US010960252B2

(12) United States Patent
Cylvick

(10) Patent No.: US 10,960,252 B2
(45) Date of Patent: Mar. 30, 2021

(54) CLIMBING-WALL AND PENDULUM-FALL, SWING APPARATUS AND METHOD

(71) Applicant: ZIPHOLDINGS, LLC, Wanship, UT (US)

(72) Inventor: Eric S. Cylvick, Wanship, UT (US)

(73) Assignee: ZIPHOLDINGS, LLC, Wanship, UT (US)

( * ) Notice: Subject to any disclaimer, the term of this patent is extended or adjusted under 35 U.S.C. 154(b) by 63 days.

(21) Appl. No.: 16/431,524

(22) Filed: Jun. 4, 2019

(65) Prior Publication Data

US 2019/0366141 A1 Dec. 5, 2019

Related U.S. Application Data

(60) Provisional application No. 62/680,909, filed on Jun. 5, 2018, provisional application No. 62/757,577, filed (Continued)

(51) Int. Cl.

| | |
|---|---|
| ***A63B 9/00*** | (2006.01) |
| ***A63B 69/00*** | (2006.01) |
| ***A63B 21/00*** | (2006.01) |

(52) U.S. Cl.

CPC ..... *A63B 9/00* (2013.01); *A63B 21/4007* (2015.10); *A63B 69/0048* (2013.01)

(58) Field of Classification Search

CPC ... A63B 9/00; A63B 69/0048; A63B 21/4007; A63B 2220/20; A63B 71/022;

(Continued)

(56) References Cited

U.S. PATENT DOCUMENTS 3,760,910 A 9/1973 Koshihara
4,449,716 A * 5/1984 Goldy ..... A63B 69/0064 254/398

(Continued)

FOREIGN PATENT DOCUMENTS

EP 3227990 A1 10/2017

OTHER PUBLICATIONS httPS://www.ohiopowertool.com/images/Product/medium/3881.jpg, Image from Ohio Power Tool website, Mar. 3, 2018.

(Continued)

*Primary Examiner* — Garrett K Atkinson
(74) *Attorney, Agent, or Firm* — Pate Baird, PLLC

(57) ABSTRACT

A climbing wall defines vertical, transverse (horizontally in-and-out, toward-and-away-from wall) and lateral (horizontally sideways) directions, mutually orthogonal. A surface treatment simulates rock by texture, holds, or both. A line (rope, cable) extends from a belay anchor, spaced away from the wall, to a climber at the wall. Line distance is controlled to eliminate slack to start, and continuously if the wall is increasingly steep and possibly curving sideways (laterally). When climbing ends, the climber swings transversely (and, optionally, laterally sideways) away from the wall in a pendulum fall, swinging (oscillating) about the belay anchor for multiple cycles and clear of contact with the wall. The fall may be intentional (the climber releasing a grip on the wall), accidental (falling from own weight), or due to line tension initiated by an automated timer or operator intervention.

14 Claims, 47 Drawing Sheets

Related U.S. Application Data on Nov. 8, 2018, provisional application No. 62/839,665, filed on Apr. 27, 2019.

(58) Field of Classification Search

CPC ..... A63B 2225/20; A63B 2220/51; A63B 71/023; A63B 2225/093; A63B 71/0054; A63B 2210/50; A63B 2220/80; A63B 2209/02; A63B 2225/50; A63B 2220/10; A63B 71/02; A63B 1/00

See application file for complete search history.

(56) References Cited

U.S. PATENT DOCUMENTS 4,458,781 A * 7/1984 Ellis ..... E06C 7/186 182/10
4,596,314 A 6/1986 Rogelja
4,997,064 A * 3/1991 Motte ..... A62B 35/0093 182/19
5,577,576 A 11/1996 Petzl et al.
5,850,893 A 12/1998 Hede et al.
6,083,142 A * 7/2000 Wilson ..... A63B 69/0048 280/DIG. 8
6,322,483 B1 * 11/2001 Rotella ..... A63B 21/0552 482/121
6,907,960 B2 6/2005 Klingler
6,908,418 B2 * 6/2005 Saure ..... A63B 21/0552 482/121
7,261,278 B2 8/2007 Ball et al.
7,381,137 B2 * 6/2008 Steele ..... B61B 7/00 104/113
7,600,610 B2 * 10/2009 Deuer ..... F03D 80/50 182/8
7,976,445 B2 * 7/2011 Lalaoua ..... A63B 21/1654 482/129
D654,124 S * 2/2012 Davis ..... D21/662
8,141,681 B2 * 3/2012 Brickell ..... A62B 1/10 182/37
8,205,718 B2 * 6/2012 Taylor ..... A63B 69/0048 182/231
8,490,751 B2 7/2013 Allington et al.
8,616,333 B2 12/2013 Schwarzenbach et al.
8,821,359 B1 * 9/2014 Kassel ..... A63B 21/4043 482/121
8,851,235 B2 10/2014 Allington et al.
8,986,178 B2 * 3/2015 Klopman ..... A63B 7/085 482/142
9,044,631 B2 6/2015 Gerner et al.
9,174,073 B2 11/2015 Casebolt et al.
9,220,966 B2 * 12/2015 Garner ..... A63B 21/068
9,339,682 B2 * 5/2016 Braier ..... A63B 21/1618
9,427,622 B2 * 8/2016 Thrasher-Rudd ..... A63B 21/4034
9,480,865 B2 * 11/2016 Naylor ..... A62B 35/0056
9,545,533 B2 * 1/2017 Boyer ..... A63C 17/015
9,630,043 B2 * 4/2017 Foster ..... A63B 21/4035
9,636,535 B2 * 5/2017 Schleiden, II ... A63B 23/03541
9,707,420 B2 7/2017 Sinkaruk
9,732,956 B2 * 8/2017 Benedict ..... A63B 7/085
9,764,175 B2 * 9/2017 Klopman ..... A63B 7/085
9,867,452 B1 * 1/2018 Martinez ..... A47C 1/146
9,962,588 B2 * 5/2018 Allington ..... A63B 69/0048
10,376,798 B2 * 8/2019 Hreniuk-Mitchel ... A63G 21/22
10,780,360 B2 * 9/2020 Hreniuk-Mitchell .... A63B 9/00
2002/0046903 A1 * 4/2002 Strickler ..... A62B 35/0093 182/36
2003/0029672 A1 2/2003 Argoud
2004/0087420 A1 * 5/2004 Montesquieux ... A63B 23/0355 482/129
2004/0215114 A1 * 10/2004 Cruz ..... A61H 11/00 601/132
2004/0238277 A1 * 12/2004 Kruse ..... A63B 29/02 182/36
2006/0027134 A1 * 2/2006 Steele ..... B61B 12/06 104/113
2007/0175698 A1 * 8/2007 Ketring ..... A62B 1/14 182/8
2007/0205048 A1 9/2007 Klingler
2008/0011543 A1 1/2008 Klingler
2008/0185221 A1 * 8/2008 Postma ..... A63B 69/0048 182/18
2008/0189915 A1 8/2008 Klingler
2008/0245611 A1 10/2008 Klingler
2009/0075788 A1 * 3/2009 Hetrick ..... A63B 21/4035 482/91
2009/0211846 A1 * 8/2009 Taylor ..... A63B 69/0064 182/231
2012/0238421 A1 * 9/2012 Klopman ..... A63B 7/085 482/142
2013/0165301 A1 * 6/2013 Thrasher-Rudd ..... A63B 23/03575 482/129
2013/0180800 A1 7/2013 Mauthner
2013/0240298 A1 * 9/2013 Naylor ..... A62B 35/00 182/231
2014/0375158 A1 12/2014 Allington et al.
2016/0089577 A1 * 3/2016 Boyer ..... A63B 22/18 472/135
2016/0245503 A1 * 8/2016 Benedict ..... F21V 23/008
2016/0325130 A1 * 11/2016 Grund ..... A63B 7/085
2016/0361660 A1 * 12/2016 Hreniuk-Mitchell ..... A63G 31/04
2017/0274261 A1 9/2017 Allington et al.
2018/0035792 A1 * 2/2018 Martinez ..... A01M 31/02
2018/0185690 A1 * 7/2018 Coulter ..... A63B 7/02
2019/0358551 A1 * 11/2019 Hreniuk-Mitchell ..... A63G 21/16
2020/0144824 A1 * 5/2020 Campus ..... H02S 10/10

OTHER PUBLICATIONS https://spectrumsports.com/wp-content/uploads/autobelay_gal41.jpg, image from Spectrum Sports website, Mar. 7, 2018.
https://spectrumssports.com/wp-content/uploads/autobelay_gal51.jpg, image from Spectrum Sports website, Mar. 7, 2018.
https://spectrumsports.com/wp-content/uploads/autobelay_gal11.jpg, image from Spectrum Sports website, Mar. 7, 2018.
https://spectrumsports.com/wp-content/uploads/3c_climbndangle_mobile_gal11.jpg, image from Spectrum Sports website, Mar. 7, 2018.
https://spectrumsports.com/wp-content/uploads/3c_climbndangle_mobile_gal7.jpg, image from Spectrum Sports website, Mar. 7, 2018.
www.bigrush.co.za, Big Rush Urban adrenaline, Tallest Guinness World Records: Tallest Swing!, image from Big Rush website, Apr. 12, 2018

* cited by examiner

CLIMBING-WALL AND PENDULUM-FALL, SWING APPARATUS AND METHOD

RELATED APPLICATIONS

This application: claims the benefit of U.S. provisional Patent Application Ser. No. 62/680,909, filed Jun. 5, 2018; U.S. Provisional Patent Application Ser. No. 62/757,577, filed Nov. 8, 2018; and U.S. Provisional Patent Application No. 62/839,665, filed Apr. 27, 2019, all of which are incorporated herein by reference.

This patent application hereby incorporates by reference U.S. Pat. No. 10,010,798, issued Jul. 3, 2018; U.S. Pat. No. 9,669,319, issued Jun. 6, 2017; U.S. patent application Ser. No. 15/605,786, filed May 25, 2017; U.S. patent application Ser. No. 16/021,625, filed Jun. 28, 2018; U.S. Provisional Patent Application Ser. No. 62/680,909, filed Jun. 5, 2018; and U.S. Provisional Patent Application Ser. No. 62/757,577, filed Nov. 8, 2018.

BACKGROUND

Field of the Invention

This invention relates to amusement rides and, more particularly, to novel systems and methods for combining a climbing wall and a swing mechanism.

Background Art

Rock climbing is a popular sport that has become more universal as people have become aware of its possibilities. The increase in artificial climbing walls and indoor climbing gyms containing such walls has led to increased training and recreational climbing on artificial climbing walls.

Meanwhile, thrill rides have been a staple of circuses, carnivals, and theme parks almost since their inception. At these venues, several requirements, including safety and skill, tend to increase the need for trained staff, trained users, and safety mechanisms for the devices. In climbing this need is met with top roping and a belayer, a second person. In thrill rides, this need is met by locks, cages, safety bars, and the like that fix persons in a cart that is closely controlled on some form of support system.

What is lacking is the fun of rock climbing, combined with a swing for a safe pendulum fall as a termination to the climb, and a safe belay throughout. It would be an advance in the art to provide a system that combines a climbing wall, engineered to this specific purpose, with a support system for a swing acting as a belay system. In this way, at any point on a climb, by reason of a climber falling, missing a hold, finishing a route, or timing out, the belay system may be engaged to operate as a swing providing additional enjoyment, as well as a termination and ready completion of one user's use on such a system. Thus, the fun is doubled, the safety is maintained and increased, the level of skill is reduced, while permitting higher levels of skill to still enjoy equally the thrill of the climb and of the pendulum fall. Meanwhile, the number of attendants required for operating a ride is minimized.

BRIEF SUMMARY OF THE INVENTION

In view of the foregoing, in accordance with the invention as embodied and broadly described herein, a method and apparatus are disclosed in one embodiment of the present invention as including a wall extending forward and above a climber, and typically extending laterally to the right or the left in front of the climber. Typically, the wall will be arcuate, and mounted on a truss as an underlying frame. An overhead beam may extend back from the main frame to suspend a belay line. In other embodiments, the overhead center of suspension of a climber may be positioned on some other independent structure, such as a beam, yoke, arch, or the like some distance away from the climbing wall.

A system combining a climbing wall with a swing may be characterized as a climbing wall that will terminate in a pendulum fall. The pendulum fall results in a swinging motion of a harnessed user away from the climbing wall and out into space away from the wall. A user continues to swing, until the swinging has decayed, after which the system descends the user to the original launch area from which the climb was begun, to be unclipped from the belay line, and released from the climbing area.

New climbers are harnessed, brought to a launch deck, clipped into a belay line, and the line is tensioned to belay the climber on the climbing wall. The climbing wall may be circular in its concavity, parabolic, elliptical, or some other shape. Typically, a lateral (sideways) progress (e.g., curvature) of the wall, or of the climbing path, exists with rising altitude. Thus, a climber is typically climbing not above the portion of the wall that has been climbed, but over empty space below the wall, which angles to the right or the left, as it ascends.

The system operates as both a climbing wall and a swing. Typically, a climber will enter a preparation area and harness up with a full body harness. The climber may then proceed at an appropriate time with certain permissions and safety precautions in place, to a launch area. A computer may be used to control tension in a connecting line, rope, cable, or the like. Also, a computer may be used to control lengths of line extended, detect position, read any parameter sensor, and track overall maintain safety conditions.

Eventually, in a launch area, a line is connected to a harness on a user. Upon a proper safety check, the user may then proceed to climb the wall. Climbing is done by using hand holds, foot holds, and a textured surface of the wall. The wall is maintained in its place by a suitably strong and stiff framing system. Stringers interconnected by struts provide comparatively low or reduced weight with comparatively increased strength and stiffness. To that end, the stringers may have end plates maintaining their relative position with respect to one another, while the struts maintain that positioning.

Fasteners may be used to connect segments of framing. Each segment may be made up of stringers spaced apart and held together by struts. Segments may be connectable to each other by end plates secured to those stringers.

Supports or stabilizers may be provided to maintain erect a comparatively narrow wall by broadening its base on a pad, foundation, footings, trailer, ground, floor or the like. The frame may actually be anchored and supported below a supporting surface that supports a user. In other embodiments, a base may be secured to a supporting surface, foundation, footings, trailer, floor or the like. The base may support the frame extending away from the base and upward. However, an arcuate wall will typically proceed upward, forward, and to the left or right away from a starting position.

Provisions for safety may be used for a system, such as providing buffering spaces between active areas, preparation areas, and the like. Likewise, padding, elastomeric materials in flooring, and the like may also protect against falls, bumps, stumbling, and the like. In certain embodiments, a launch deck may actually exist in a launching area, and may exist above an underlying supporting surface. In other embodiments, the underlying supporting surface may be a floor from which a climber moves away up the wall.

The climbing wall may be vertical, may have an angle less than vertical, and may be suitably shaped. Typically, in order to improve the operation of the swing, and provide a comparatively constant radius of a harness of a user away from some center of pivot, the wall may have a circular shape, a parabolic shape, an elliptical shape, or some other arcuate shape.

Depending on the shape of the wall, a positioner may either move a center of pivoting of a line, or may take up a certain length of line in order to assure that a climber is always belayed while on the wall, and is always safe to swing upon dis-attaching from the wall.

A positioner may involve a trolley with wheels operating along a rail in order to support a hanger with connections to the line. In other embodiments, a ball screw system may move a trolley, a cable system may do so, a hoist may operate directly on the line, without moving a center of pivot, or the like.

Typically, sensors may detect position, loading (such as tension, force, pressure, stress, etc.), or other parameters in order to detect the condition of the line and of the user. Falling from the wall is an eventuality in virtually every case. It forms a part of the operation of the system that provides part of the thrill of the climb, and falling in a pendulum fall therefrom. A winch, ball screw, or other system may be operated by a controller to take-up line, move a center of pivoting, or the like. In certain embodiments, a process for operation may involve admitting a climber, harnessing the climber in a safe area followed by moving the climber to an active area.

Clipping in a harness of a user to a belay line may be followed by positioning or retracting the center of pivot or the line itself in order to take up any slack. Sensors may sense tension, position, or other loading or motion parameters in order to determine when to open the interlocks and permit the climber to climb. Monitoring the various sensors may determine whether a climber has timed out beyond a permitted time on the wall, or topped out at the maximum physical extend of the wall, or has fallen from the wall.

Accordingly, a retractor or positioner may take-up line or change position of a center of pivot to swing the climber away from the wall, to eventually oscillate back and forth until motion is decayed sufficiently to descend safely to the floor or supporting surface where the climber can be released (unclipped, exit, and unharnessed) and leave the active area.

Various safety checks may be provided such as stop lights, actuation of a retractor or positioner to remove the ability of a climber to move toward the wall, or the like. Typically, inspection, safety testing, and the like will make a user safe in order to continue advancing to climbing a wall. Other safety mechanisms and sensors are also provided.

A method of belay may simulate both rock climbing and a super-sized swing along an arc about a belay anchor or point of belay (center of pivot). One may provide a wall simulating a rock formation and extending above a supporting surface, such as the ground, a floor, a concrete pad, a deck on a trailer on the like. A belay anchor may be provided remote from the wall, supported by one of several mechanisms such as an arch from the ground or another supporting surface, a yoke from the same or from a base of the climbing wall, or even a cantilevered beam extending from the top of the wall back over the horizontal distance to the base of the wall.

Upon harnessing a climber into a harness and securing the harness to the belay anchor by a line extending therebetween, a climber may be protected (belayed) against falling. A climber may fall, but the line assures that the climber will not fall straight down, nor uncontrolled.

A retractor system may minimize a length of the line between the belay anchor and the harness during an ascent of the climber along the climbing wall some distance. Any of various mechanisms include a ball screw assembly, a winch, an ascender, or other one-way take-up devices may be employed to take up slack if the natural curvature of the wall does not do so.

Rather than climbing up a vertical wall, a climber may encounter a circular, elliptical, parabolic, or other shape for the climbing surface (presented face) of the wall. A frame behind the wall supports and stiffens a front facing material such as plywood provided with texturing, handholds, or both to simulate rock.

Rather than descending in a belayed climb using friction, a climber "falls" from the wall in a pendulum fall. However, this is not a conventional, and dangerous pendulum fall so assiduously avoided by rock climbers. A conventional pendulum fall occurs when a climber falls from a location that is some horizontal distance away from the closest protection, typically a bolt and hanger through which a "quick draw" is anchored. A quick draw is two carabiners with a flexible sling extending between them, one carabiner to connect to the hanger and one carabiner to connect to the rope.

A conventional pendulum fall will typically drag a climber along the face of a rock formation or climbing wall, banging and bruising against protrusions from the surface. If a formation or wall has an overhang, the pendulum may cause a climber to swing back and into the main vertical portion of the rock or wall.

In contrast, in a method and apparatus in accordance with the invention, a fall (dropping the climber in harness in a pendulum fall) swings the climber and harness away from the wall, due to the horizontally remote location of the belay anchor. The harness and climber will thus swing in an arc about the belay anchor for multiple cycles, like a rope swing on a tree.

When the swinging has stopped, or decayed sufficiently, or when a time limit has expired, the harness may lower to stop the swinging and release the climber from the line by unclipping a carabiner connecting the harness to the line. By using a full body harness, and properly locating a connecting ring or the like, a user (climber) may be maintained upright during swinging, or nearly so, or horizontal. Upright appears to provide the fewest complications for swinging and for stopping.

In some embodiments, the line (e.g., a rope, wire rope, cable, etc.) may be the pivoting member as it flexes near the belay anchor. It will typically run over a pulley. It may instead wrap around a pulley which then pivots on an axle secured at the belay anchor location.

Taking up slack in the line may be important. An attendant may take up slack by pulling the line through an ascender device or other one-way holding device. Alternatively the pivoting point may be connected to a trolley or other system motorized to move away from the wall (horizontally, vertically, or both) the point at which the line pivots. This action may be taken before a climber starts climbing, thereafter, and often both. Sensors may detect tension or slack in the line, position, or both and trigger taking up of the line or moving of the belay anchor location or belay pivot in response to detection of the slack, a position, etc.

Taking up slack may include retrieving a portion of the line or moving the belay anchor (meaning any component of that belay anchoring system that may draw the climber further from the wall) away from the wall. The wall is typically curved to change in slope with altitude as one climbs up the wall. In some embodiments, a climber might swing clear with no active element required to distance the climber from the wall upon falling therefrom. In other embodiments, slack or length may be taken up during the climb, upon falling, after falling, or any combination thereof to assure a safe, oscillating movement of the climber suspended on the line.

The wall may be shaped to extend farther sideways on a first edge thereof and retreat farther sideways on a second edge thereof, opposite the first edge, with altitude. The wall may lean, proceed, or drift right or left in a warping shape with distance up the wall. In this way, a fall from the wall is always into space below the wall rather than downward to a lower part of the wall.

The wall may be constructed to deploy on a trailer secured to support and stabilize the wall in the deployed configuration. The wall may lie down for storage and transport to be later pivoted up (tilted up) to stand on the trailer, or to stand on the ground behind the trailer (by pivoting about a horizontal axis across the back end of the trailer for example).

The wall is more suitable, and more realistic if it has a surface containing texturing simulating the surface roughness of rock and holds of various sizes and shapes simulating a rock formation. Holds may be grasped or otherwise engaged by hands or feet, some being suitable for both.

The slope of the wall requires less active control over the line if it changes strictly monotonically (always in one direction, regardless of rate of change or any specific value of slope). Slope is sometimes called "rise over run," meaning "rise divided by run," or a change in vertical elevation as a function of change in horizontal position. One may think of an increase in the angle of the wall measured with respect to a horizontal line (datum) extending behind (back side, opposite the climbing face) and away from a base of the wall at a bottom end of the wall. That angle (slope) will start comparatively smaller and grow comparatively larger as one ascends the wall. It may even proceed to an overhang, and still be monotonically increasing. From the front, climbing face, the wall begins closer to parallel with a supporting surface, decreasing to zero if it achieves a completely horizontal (parallel) overhang above a horizontal supporting surface.

The wall may comprise a surface supported by a frame fixed with respect to the supporting surface proximate a first, proximal, end of the frame. The frame will typically be cantilevered (extended unsupported except by itself away from some anchoring location closer to a base end) near a second, distal, end thereof. The surface may be a surface of a fiberglass wall or other composite structure. Plywood may also serve as a wall material, with texturing and hand holds attached thereto.

The belay anchor is secured to a support. That support may be a beam secured to a top end of the wall to be supported thereby and extend away therefrom. The support may be an arch, structurally independent from the wall. A yoke extending upward and away from a bottom end of the wall or from a supporting surface nearby may provide support for a beam extending across the yoke. If other structures are nearby, they may serve as anchoring systems from which to suspend a belay anchor. For example, a pulley may be suspended from cables extending in at least three directions to completely stabilize it. Those cables (wire ropes), or the like may be sufficiently strong and stiff to extend from structures (trees, towers, poles, buildings, amusement ride frames, etc.) to completely eliminate any need for an overhead structure of solid, inflexible, structural members thereabove.

An apparatus as an amusement ride may include a wall, extending above a supporting surface and containing fixtures along a climbing route thereon simulating rock climbing. A belay anchor may be secured horizontally away, and vertically away, to be remote from the wall, and draw a falling climber horizontally theretoward.

A line may connected to pivot at or about the belay anchor. A line (rope, wire rope, chain, etc.) may extend over a pulley to flex therearound. It may wrap and around a pulley and be clamped to itself, while the pulley pivots about an axle fixed above and away from the wall. The position of the pivoting point may be moved by a motor, winch, slide, ball screw, or other "retractor" mechanism to increase distance of a harness, and thus a climber, away from the wall after a fall.

A harness, secured to the belay anchor by the line and operable therewith may receive a climber therein. The line may thus belay the climber while climbing on the wall. It is especially intended that it support the climber oscillating in an arcuate path away from the wall upon falling, by the climber, from the wall. To do so, a retractor may activate or otherwise act to increase the distance of a climber away from the wall by about two to four feet (50 cm to 1.3 meters) in order to assure that no body part nor component of the moving structures, line, or harness may contact the wall or its underlying frame, nor any other fixed object.

A positioner may operably connected to swing the climber clear of the wall by adjusting at least one of a position of the belay anchor and a length of the line. Orientation of the climber during the fall and swinging may be controlled by the harness. If the harness constitutes a full-body harness, a single link proximate an upper portion of a torso of the climber will stably and safely suspend the climber from the line with little danger of ever contacting the wall on a return of the "swing." In fact, with a "warped wall" ascending as it proceeds sideways with elevation, may be rigged to assure that a user cannot return into contact with the wall.

The harness is secured to the belay pivot by the line extending therebetween. A positioner operates to minimize a length (radius, in a fall) of the line between the belay anchor and the harness during an ascent of the wall by the climber. A guide may be installed to urge the line and harness along a constant path, without precession into another vertical plane. Thus, it is guided away from oscillating back or returning toward a lower portion of the wall during the multiple cycles of oscillating.

The positioner may be configured to lower the climber in the harness to an ending position proximate the supporting surface. This may be timed, or simply occur when oscillations have died down in amplitude (decayed) sufficiently that the climber can stop moving and stand on the supporting surface. An operator may intervene to hold a tether to the harness or activate an interfering element (bar, pulley, etc.) or two to capture the line and damp oscillations.

In some embodiments, a frame structurally supporting the wall (including its frame; or sometimes the frame alone as a support for the wall) may extend as a cantilever (unsupported, other than self-supporting). This will typically mean it extends somewhat horizontally, as well as vertically, above the supporting surface. It may extend above some lower portion of itself that is stabilized by struts, outriggers, or the like and anchored at a base end to the supporting surface or the ground below.

A control assembly may be operably connected to control a radius of extension of the line between the positioner and the wall. This may by operated and activated by an attendant. All or part of the activities may be programmatically controlled to respond to sensors, attendant activated buttons or other inputs, or the like.

Alternative belay support structures for extending from the supporting surface may anchor in at least two distinct locations to support the belay anchor. This creates a clear space for the oscillations of the climber therewithin and away from contact directly with any fixed object. Fixed objects of concern include the wall, its underlying frame, and any belay support structure. Upon falling from the wall by the climber, the climber needs to swing clear of all fixed objects by physical configuration of the system, by active moving elements, or by a combination thereof.

A trailer may make a system mobile. A trailer may support the wall in a first, stowed, configuration reposed proximate the frame of the trailer. The wall may then move to a second, deployed, configuration suitable for climbing and extending upward away from the frame of the trailer.

Thus, in general a wall may define vertical (up-and-down), transverse (in-and-out; forward-and-backward), and lateral (side-to-side) directions with respect to the wall, all mutually orthogonal, and provided with a treatment simulating rock. A belay location is spaced laterally (sideways) and transversely (out, back and forth) away from the wall. A climber is strapped into a harness, which then secures to a line extending from the belay location. After a safety check, an attendant, the line, the belay system, or a gate may release the climber to climb the wall. Upon completion, release, timeout, fall, or other failure, a climber falls, swinging in an arc passing laterally and transversely away from the wall in a pendulum fall. The climber in harness will oscillate in a swinging motion supported by the belay location for multiple cycles without contacting the wall or other fixed object.

A fall, initiating the swinging, may itself be initiated by the climber releasing a grip from the wall, the climber falling from the wall from force of the climber's own weight, or tension applied to and in the line. Tension may be exerted in response to one of an automated timer and an operator activating the tension to pull the climber away from the wall. Force may be a result of a winch, ball screw, slide, crank, or other motorized system drawing in a portion of the line.

One method of combined belay and swinging may include providing a wall presenting a climbing surface; providing a support capable of supporting swinging by a climber about a location remote from the wall; providing a line extending from the support and capable of belaying the climber while climbing the wall; providing a belay takeup operably connected to be capable of automatically retrieving slack created in the line by the climber ascending and preventing contact by the climber with the wall and with the loading surface by containing the line against paying out from the belay takeup until after completion of the swinging on the line by the climber; harnessing the climber into a harness capable of supporting the climber and connecting to the line; securing the harness to the line when the climber is on the loading surface; retracting, automatically by the belay takeup, the line during an ascent of the climber upward along the wall; and swinging the climber in a fall along a path leading away from the wall, the fall being controlled throughout by the line and supported by the support together precluding the climber touching the wall and precluding the climber touching the loading surface.

In addition, the method may include falling by the climber from the wall as a result of at least one of the climber accidentally losing grip on the wall and the line pulling the climber away from the wall. That may include providing a pivot location on the support capable of securing the line thereagainst, the pivot location being movable along the support between a first position proximate the wall and a second position spaced away from the wall; positioning the pivot location in the first position during the ascending; and moving, by the pivot location, to the second position in response to the falling.

To this may be added defining, by the line, a first path, proceeding from the wall to a maximum extension of the line below the pivot location in the second position, and a second path, scribing an arc at a fixed radius from the pivot location in the second position. Such a method may also comprise providing an attenuator capable of reducing forces applied by the line to the climber when the first path intersects the second path during the falling.

The basic method or its alternative improvements may include providing a carrier supporting the pivot location and movable along the support by a carrier takeup; and supporting the climber above the loading surface, by the line, while returning the climber to proximate the loading surface. This may be improved by controlling the amount of the line paying out and retracting by the belay takeup; and controlling the positioning of the pivot location along the support by the carrier takeup moving the carrier with respect to the support.

To these steps may be included moving the climber along a substantially level course as the carrier moves from the first position to the second position by coordinating operation of the belay takeup and carrier takeup simultaneously. In any method hereinabove, the wall may have a surface containing at least one of texturing and holds capable of simulating a rock formation and is supported by a frame.

Likewise, any method may include providing a drop location along the support, spaced from the wall sufficiently to preclude the climber touching the wall; drawing the climber away from the wall and toward the drop location by the line; and positioning the climber under the drop location before initiating the fall.

In one embodiment of an apparatus operable as a combined belayed climbing wall and swing, the apparatus may include a wall capable of supporting a climber climbing from a starting area proximate a bottom end thereof to a completion area proximate a top end thereof; a line operably connected to belay the climber; a first takeup operably connected to automatically take up a portion of the line in response to the climber ascending the wall, and maintain the portion during falling of the climber subsequent to the climbing; a harness, capable of receiving a climber and securing to the line; and a carrier positionable proximate the wall to suspend the line to the climber during the climbing and movable horizontally away from the wall in response to the falling.

It may include the carrier, line, and harness together forming a swing capable of swinging the climber away from the wall after the climbing to oscillate about the carrier in a path perpendicular to the wall. It may also include a second takeup operably connected to move the carrier toward the wall to a belay position to effect the belaying; and a controller operably connected to control at least one of the first takeup and the second takeup and to initiate the falling.

The apparatus may include, typically, a support operating as a track extending perpendicular to a surface of the wall and supporting the carrier continuously between the belay position as a first position proximate the wall and a second position spaced away from the wall as a swinging position capable of supporting the swinging. The carrier typically is or includes a trolley capable of moving along the track in a single dimension while supporting the line suspended therebelow. Also, the line and carrier together define a first path of the climber, along the wall during the climbing, a second path of the climber away from the wall through space during the falling, and a third path of the climber constituting an oscillation with respect to the carrier fixed thereabove at the second position.

In one embodiment, an apparatus may include first and second takeups operably connected to attenuate momentum of the oscillation by the first takeup simultaneously controlling the portion of the line extending from the carrier to the climber while the second takeup changes a position of the carrier along the support. The apparatus may include a controller operably connected and to control operation of the first takeup and the second takeup. The controller may be computerized (include a processor and programming capabilities) and be programmatically controlled to operate automatically without human intervention during the climbing, falling, and swinging.

The carrier and line may define a fourth path of the climber passing horizontally toward the wall from a midpoint of the oscillation of the climber. The climber may be conducted along the fourth path by operation of the first takeup paying out the line to maintain the climber on a level trajectory and operation of the second takeup drawing the carrier toward the wall.

An apparatus operable as a combined climbing belay and pendulum swing may typically include a support capable of mounting to extend horizontally away from a top end of a climbing wall; a carrier movable along the support between a first position proximate the climbing wall and a second position remote from the wall; a line threaded over the carrier to extend therebelow and capable of connecting to a harness of a climber; and controls operably connected to be capable of controlling positioning of the carrier and the line to belay the climber during climbing by, fixing the carrier at the first position, and swing the climber away from the wall while falling from the wall, by moving the carrier to the second position, and swinging the climber in an oscillation about the carrier by fixing the carrier at the second position.

The controls include a first takeup operably connected to move the line; a second takeup operably connected to move the carrier; and a controller operably connected to control operation of the first takeup and operation of the second takeup. The line extends vertically a distance above a loading surface to a support capable of supporting swinging by a climber about a location remote from the wall.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
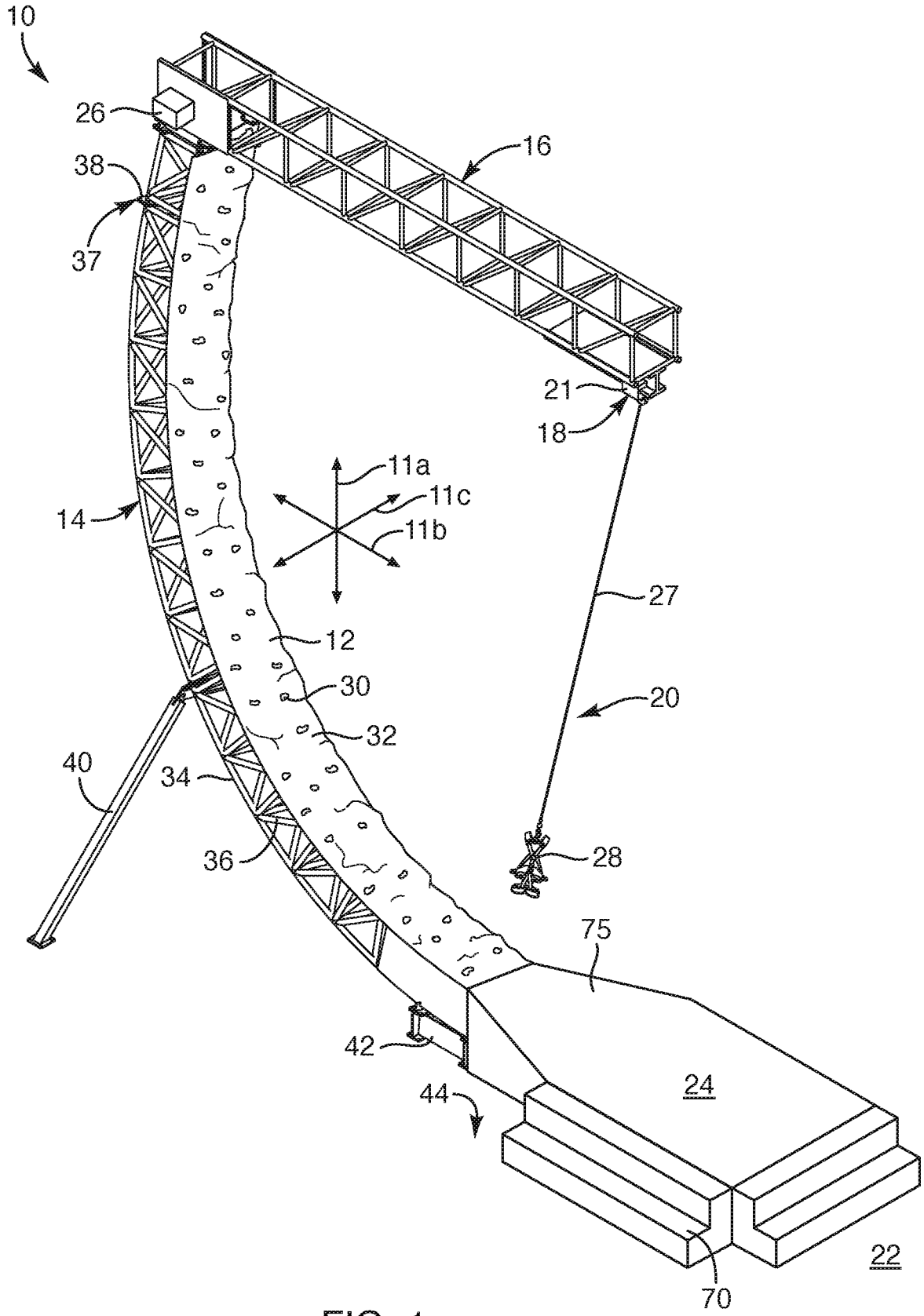
FIG. 1 is a perspective view of one embodiment of a climbing wall swing combination in accordance with the invention.
Figure 2:
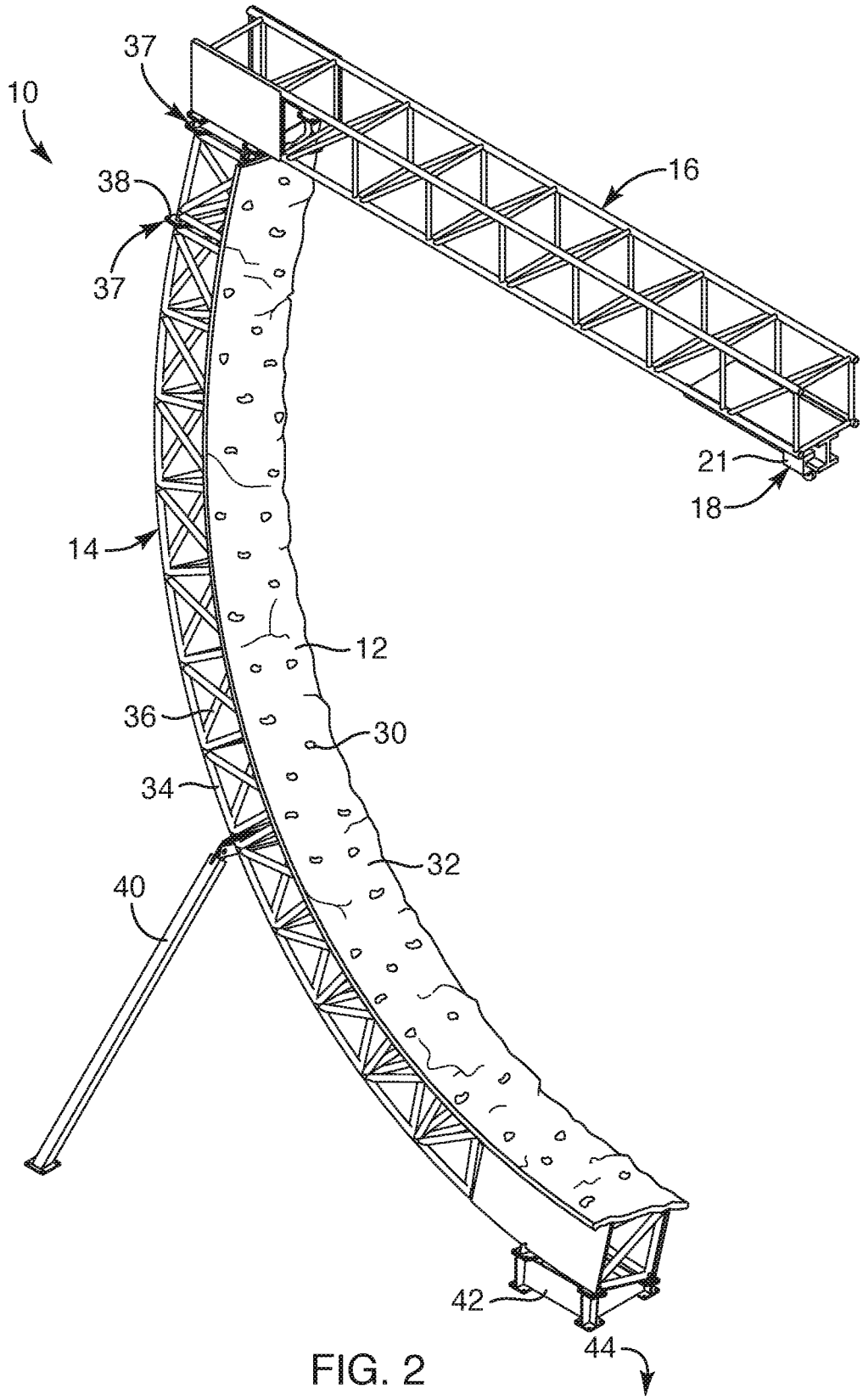
FIG. 2 is an alternative perspective view thereof, absent a launch deck, line (rope), and harness.
Figure 3:
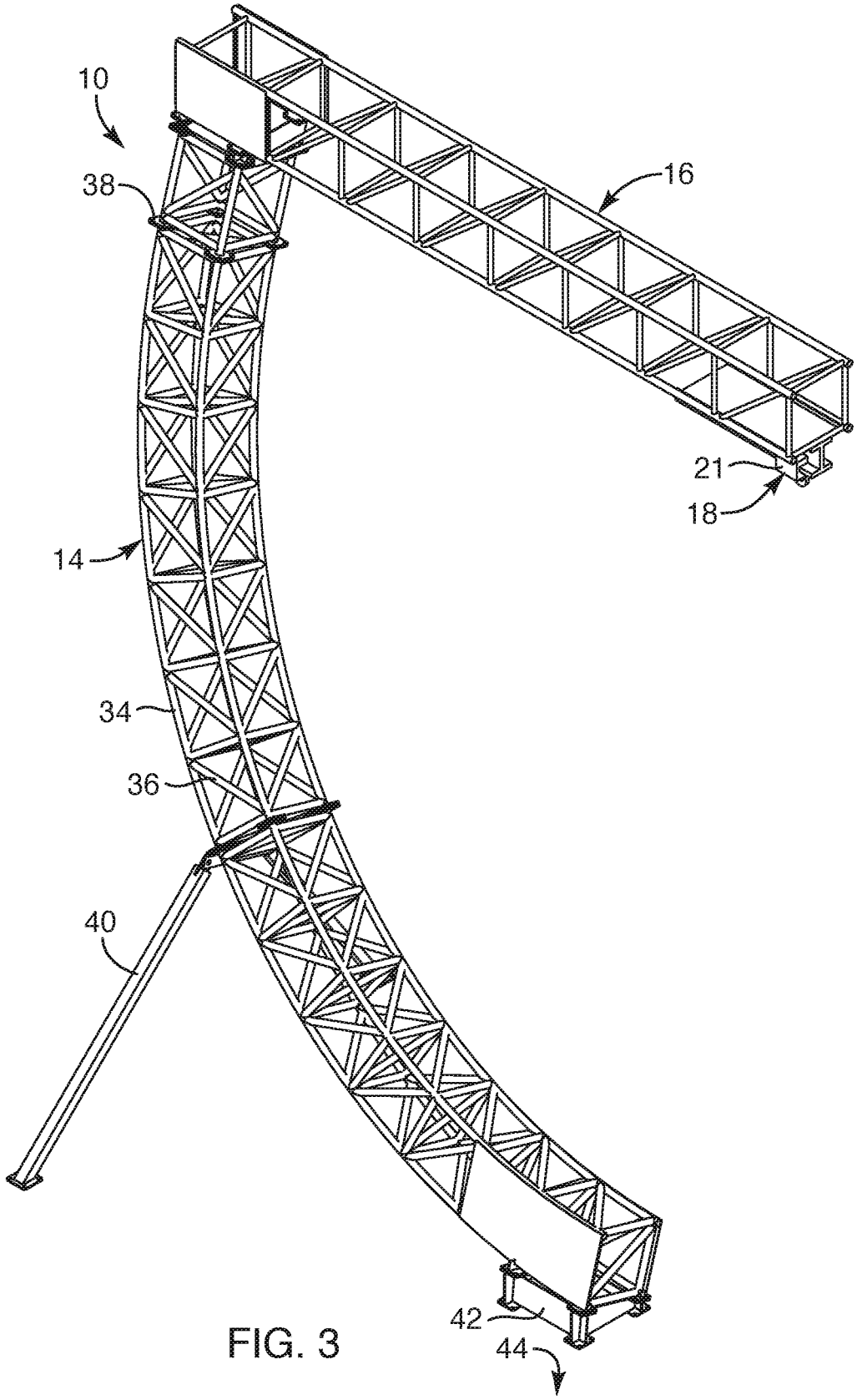
FIG. 3 is a perspective view of the principal frame structure thereof.
Figure 4:
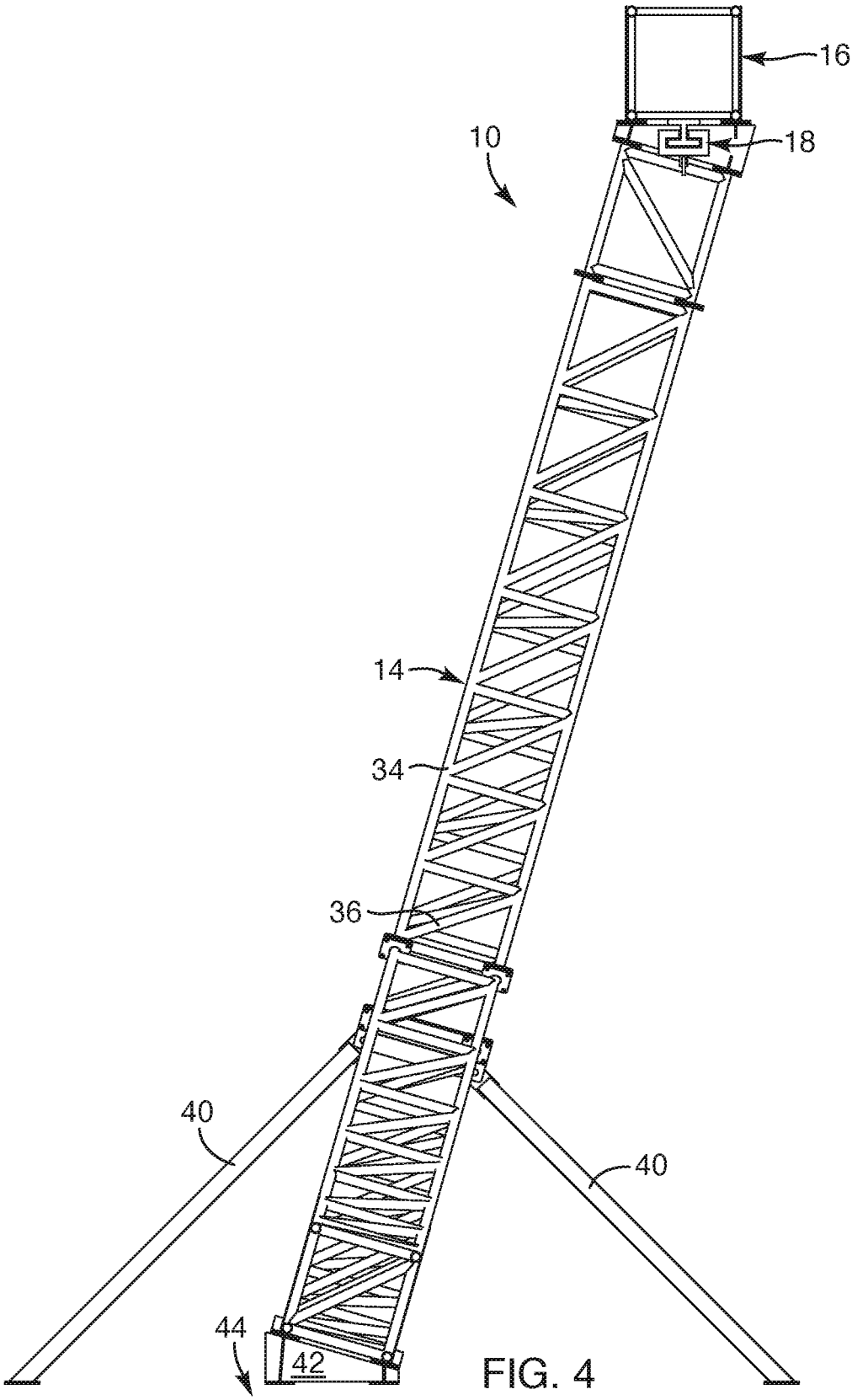
FIG. 4 is a front elevation view of the frame of FIG. 3.
Figure 5:
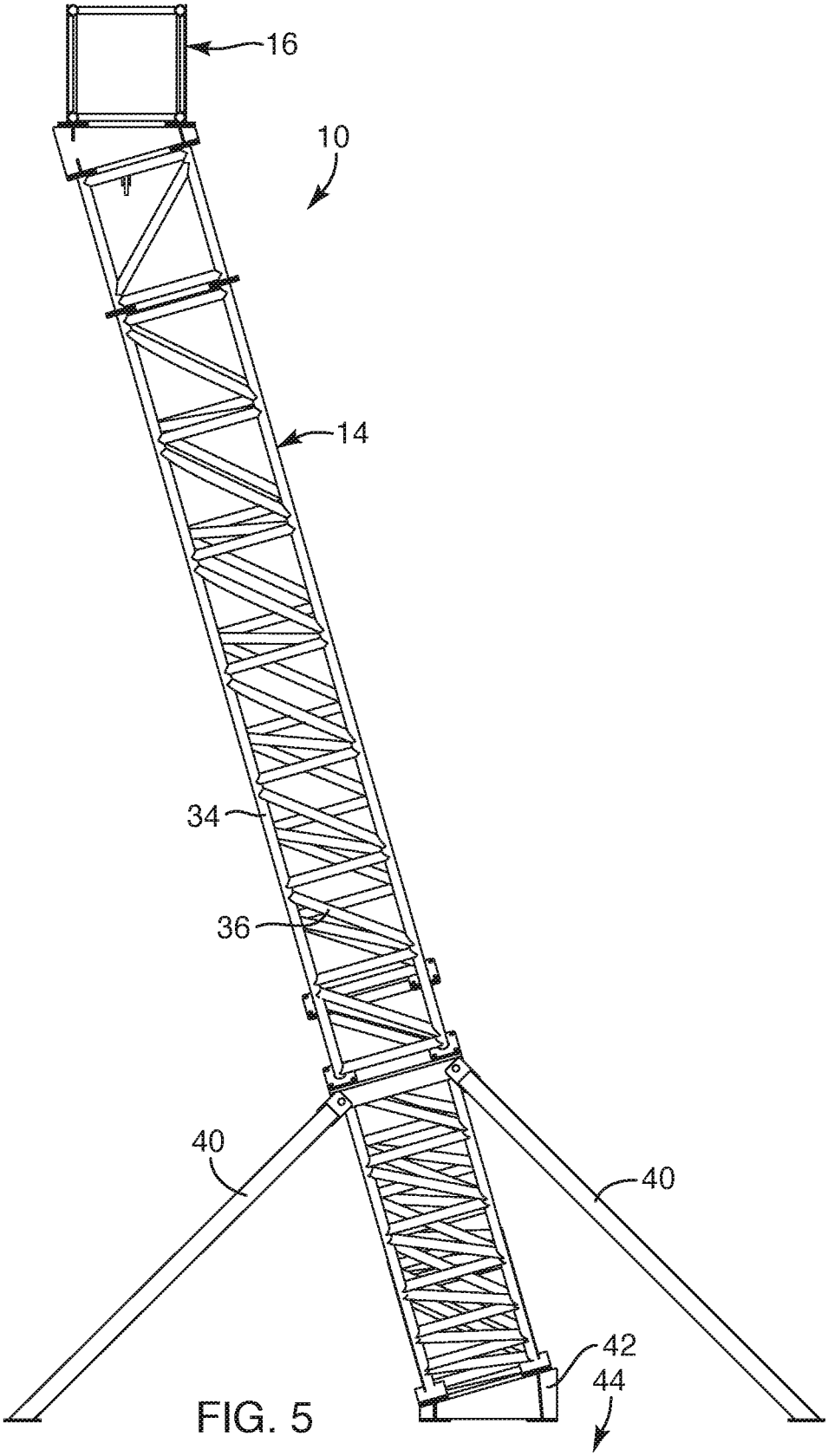
FIG. 5 is a rear elevation view thereof.
Figure 6:
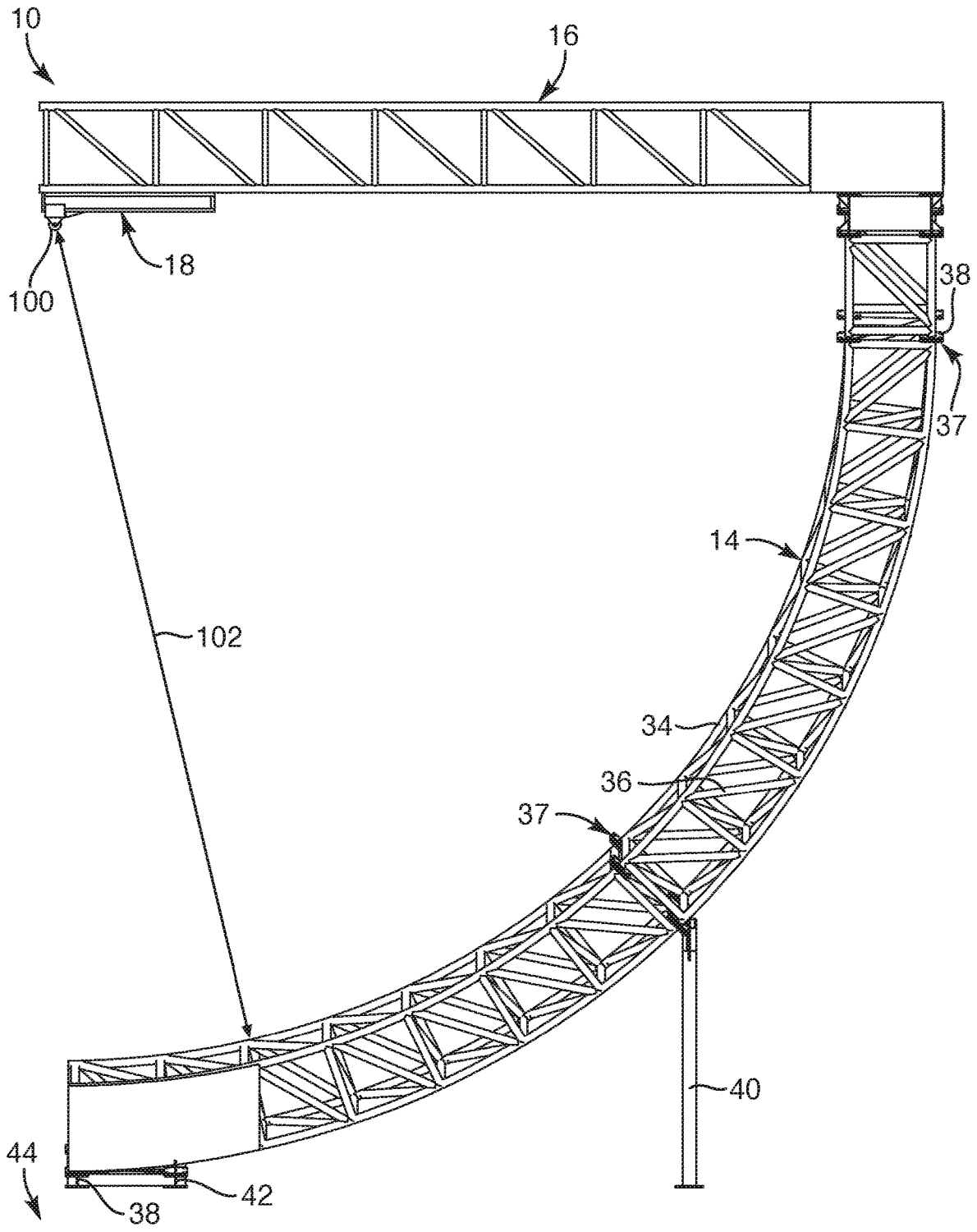
FIG. 6 is a right side elevation view thereof.
Figure 7:
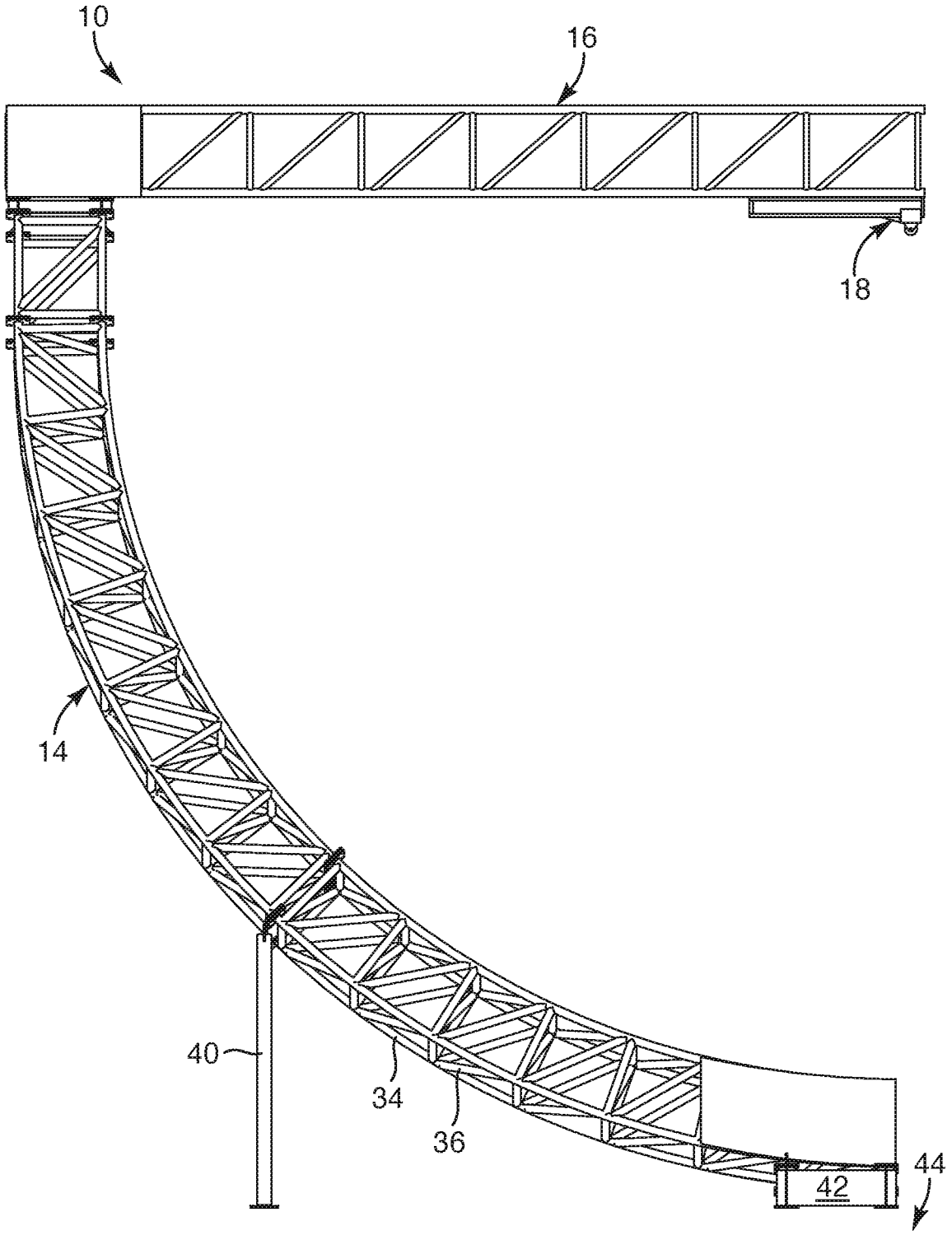
FIG. 7 is a left side elevation view thereof.
Figure 8:
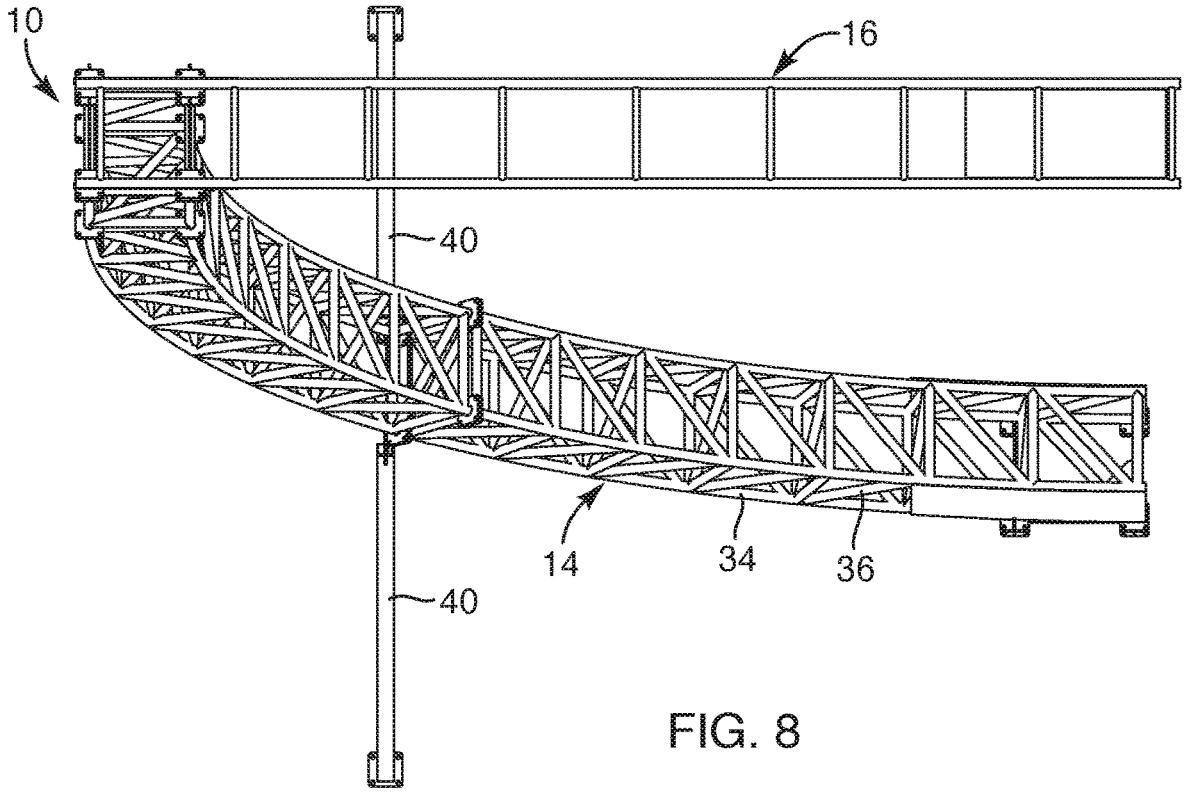
FIG. 8 is a top plan view thereof.
Figure 9:
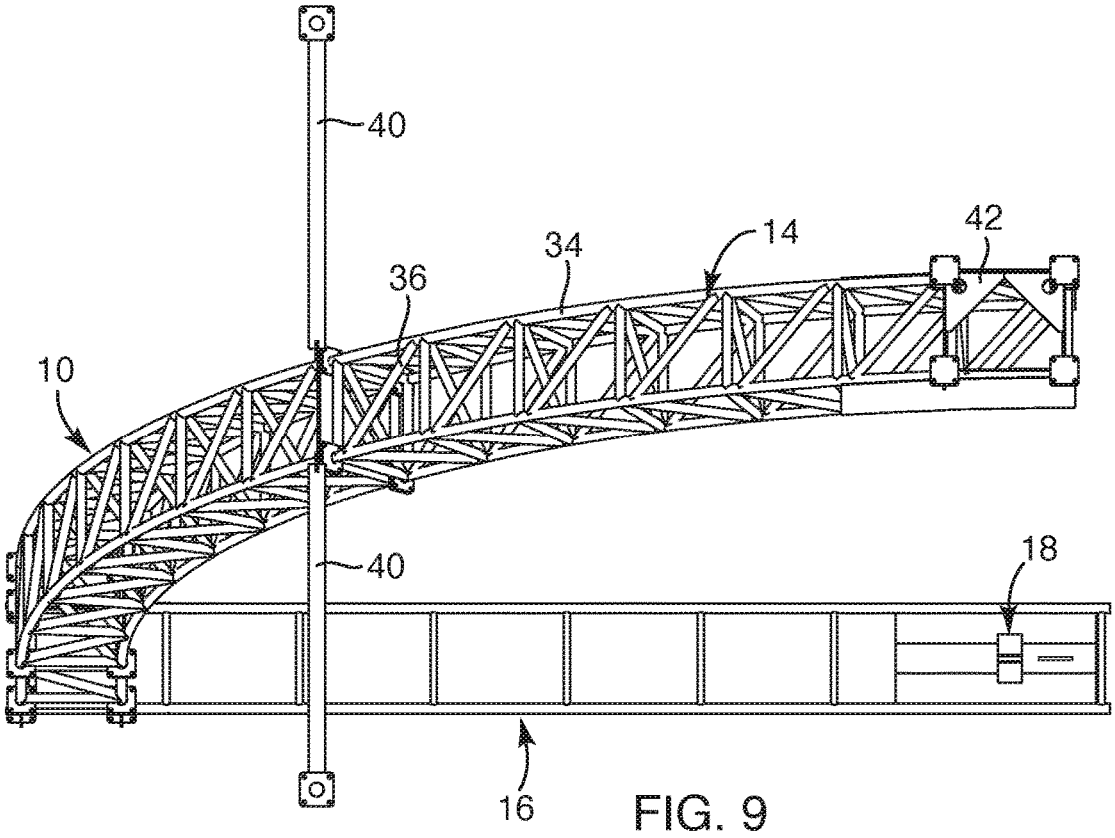
FIG. 9 is a bottom plan view thereof.
Figure 10:
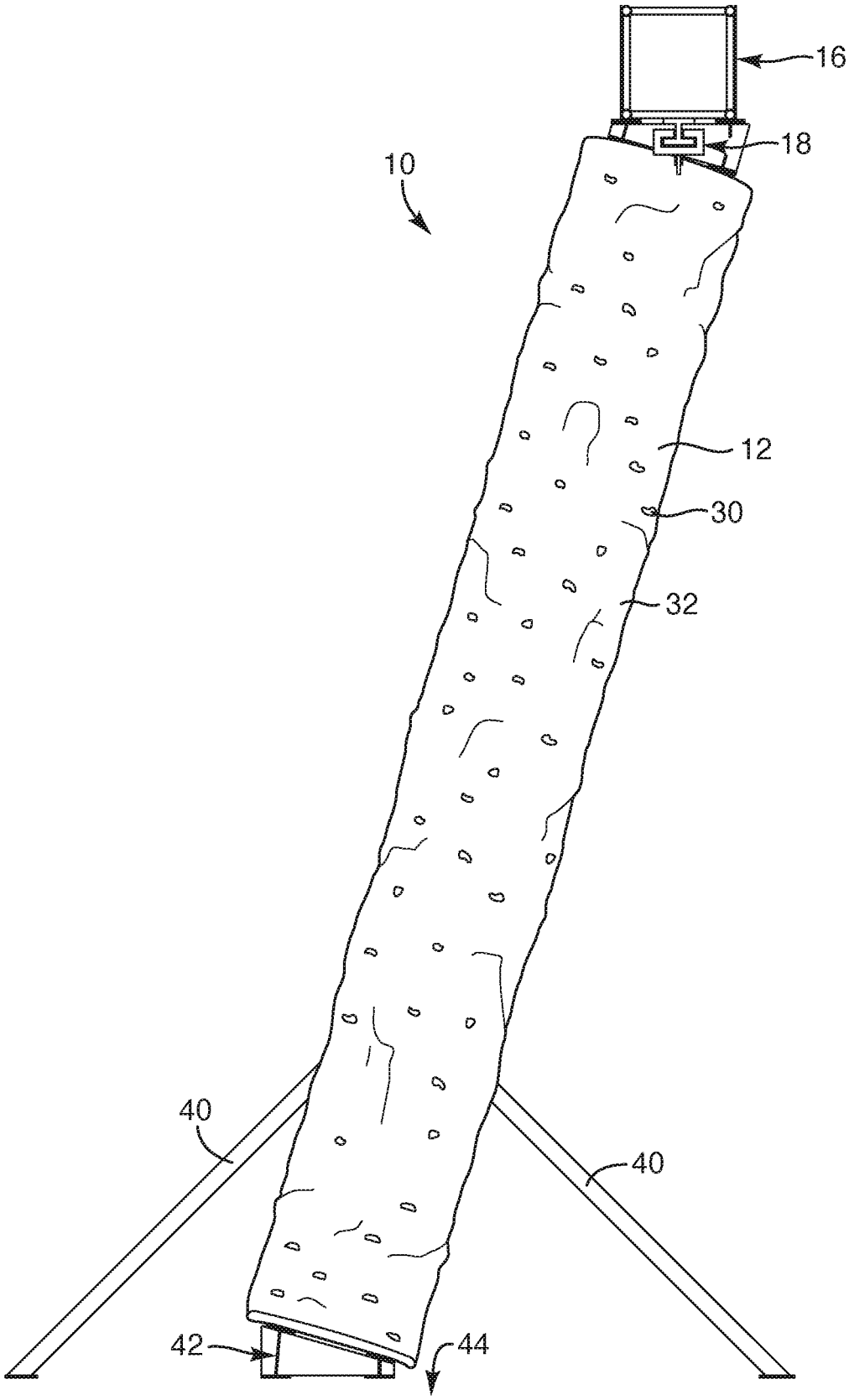
FIG. 10 is a front elevation view of the system of FIG. 1.
Figure 11:
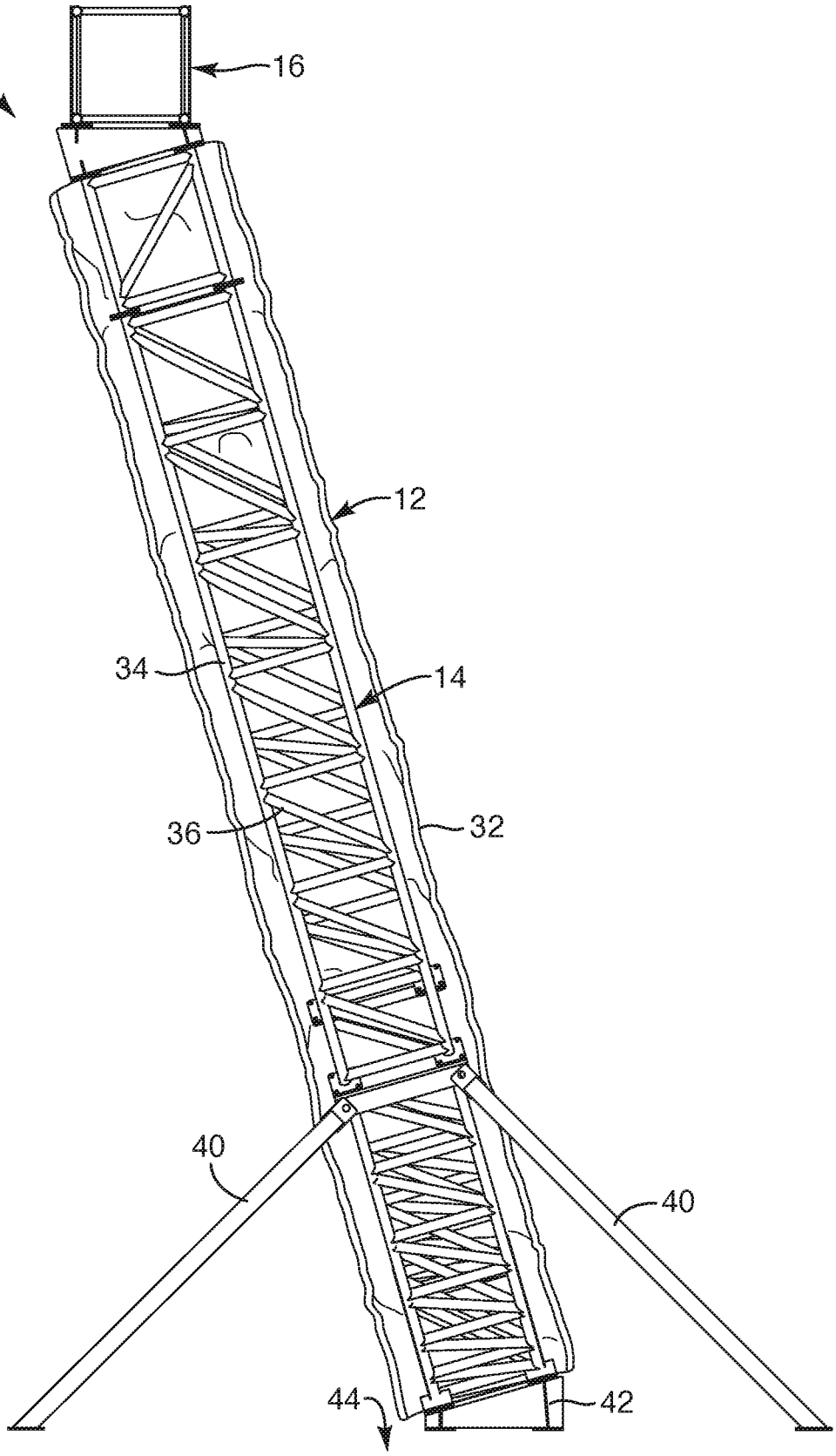
FIG. 11 is a rear elevation view thereof.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of systems and methods in accordance with the invention. The illustrated embodiments will be best understood by reference to the drawings, wherein like parts are designated by like numerals throughout.

Figure 57:
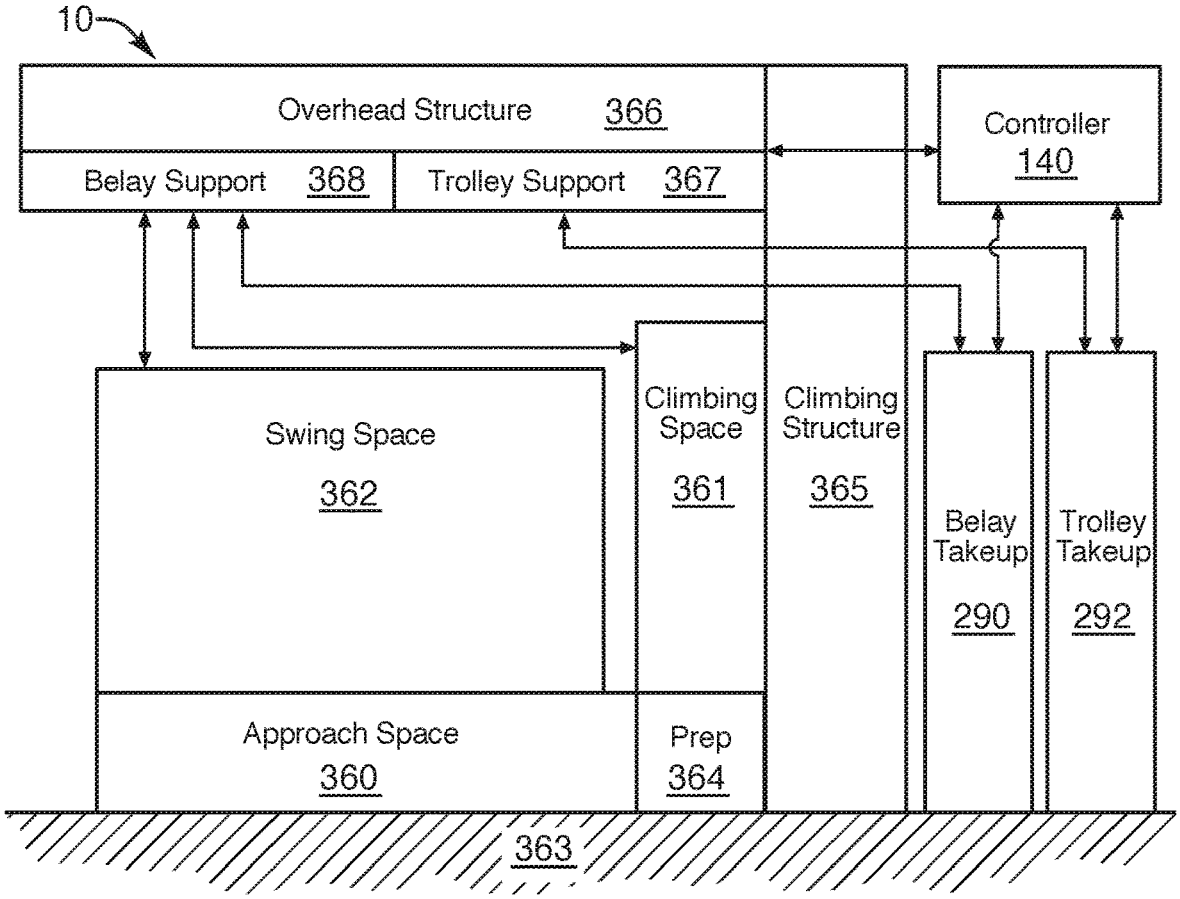
FIG. 57 is a schematic block diagram of a generalized system in accordance with the invention.

Referring to FIGS. 1 through 11, while referring generally to FIGS. 1 through 57, a system 10 may define directions 11*a*, 11*b*, 11*c* as, respectively a more-or-less vertical direction 11*a*, a more-or-less horizontal, forward-and-backward direction 11*b* (transverse direction 11*b*), and a lateral direction 11*c* (side-to-side), orthogonal to both the former. The system 10 may include a wall 12 styled as a climbing wall 12. Such a wall 12 will typically be used as a substitute for rock climbing on natural rock faces. Typically, an indoor climbing gym or bouldering center will include such walls 12 in various shapes and configurations. Each may be provided with a roughened frontal surface texture. This is typically formed of a paint and grit, such as a sand suspended in the paint and applied as a texturing of the wall 12.

The wall 12 may be mounted on a frame 14 styled as an arcuate truss 14 beginning at some lower level 15*a* (bottom end) and rising to some maximum height at a top end 15*b*. Overhead, a beam 16 may cantilever from an attached end 17*a* an upper end of the frame 14. It returns in the transverse direction back toward the bottom end of the frame 14. The beam 16 may support a positioner 18 (retractor 18) at an extreme end 17*b* thereof almost directly over the bottom end 15*b* of the frame 14.

The positioner 18 may work in any number of ways. It may include various optional mechanisms 18 in order to define a swing 20 device. It may be made up of a motorized, manual, or automated positioner 18. It may include or suspend from a carrier system 21 above a station 22 for preparation of a user 60 or climber 60 (see, e.g., FIGS. 47 through 50).

Typically, the climber 60 may prepare (harness, learn, etc.) at a preparation station 22, then step to a deck 24 or launch area 24. This introduction area 24 accesses the bottom end 15*a* of the wall 12 supported on the frame 14. In one currently contemplated embodiment, a user 60 may put on a harness system, typically providing full body support, rather than a simple waist-type harness. It is installed long before approaching the launch deck 24. Since dressing in a harness may require substantial time, several individual "riders" 60 or "climbers" 60 may be dressed properly and prepared in some preparation area 22 away from the launch deck 24.

In several currently contemplated embodiments, a line 27 connects to the harness 28 on a user 60. This harness 28 provides mechanisms for connecting to the line 27, which, in turn, connects to the positioner 18 at one extreme end of the overhead beam 16. The line 27 operates as a belay line 27 preventing a climber 60 from falling in a harmful way, in a harmful direction, or to a harmful distance.

However, this line 27 operates differently from both lead climbing lines, and top roped lines. Instead of suspending directly above a vertical climbing wall 12, the line 27 actually extends from the climber 60 out to the positioner 18 on the overhead beam 16. Thus, every fall becomes exciting, even thrilling, a pendulum fall, which would otherwise be dangerous, and anathema to conventional climbing.

For example, a pendulum fall in natural rock, and even on an artificial climbing wall, such as is presented in many gyms, is a disaster. The reason for this is that a pendulum fall is from a suspension point either above a climber 60 (in top-roping), or below a climber 60 (in lead climbing). In top roping, a fall is not substantial, and may not be permitted if a belayer below a climber 60 is maintaining tension on the rope. In lead climbing, a vertical fall of twice the distance to an anchor (protection) will result. However, on overhangs, on traverses, and the like, a fall may be a pendulum fall about some pivot point of the line suspended from an anchor, some lateral and transverse distance away from the climber 60. Thus, a pendulum fall results in a climber 60 swinging along the wall on which a grip has been lost, and swinging into some other object, typically another part of a rock or another part of the wall. From an overhang, the fall may be into space or back into the main wall, with devastating impact.

In an apparatus and method in accordance with the invention, a pendulum fall is the end result of the climb. As a climber 60 releases from the wall 12, the weight of the climber 60 results in the swing 20 (constituted by the line 27, harness 28, and possibly including the supports 16, 18). The climber 60 swings away from the wall 12, and out into space away from the wall. Ultimately, as a swing 20 operates, the climber 60 may then be returned to oscillating positions close to the wall 12 and away from the wall 12. Eventually natural damping slows movement, and permits a climber 60 (rider 60) to stand once again on the launch deck 24 or nearby on a supporting surface.

Referring to FIGS. 2 through 11, while continuing to refer generally to FIGS. 1 through 57, the wall 12 may be provided with holds 30 of various shapes designed and engineered to provide a resemblance to natural rock formations. Each of these holds 30 is supported by a bolt and "T-nut" through the material (e.g., fiberglass, wood, etc.) of the wall 12. The surface 32 may be treated with a paint material, and will typically include a grit, such as sand, or other material suspended in paint applied to the surface 32.

The frame 14, as well as the overhead beam 16 or beam 16, may be formed from a series of stringers 34 effectively spaced some engineered distance apart along the lengths thereof. These stringers 34 may be straight, such as in the beam 16, or curved, such as in the frame 14. Spacing between the stringers 34 is maintained by struts 36, which may angled at suitable directions as engineering strength and stiffness may dictate. Minimizing weight and maximizing strength and stiffness will typically provide a system of struts 36 that sparsely fill the space between the stringers 34.

Meanwhile, end plates 37 may be built into the frame 14 and beam 16 in order to anchor and space apart the stringers 34 with respect to each other. Likewise, end plates 37 may be secured together with fasteners 38. Thus, the frame 14 and beam 16 may actually be segmented in order to manufacture in shorter lengths, yet assemble into comparatively longer lengths.

In order to support loads (forces), and stabilize motion of the frame 14 and the wall 12, supports 40 or stabilizers 40 may extend from the frame 14 downward. These may be styled as extendable tubes 40, hydraulic cylinders 40, outriggers 40, or the like. Stabilizing tall cranes and man lifts is a requirement for safe operation thereof. Any of the art stabilizing such structures may be relied upon to support the frame 14, beam 16, or both. These stabilizers 40 may form a "three-point base" effectively by providing two supports 40 and a base 42 all secured to and extending above a supporting surface 44.

In the illustrated embodiment, the frame 14 is supported on some base 42 that may rest on a supporting surface. Typically, a supporting surface may be a concrete floor 44 supported by footings, a foundation, or the like. In order to support the frame 14 and beam 16 in their cantilevered arrangement illustrated, the supporting surface 44 is typically supported by engineered footings, and suitable fasteners 38 extending from such footings (not shown) connected to the base 42.

Figure 12:
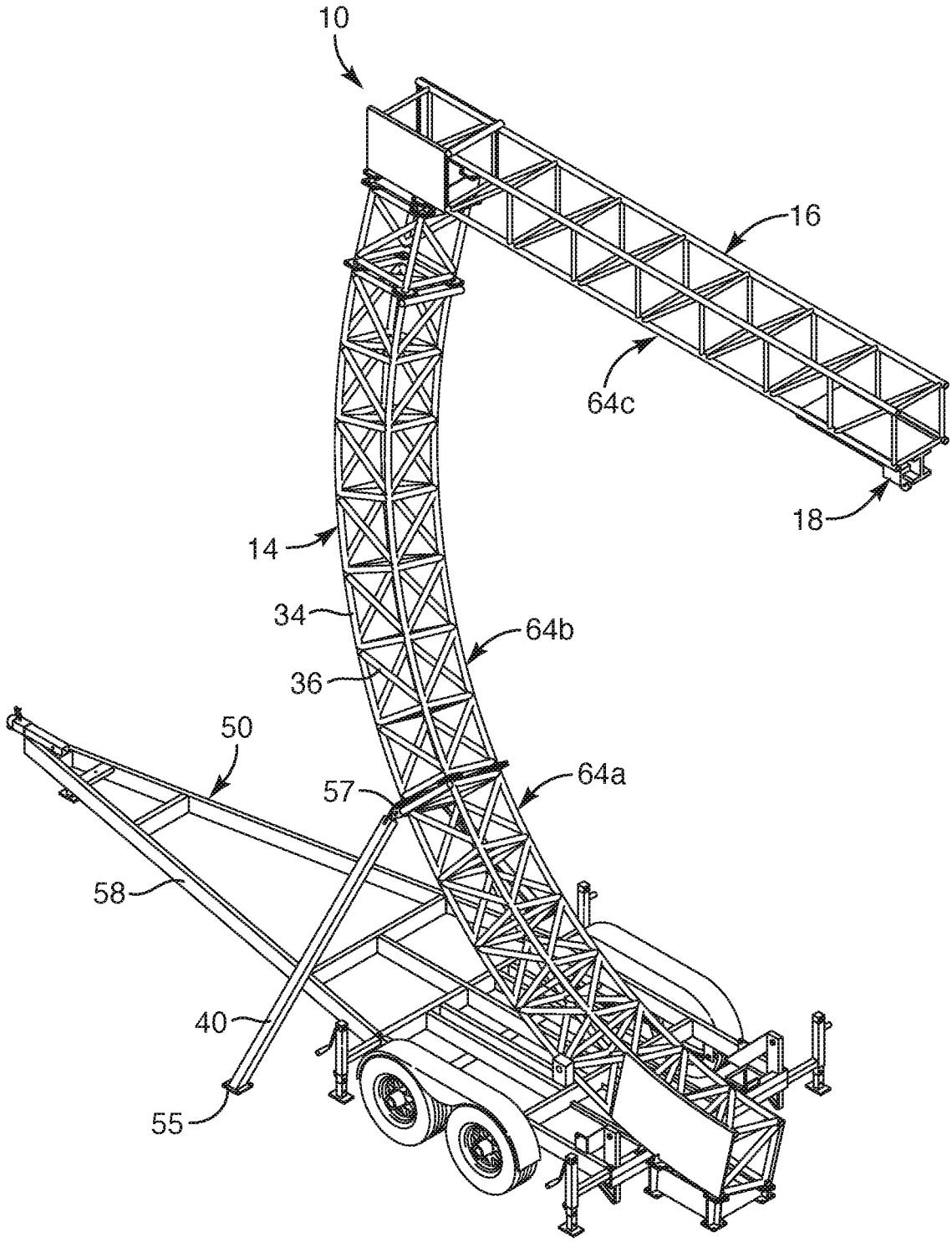
FIG. 12 is a perspective view of one embodiment of the frame of a mobile climbing wall and swing system in accordance with the invention, in a fully deployed configuration.
Figure 13:
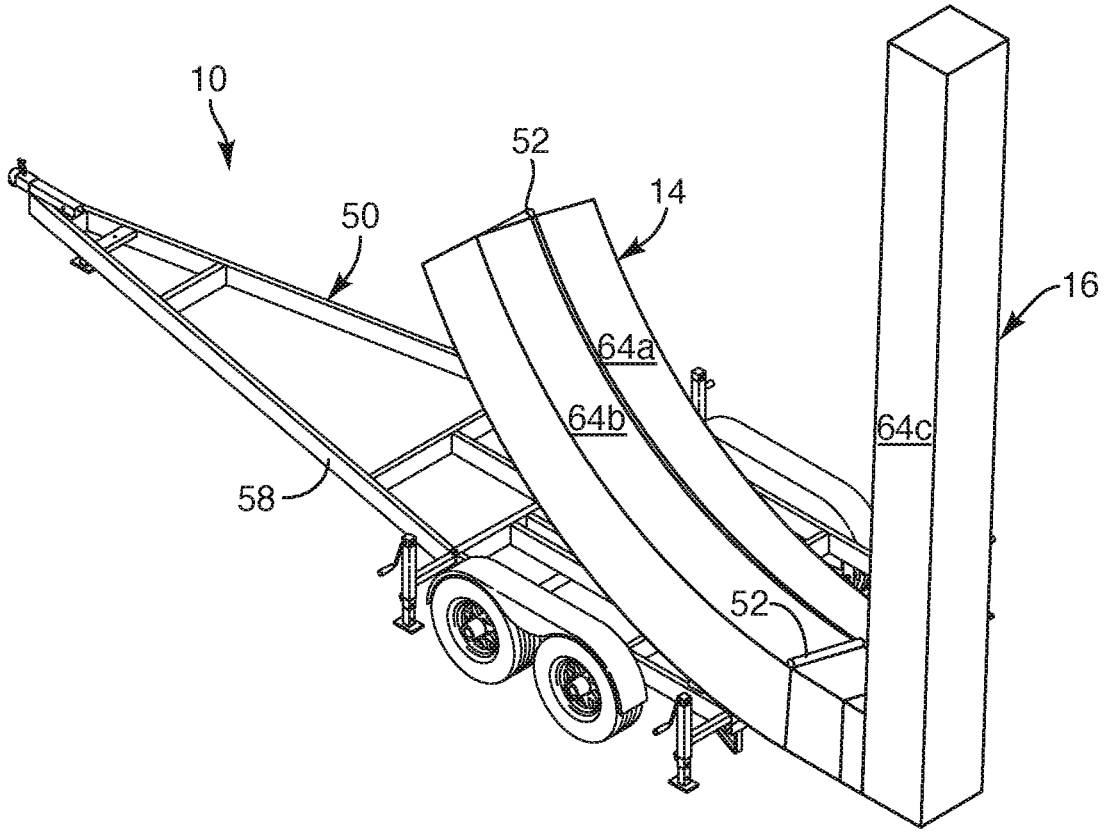
FIG. 13 is a perspective view of the system of FIG. 12 in a partially folded or stowed configuration, with details of the truss work replaced by their envelope (spatial volume) for clarity.
Figure 14:
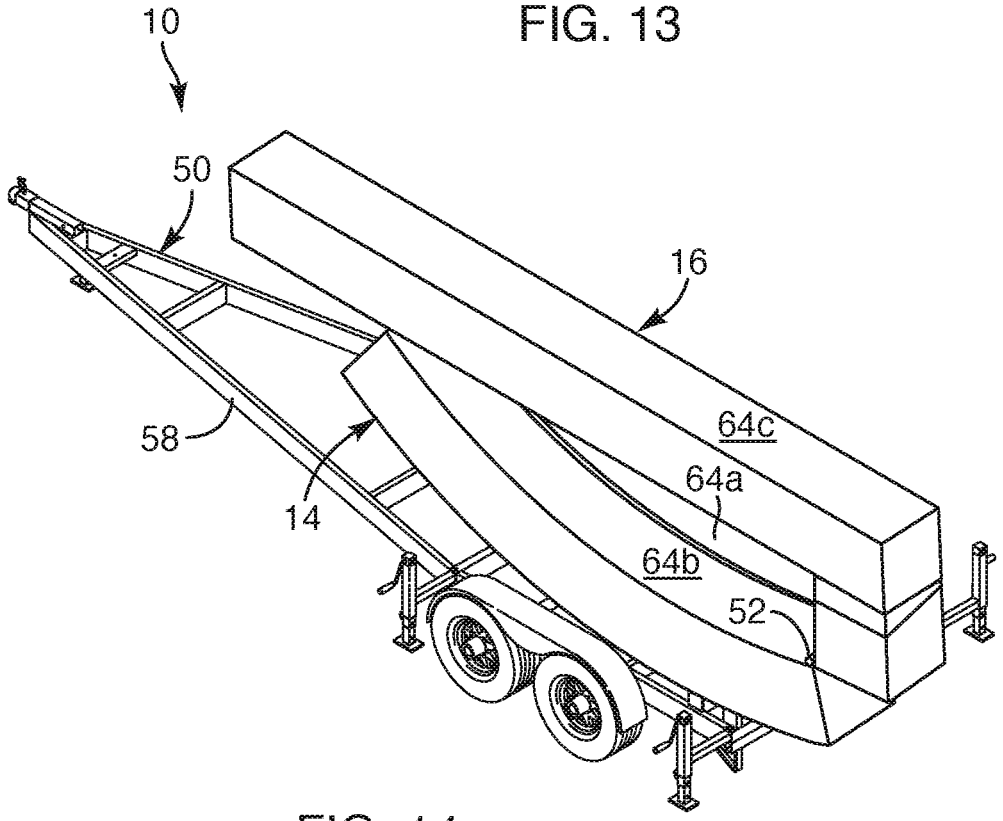
FIG. 14 is a perspective view thereof in a fully stowed configuration.

Referring to FIGS. 12 through 14, while continuing to refer generally to FIGS. 1 through 57, one embodiment of the system 10 in accordance with the invention may include a trailer 50 supporting a frame 14 and beam 16. A system of hinges 52 may connect or assemble the frame 14, or even the beam 16. Some type of fasteners 38 will necessarily connect the beam 16 to the frame 14. However, if the beam 16 is not cantilevered from the frame 14, then other support mechanisms for the positioner 18 supporting the swing 20 may be relied upon as discussed hereinbelow.

In the illustrated embodiment, the supports 40 or stabilizers 40 include a ram 54 extending between a foot 55 on the supporting surface 44, and a hydraulic cylinder 56. The positions of the cylinder 56 and the ram 54 may be reversed. Meanwhile, a clevis 57 or other pivoting connector 57 may secure the ram 54 to the foot 55, and the cylinder 56 to the frame 14. In certain embodiments, these connections may be reversed with no degradation of service.

The trailer 50 may include a frame 58 and be secured to the base 42 of the frame 14 by fasteners 60. One convenient means to place the bottom end 15*a* on the ground is to connect the frame 14 to the trailer frame 58 by a pivot at the back end of the trailer 50.

The hydraulic cylinder 56 with its associated ram 54 is a well understood mechanism and may operate as an actuator 62 to stabilize and level the frame 14, the trailer 50, or both. Likewise, the hydraulic cylinder 56 and its associated ram 54 may operate as a stabilizer 40 reducing a tendency by the frame 14 to oscillate or move in response to weight, wind, or other loading (forces).

In one presently contemplated embodiment, the frame 14 and beam 16 may be divided into segments 64*a*, 64*b*, and segment 64*c*, respectively. In the illustrated embodiment, all the segments 64*a*, 64*b*, 64*c* are extended to their maximum dimensions by pivoting about their hinges 52, and receiving fasteners 38 securing and plates 37 between the segments 64*a*, 64*b*, 64*c*.

Referring to FIG. 12, the system 10 is illustrated in a deployed configuration. The stabilizers 40 are extended or deployed. The frame 14 and beam 16 are fully assembled as deployed.

Referring to FIG. 13, the second segment 64*a* may be folded about a hinge 52 between itself and the first segment 64*b* in order to shorten the length of the frame 14 for transport. Meanwhile, the third segment 64*c* may be folded to place the beam 16 at a lower level, greatly reducing the overall profile of the system 10 on the trailer 50.

Referring to FIG. 14, the system 10 is completely folded up in a stowed position, ready for travel. The trailer 50 may be connected to a towing vehicle, and the system 10 may be relocated for operation elsewhere.

Figure 15:
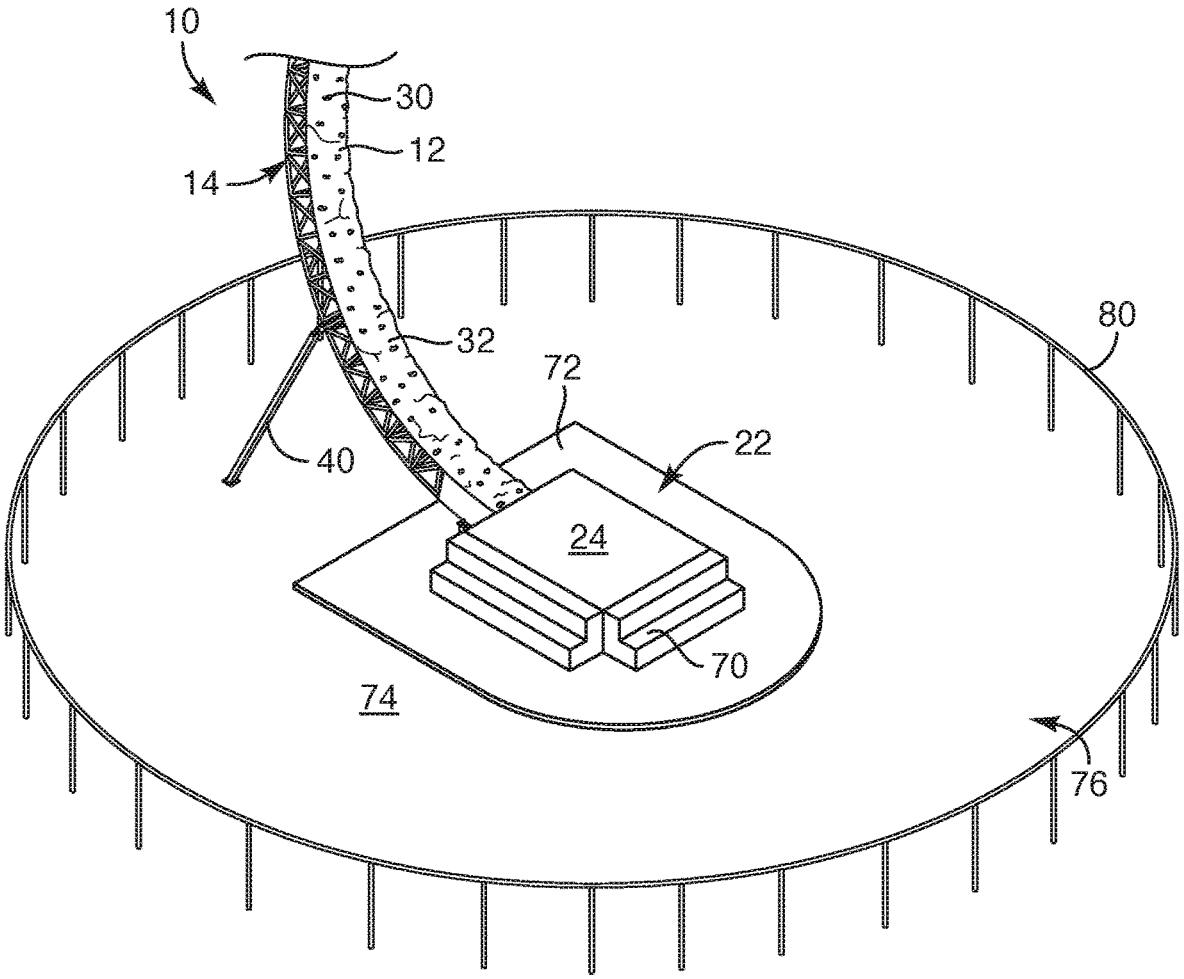
FIG. 15 is a perspective view of one embodiment of a preparation and launching area for a system in accordance with the invention, using a step and elevated deck above the floor as an entry to the climbing wall.
Figure 16:
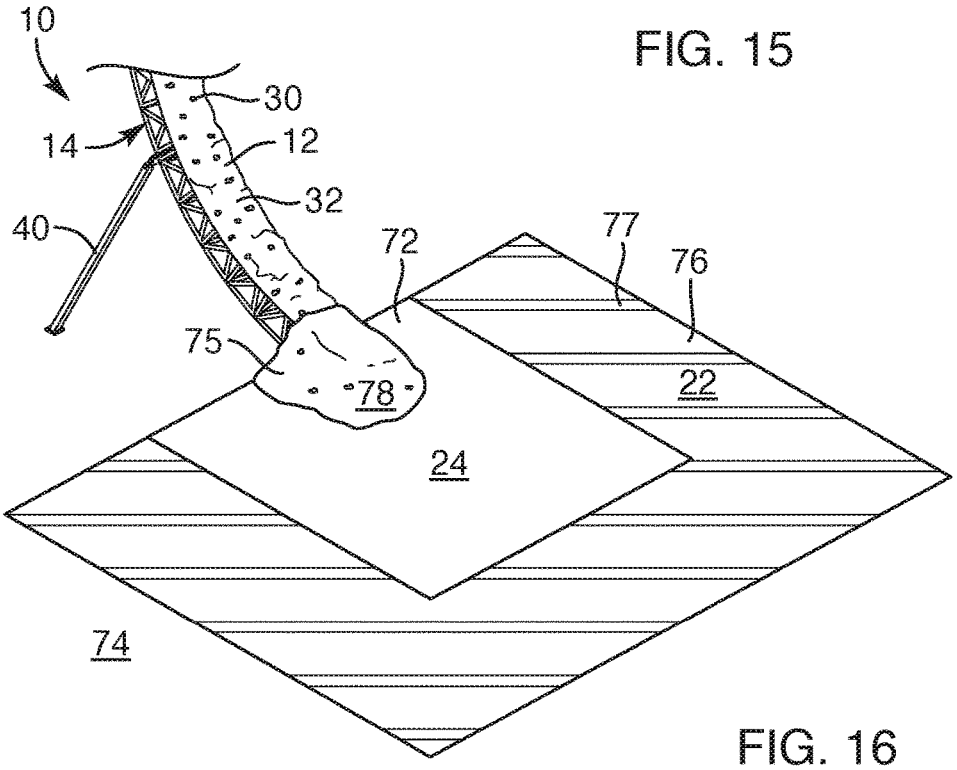
FIG. 16 is a perspective view of an alternative embodiment thereof, using a simulated rock starting shape, and a preparation area and safety zone marked on a flush floor.

Referring to FIGS. 15 and 16, while continuing to refer generally to FIGS. 1 through 57, a preparation station 22 or preparation area 22 may be spaced a safe distance away from a launch area 24 or launch deck 24. In the embodiment of FIG. 15, the launch deck 24 is above the preparation station 22 or preparation area 22. However, in the embodiment of FIG. 16, the launch area 24 is at the same level as the preparation area 22. In the former embodiment, steps 70 lead from the preparation area 22 to the launch deck 24. Accordingly, the launch deck 24 may be connected at about the height of the top surface of the bottom end 15*a* of the frame 14.

Padding 72 may be provided as a foam pad 72, or as a rubberized or otherwise elastomerically treated material on a floor 74. In this embodiment, a transition 75 may extend from the launch deck 24 to the wall 12 with its climbing holds 30.

A user 60 may prepare by harnessing up in a region 22 designated for preparation. Harnessing may occur farther away during the time that another climber 60 or rider 60 is occupying the system 10. Ultimately, a rider 60 or user 60 should arrive at a preparation station 22 for inspection, a safety check, and in order to hook (link) the harness 28 to the line 27. When all has been deemed suitable and safe, the user 60 may mount the stairs 70 or otherwise approach the launch deck 24. When all slack has been removed from the line 27, a climber 60 may begin climbing the wall 20. Different mechanisms may be relied upon to take up slack in the line 27 connected to the harness 28 of a user 60. These will be discussed hereinbelow.

Referring to FIG. 16, in certain embodiments, the floor 74 may contain both the preparation station 22 and launch deck 24 at a single level. A space 76 or buffer 76 may exist therebetween, and may be marked with stripes 77 or other warning pattern 77 or mechanisms 77 for warning. In this embodiment, the wall 12 may begin at a height somewhat above the floor 74, owing to the structural size of the bottom end of the frame 14. An interface 78 styled as a wall 78 or boulder 78 that covers the end of the bottom 15*a* of the frame 14 may begin the climbing activity right at the level of the floor 74, in the launch area 24.

Thus, the embodiment of FIG. 15 has the advantage that it elevates a user 60 immediately to the level of the wall 12, or the edge of the wall 12 as it begins at the bottom 15*a* of the frame 14. A benefit of the configuration of FIG. 16 is that no obstructions (e.g., elevated deck 24) need be present to interfere with walking, or swinging over the floor 74. In fact, in some embodiments, the embodiment of FIG. 15 may be kept for the wall 12, and frame 14, both being mounted to begin flush with the floor 74. Thus, the interface 78 would be unrequired, as would the transition 75.

As a practical matter, some transition 75 may be required to cover a portion of the frame 14. It may simply be the transition 75 at the lower end of the wall 12 from the launch deck 24 to step directly to the wall 12. In such an embodiment, even the frame 14 would provide no interference to freely swinging by a user 60. Neither would a transition 75, an elevated interface 78 being completely unnecessary.

A fence 80 and gate 73 will probably be required for safety. The extent of the fence 80 will typically be determined by the effective height and distance required to protect passersby or observers. The frame 14 and beam 16 may be positioned sufficiently high that a rider 60 may swing out beyond the fence 80, and above the fence 80, but at a distance that would not endanger the rider 60 nor a passerby outside the fence 80. In fact, a preparation area 22 may actually be outside the fence 80. However, a better situation results if preparation occurs inside the fence 80, but away from the region through which a rider 60 may swing from the line 27.

Referring to FIGS. 17A, 17B, 18A, 18B, 19A, and 19A, alternative embodiments for supporting the line the beam 16 may be configured to stand alone or as supports for the beam 16.

Figure 17A:
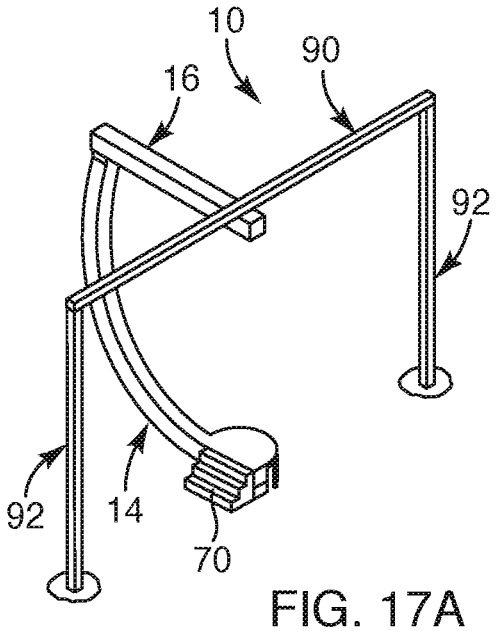
FIG. 17A is a perspective view of one embodiment of a support system on a climbing wall and swing in accordance with the invention, having a support rather than a fully cantilevered top truss (beam)
Figure 17B:
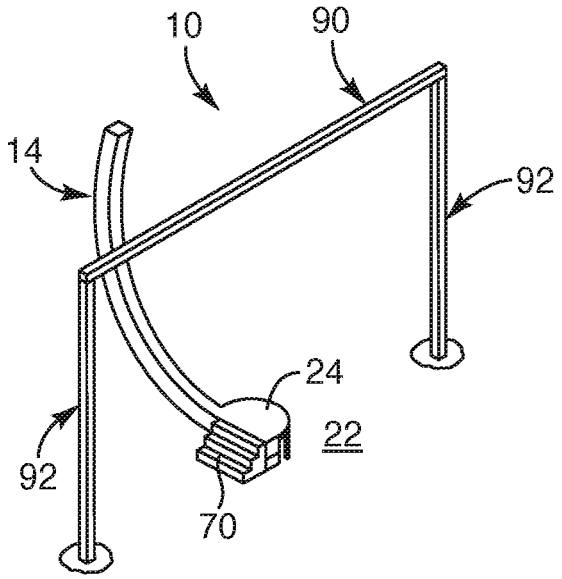
FIG. 17B is a perspective view of an alternative embodiment thereof, in which the horizontal beam extending from the frame of the climbing wall is unnecessary, as the line and swing will suspend from the independent support spaced away from the wall and its frame.

Referring to FIGS. 17A and 17B, for example, a crossbeam 90 may be supported on pillars 92. The pillars 92 will typically need to be spaced apart a sufficient distance to provide clearance for a climber 60 who swings free from the wall 12, from a center of suspension 100 or center 100.

The beam 16 may or may not be installed. The cross beam 90 may carry the rider 60. The beam 16 may help stabilize the top of the frame 14 by connecting to the cross beam 90, but need not be present to do so in all embodiments. Other structures may support and stabilize the frame 14 adequately from the ground itself, as in FIGS. 20-23.

For example, as illustrated in FIGS. 1, 20-23, and FIGS. 28 and 29, the line 27 will extend to some radius 102, which may be measured to the harness 28 of the rider 60, or all the way to the wall 12. In either event, a radius 102 from the center 100 of suspension to the wall 12 must provide clearance for appendages of a rider 60. Inasmuch as friction is greatly reduced with the mechanisms incorporated in the system 10, the prospect of a rider 60 being affirmatively prevented from returning completely to an original position of falling from the wall 12 should be accommodated. This may be done in any of several manners to be discussed hereinbelow.

The positioner 18 may be movable from a first, closer, position during climbing of the wall 12, to a latter and more distant position from the frame 14 and wall 12 following a pendulum fall by the climber 60. It may move a few feet (meter) away along the beam 16 with the momentum of a fall and lock there. Thus, a climber 60 cannot swing as far as the wall on returning.

Figure 18A:
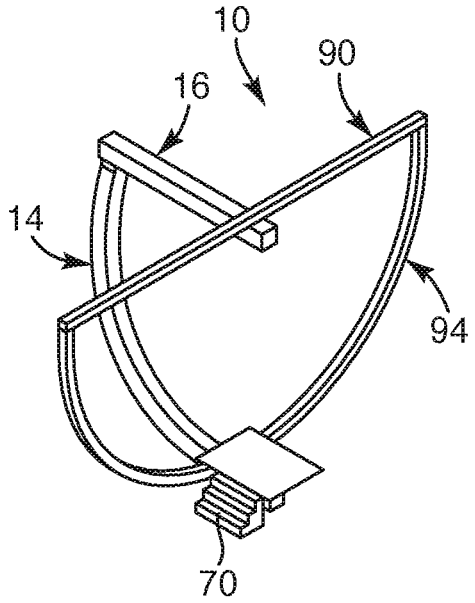
FIG. 18A is an alternative embodiment of a frame for a climbing wall, relying on a yoke to provide end support for horizontal trusses, and clearance for swinging space.
Figure 18B:
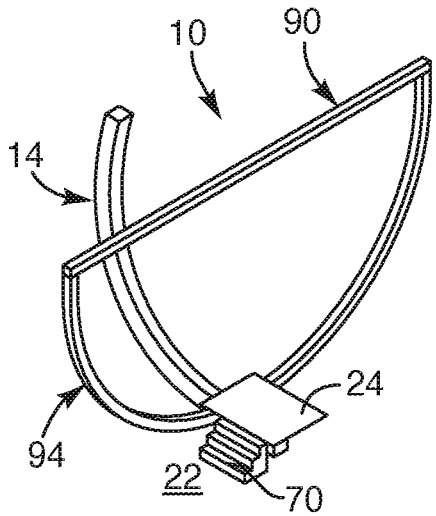
FIG. 18B is a perspective view of an alternative embodiment thereof, in which the horizontal beam extending from the frame of the climbing wall is unnecessary, as the line and swing will suspend from the independent support spaced away from the wall and its frame.

Referring to FIGS. 18A and 18B, in an alternative embodiment, the crossbeam 90 may be supported by a yoke 94. Again, the beam 16 may or may not be included. It may help stabilize the top of the frame 14 by connecting to the yoke 94, but need not be present to do so in all embodiments. Other structures may support and stabilize the frame 14 adequately from the ground or other surface below the frame 14.

One advantage to a yoke 94 is that stability may be improved by extending from the launch deck 24 up to the crossbeam 90 in a single structure, rather than having a sharp corner angle, that tends to be less stable, as illustrated between the crossbeam 90 and the pillars 92 of FIG. 17. Moreover, the shape of the yoke 94 is effectively that of the swing arc of a climber 60 (rider 60). Thus, clearance may be equal in all directions. Clearance between the center of pivot 100 and the yoke 94 may be greater than the clearance to the wall 12 and its underlying frame 14. This would provide for movement of the center 100.

Nevertheless, certain mechanisms for guiding the line 27 from the pivot point 100 may reduce or even eliminate swinging in the lateral (side-to-side) direction 11*c*. Restricting movement to be within a plane defined by the vertical direction 11*a* and the horizontal (transverse; in-and-out) direction 11*b* may effectively eliminate a need for a full radius 102 value of clearance for the pillars 92, in either configuration, of FIGS. 17A and 17B or FIGS. 18A and 18B.

Figure 19A:
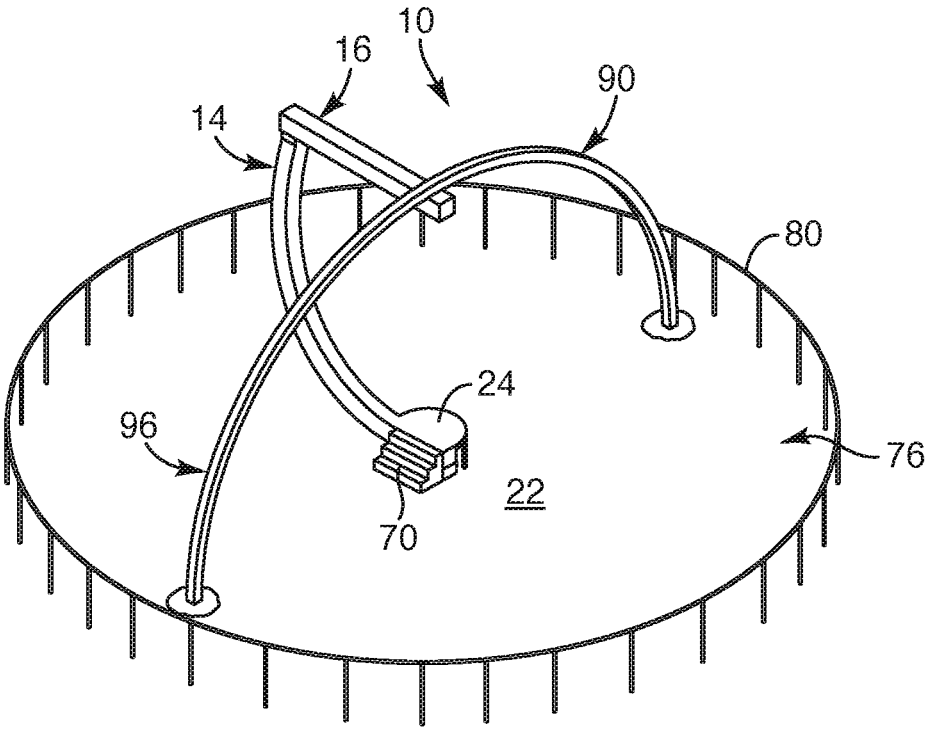
FIG. 19A is a perspective view of an alternative embodiment of a frame, relying on an arch to support an end of a horizontal truss system.
Figure 19B:
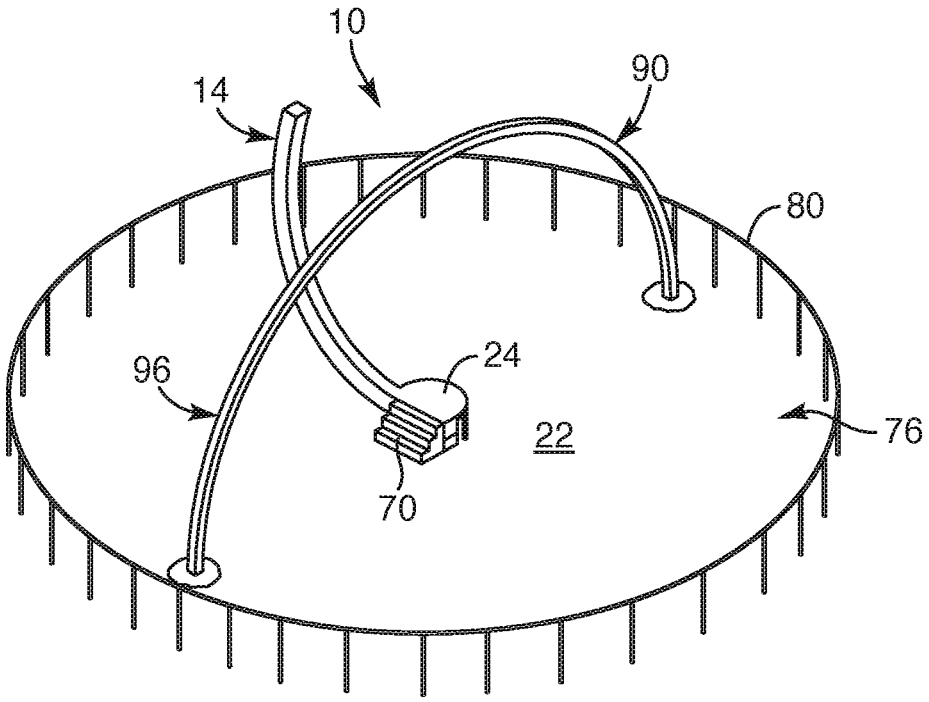
FIG. 19B is a perspective view of an alternative embodiment thereof, in which the horizontal beam extending from the frame of the climbing wall is unnecessary, as the line and swing will suspend from the independent support spaced away from the wall and its frame.

Referring to FIGS. 19A and 19B, this clearance question comes into focus with an arch 96 of FIG. 19. In this embodiment, the arch 96 may need to rely on guidance of the line 27 from the pivot point 100 on the positioner 18. Otherwise, with a certain amount of lateral 11*c* movement of a climber 60 with respect to the pivot point 100, a user 60 could swing in a lateral direction 11*c*, and strike an arch 96. Otherwise the radius 102 may require a much wider arch 96 than would be required of the yoke 94.

The beam 16 may or may not be present. It may help stabilize the top of the frame 14 by connecting to the arch 96, but need not be present to do so in all embodiments. Other structures may support and stabilize the frame 14 adequately. On the other hand, an arch 96 is fundamentally quite stable, having a continuous radius and no corner, as well as a much greater bearing length (distance between the two, anchored, bottom ends) at the base of the arch 96. In contrast, the yoke 94 necessarily has a much shorter baseline or bearing length along its entire length between anchoring points to the ground 44 or other supporting surface 44.

Figure 20:
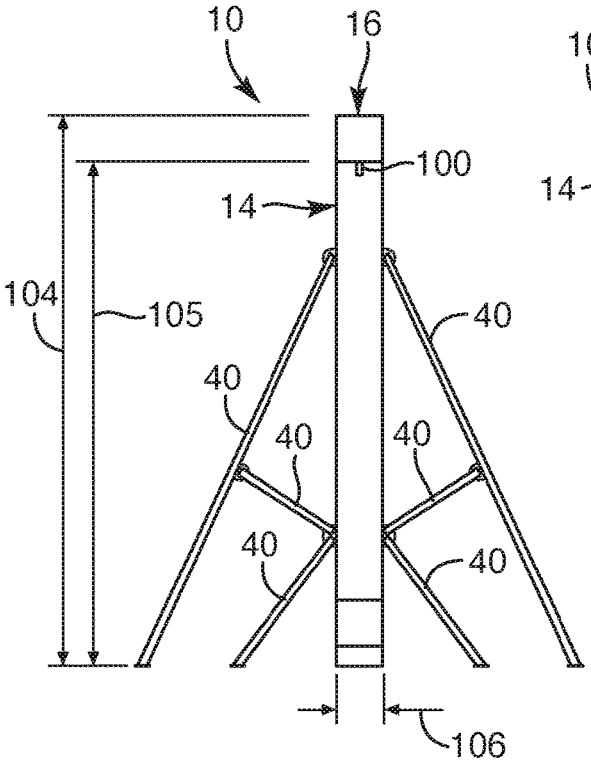
FIG. 20 is a front elevation view of an alternative embodiment of the framing system of FIG. 3, this having no offset sideways (laterally) between the base and the top of the frame.

Referring to FIGS. 20 through 23, alternative embodiments may include various other geometries for the frame 14, and consequently the wall 12. For example, FIG. 20 represents a front elevation view of the frame 14, supporting its cantilevered beam 16 and positioner 18. Here, the center 100 of pivot may be in line with a center line passing vertically through the frame 14. The positioner 18 may actually position directly above a launch deck 24 or a launching location 24. Meanwhile, depending on the shape of the frame 14 supporting a wall 12, the radius 102 of the line 27 in a pendulum fall may change, and therefore, require taking up during climbing to maintain its shortest distance between the climber 60 and the center of pivot 100.

One will also note that additional supports 40 may be installed according to good engineering practice. Sufficient bearing lengths are required, distances between pairs of ground supports on opposing sides (straddling a centerline) of the frame 14, if supports 40 are dug into or resting on the ground. Permanent anchoring may alter those requirements to support lateral or transverse loading from any source.

Figure 21:
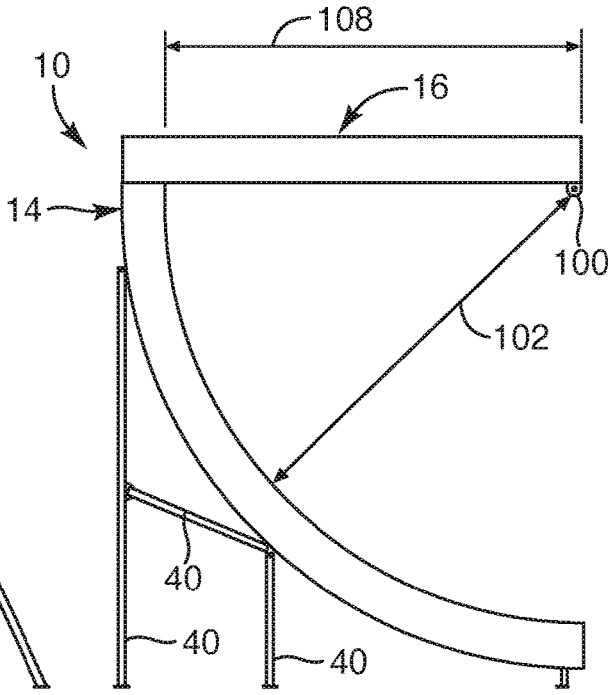
FIG. 21 is a side elevation view thereof, having a circular path from a center of pivot out toward the base of, and the entirety of, the frame structure.

Referring to FIG. 21, in one embodiment, the side elevation view of a frame 14 may be circular. However, this tends to waste much of the lower half of the frame 14 in a shallow portion (nearly horizontal) of the wall 12. Reaching a vertical climb quickly upon leaving the launch deck 24 is usually preferred. Thus, this configuration is useful, has certain regular geometry about it for structural integrity, and so forth. Nevertheless, the overhang distance 108 needs to be approximately the vertical height 104 so the radius 102 is about the same from the wall 12 on the frame 14 whether a user 60 is standing on the launch deck 24, or is at the top, extreme end 15*b* of the wall 12 on the frame 14. If the radii 102 are not the same at both locations, with respect to the center of pivot 100, then the overhang distance 108 needs to be shorter than the height 104. The objective is precluding any striking of a solid object, such as the wall 12, the floor 74, launch deck 24, or the like.

Nevertheless, certain mechanisms for a positioner 18 may permit a change in the radius 102 by retracting the line 27 or a repositioning of the positioner 18. These may increase the radius 102 of the pivot center 100 away from the wall 12 and the frame 14 almost as soon as a climber 60 disengages from the wall 12.

Figure 22:
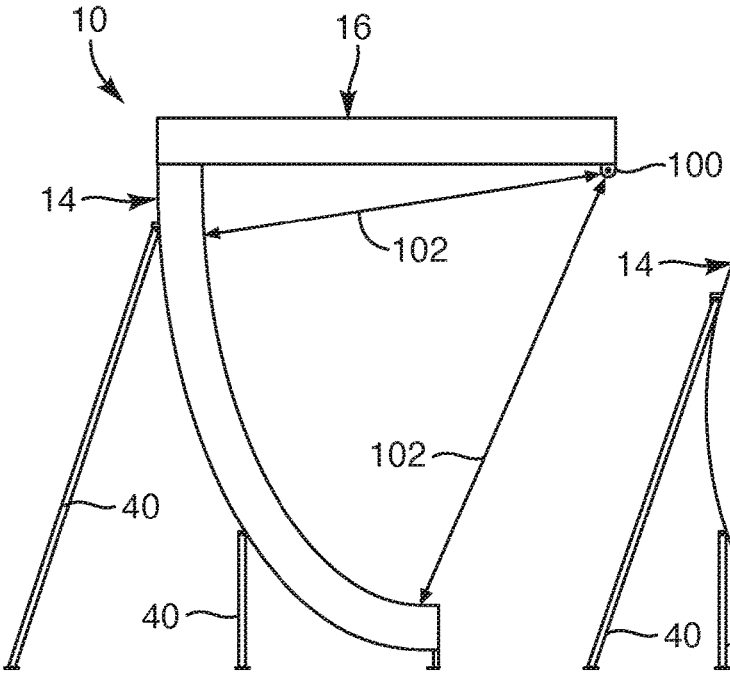
FIG. 22 is a side elevation view of an alternative embodiment of a framing system for a climbing wall swing, having a parabolic shape increasing elevation more quickly as a function of transverse distance than would a circular arc of FIG. 21.

Referring to FIG. 22, one such instance may be that of a parabolic frame 14, supporting a wall 12. In this embodiment, the distance from the pivot center 100 to the floor 74 or launch deck 24, as the case may be, may typically be much greater than the radius 102 from the frame 14 and wall 12 to the center of pivot 100 when the climber 60 is near the beam 16. In such an event, a system 10 should take up slack. Otherwise, the belay function of the line 27 is not met. Tension is an option, but should typically be minimal (nominal 3-10 pounds, usually 5 or less), thus effectively eliminating slack in the line 27. However, if the "focal point" of the parabolic shape of the frame 14 is below the center of pivot 100 (which is usually the case), then some mechanism for taking up slack or changing the center of pivot 100, must be employed. This will assure a clear, free, pendulum fall of a climber 60, when that climber 60 transitions to a rider 60 of the swing 20.

Figure 23:
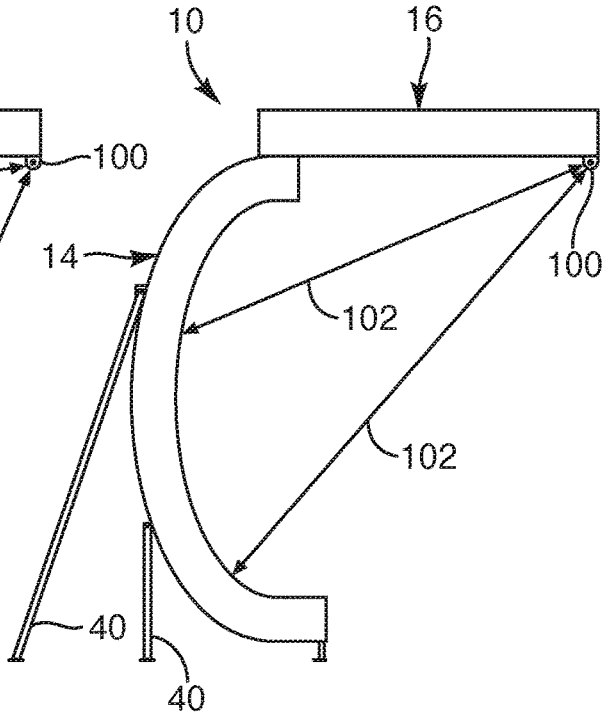
FIG. 23 is a side elevation view of an alternative embodiment of a frame structure in accordance with the invention, this having an elliptical shape, producing an increased rate of vertical rise in less of a horizontal distance, while also providing an overhanging return of the structure near the top end thereof.

Referring to FIG. 23, the frame 14 may be structured as an elliptical shape, providing rapid transition from a floor 74 or launch deck 24 into a vertical 11*a* portion of the frame 14 and its supported wall 12. This embodiment even provides for an overhang or "inverted" climbing experience for highly experienced climbers 60. However, this also points up a need for some mechanism to continually and permanently take up slack somewhat like an auto belay, without the negative influences of conventional auto belay systems.

For example, conventional auto belay systems are designed for a person climbing an effectively vertical wall. Such systems are completely inadequate for pendulum falls, and do not protect them. Moreover, conventional auto belays automatically take up slack, providing a slight amount of tension on the line 27, but immediately begin descending when loaded (a fall). They provide a damped descent of a climber as soon as the weight of the climber 60 is significantly supported by the line 27. This immediate descent would be totally inappropriate, inadequate, and dangerous for a swinging condition on a system 10 in accordance with the invention.

In more complex shapes, such as those of FIGS. 22 and 23, as opposed to the circular architecture of FIG. 21, some take-up mechanism 18 (retractor 18, positioner 18) for the line 27 or movement of the entire positioner 18 needs to provide for safety, such as clearances during a swinging event. A suitable length of extended line 27 must be accommodated with any pendulum fall from the wall 12 by a user 60.

Figure 24A:
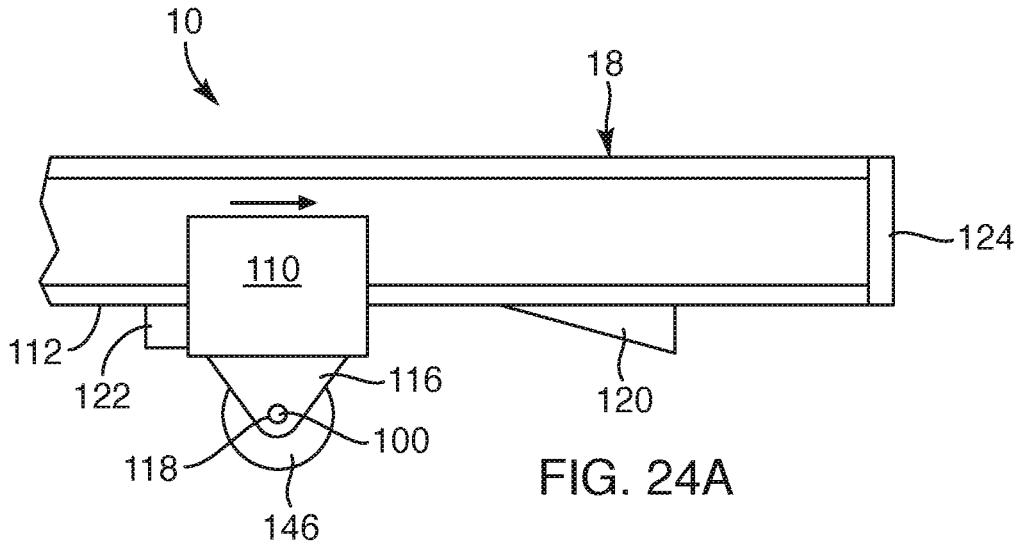
FIGS. 24A, 24B, and 24C are side elevation views of a distal end of a top beam of a frame in accordance with the invention, illustrating a process of movement of one embodiment of a supporting system and take-up system for supporting a tether or climbing belay line, wherein the center of pivot (of a pivot anchor or belay anchor) is permitted or required to move following a climber leaving the wall structure, then catch and remain there, thereby providing more clearance away from the wall during any return swinging of a climber toward the wall.
Figure 24B:
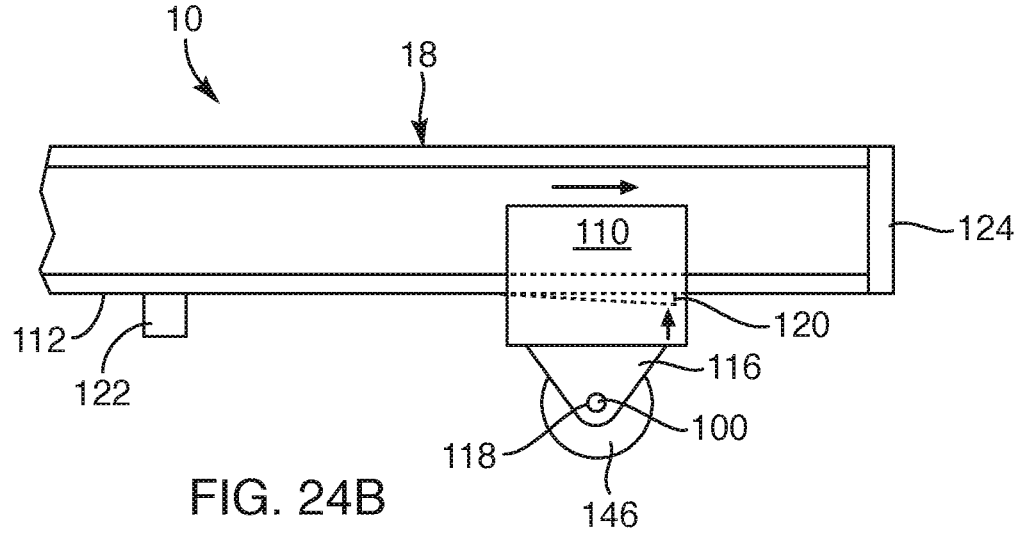
Figure 24C:
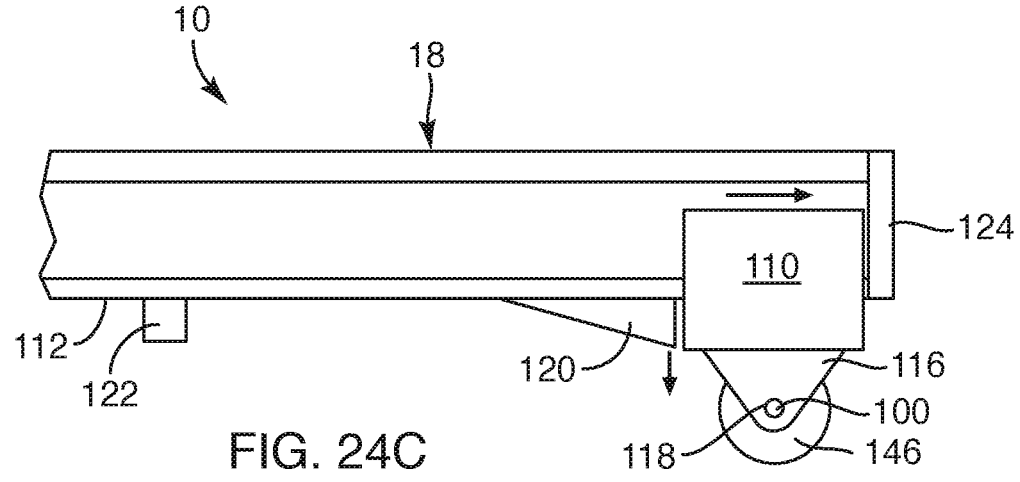

Referring to FIGS. 24A, 24B, and 24C as wells as FIGS. 25A through 27, while continuing to refer generally to FIGS. 1 through 57, different mechanism may be employed to provide a change of the location of the positioner 18 with respect to the wall 12. In some devices, one need only alter the radius 102 in order to protect a rider 60. In other embodiments, the actual location of the positioner 18, or the center 100 of suspension (center of pivot 100) that it supports may be required. In certain embodiments, both may be combined.

Referring to FIGS. 24A, 24B, and 24C, a trolley 110 may operate as a positioner 18. The beam 16 may be or include a rail 112. It may be provided with a specialized or customized rail 112, track 112, or ways 112 to support a trolley 110. Wheels of the trolley 110 may keep the trolley 110 moving with comparatively little (negligible) friction as the wheels roll along the rail 112 carrying the trolley 110. The trolley 110 may support a hanger 116 provided with a fastening means such as a link or an aperture 118.

The aperture 118 may support an axle 144 (see FIG. 25) through a pulley 146. That pulley 146 may operate as an anchor 146 (the entire positioner 18 may also be considered an "anchor" 18 or "belay anchor" 18) for a line 27. In some embodiments, the pulley 146 may operate to carry a moving line 27 over the pulley 146 as the pulley 146 itself rotates about a center 100 of pivot.

In the illustrated embodiment, the aperture 118 may be in a clevis 116 to receive an axle 144 (see FIG. 25) supporting a pulley 146. Nevertheless, the aperture 118 may simply receive directly a link 200, such as a carabiner 200 for supporting a line 27 fixed thereto. Thus, in certain embodiments, the movement of the trolley 110 may completely eliminate a need for the line 27 to be shortened or the radius 102 of the line 27 to be shortened between the center 100 of pivot and the wall 12.

For example, in the illustrated embodiment, in the configuration of FIG. 24A, a stop 122 fixed with respect to the rail 112 may prevent the trolley 110 from approaching any closer toward the wall 12 along the beam 16. In response to a controller moving the trolley 110, or a rider 60 swinging away from the wall 16, and past the stop 122, a trolley 110 may travel away from the wall 12. The trolley 110 moves along the rail 112 from the position of FIG. 24A, through a specified distance away from the frame 14 and wall 12 to pass over the latch 120 as in FIG. 24B. The system 10 may include this latch 120 operating as a ratchet 120 extending from the rail 112. The trolley 110 in passing over the latch 120 may depress it against gravity or a spring loaded mechanism to pass by it.

Nevertheless, once a climber 60 or rider 60 swings free from the wall 12 on the line 27, the trolley 110 is free to move away from the stop 122, under the influence of momentum of the climber 60 swinging transversely 11*b* away from the wall 12. Once the rider 60 has passed under the center 100 of pivot, the mass of the rider 60 and momentum thereof will urge the trolley 110 to move outward 11*b*. It rolls away from the wall 12, along the rail 112, and toward the rear stop 124 as in FIG. 24C. The rear stop 124 may block the trolley 110 from traveling further along the rail 112. Meanwhile, the latch 120 is now freed from the depression under the influence of the trolley 110. It has extended back out to its original equilibrium position, extending away from the rail 112. There, it prevents the trolley 110 from backtracking toward the wall 12.

In this way, the radius 102 of a line 27 need not change. In fact, the radius 102 may be constant, and fixed between the center of suspension 100 or center of pivot 100, and the harness 28 of a climber 60. So long as a mechanism exists, as described hereinbelow, for taking up slack, a rider 60 may swing safely. Particularly if no difference exists between height of a launch deck 24, the preparation area 22, and the floor 74.

Figure 25A:
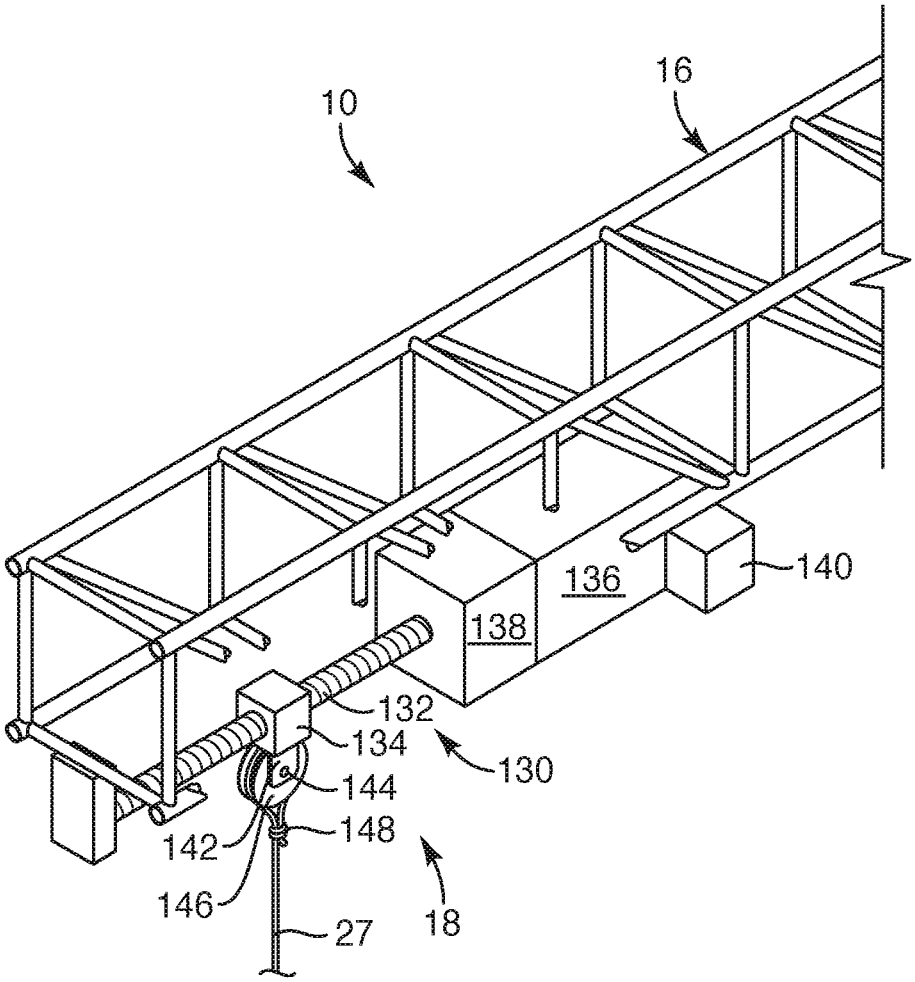
FIG. 25A is a perspective view of one alternative embodiment of a take-up or retractor system to move the center of pivot before, after, or both with respect to fall of a user on a belay line connected to a climber who will swing away from the wall near the top thereof.
Figure 25B:
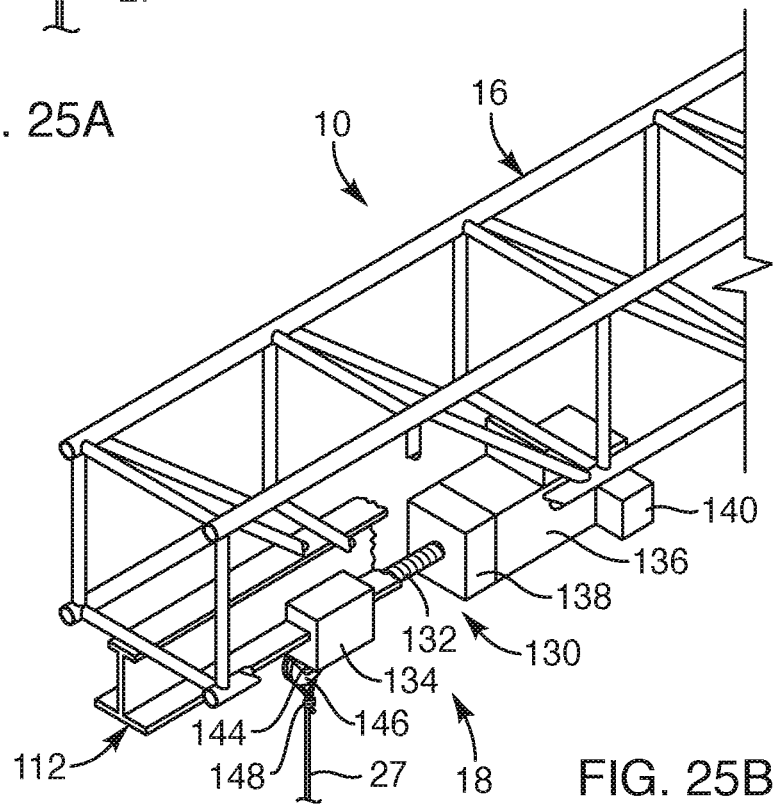
FIG. 25B is a perspective view of an alternative embodiment thereof, wherein a ball screw drives a slide supporting the center of pivot and rolling, sliding, or otherwise moving along a supporting rail.
Figure 25C:
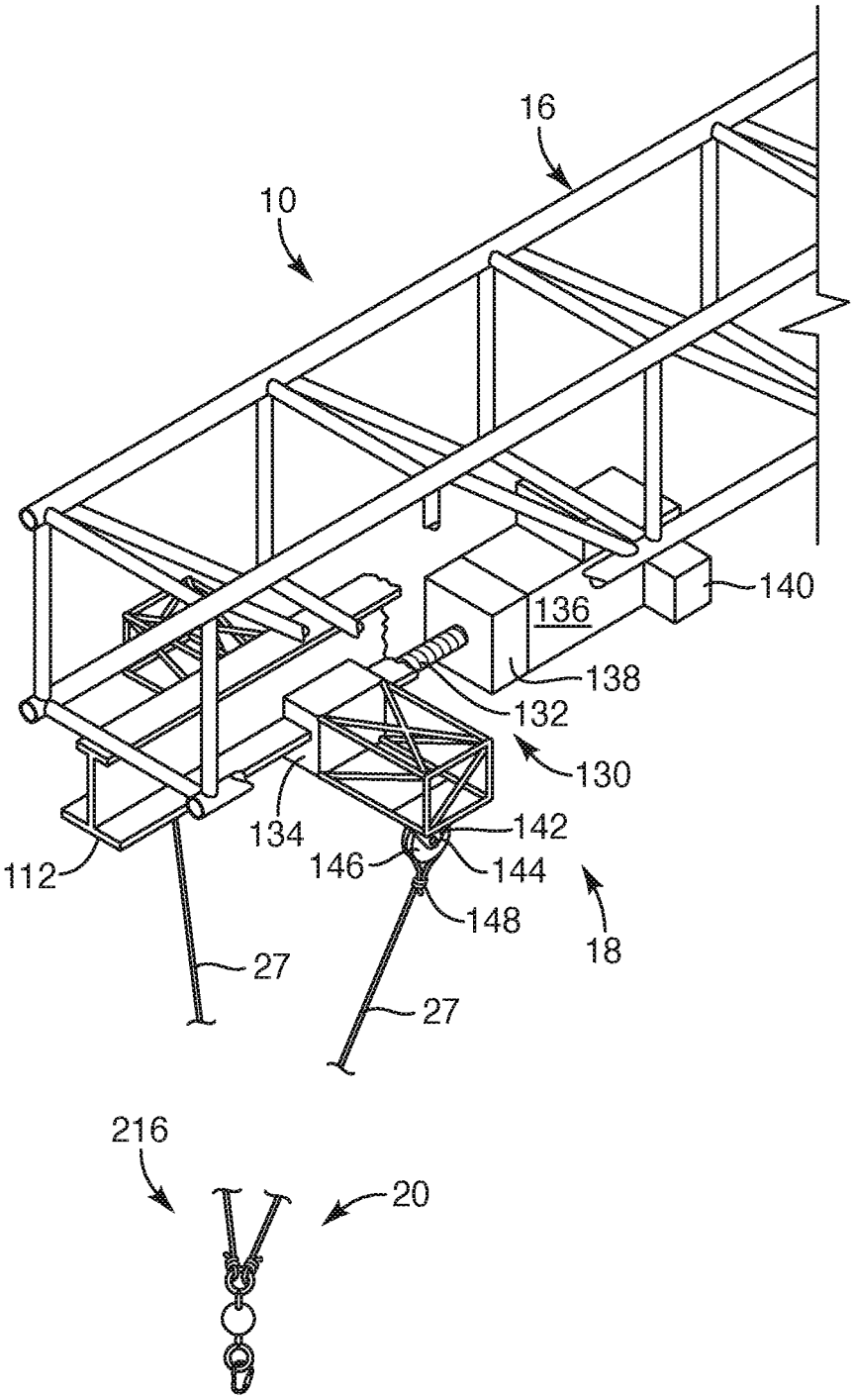
FIG. 25C is a perspective view of an alternative embodiment thereof, wherein the carrier is widened side-to-side, and two centers of pivot are used to support two lines supporting a user or rider, and a swivel, which may also be used on all of the other embodiments of lines supporting a user.

Referring to FIGS. 25A, 25B, and 25C, a mechanism for moving the center 100 of pivot, may be created by using a ball screw system 130 as a positioner 18. A sufficiently strong and stably supported screw 132 may suffice as in FIG. 25A. Otherwise, as illustrated in FIG. 25B, a ball screw system 130 may include a nut moving 134 on a rail 112 being driven by the ball nut 134 traveling along the ball screw 132.

For these embodiments, ball screw systems 130 are ubiquitous and well understood by designers of mechanisms. Ball screw systems 130 exist in the prior art, and effectively include a screw 132 that has a special threading. That special threading engages a nut 134, having ball bearings to act as its own threads. Those ball bearings operate in a race inside the nut 134, as understood in the art, in order that the nut travel along (with respect to) the screw 132 with minimal friction. Thus, the nut 134 presents negligible friction as it travels along the screw 132, compared to worm gears, conventional threads, and other threaded systems.

The motor 136 may be geared in a transmission 138 in order to specifically control the rotational speed of the screw 132 in moving a nut 134 therealong by a controller 140 programmatically controlling the motor 136 may be programmed to provide the rotation of the motor 136 to be geared down (typically) by the transmission 138 or gearbox 138, in order to rotate the screw 132. That rotational speed of the screw 132, thus controls how far and how fast the nut 134 will travel along the screw 132. A reversible motor 136 makes a linear actuator out of the nut 134, based a reversible rotation of the ball screw 132 by the motor 136 and transmission 138.

In the illustrated embodiments, the hanger 142 or clevis 142 captures a pulley 146 therein, rolling or fixed by a knot 148 or clamp. The "figure-8 knot" is a well-known and understood knot 148 used in climbing ropes and rescue. The line 27 may be a rope, such as a conventional Kernmantle rope used in climbing, both on rock and on artificial rock walls.

In certain embodiments, a knot 148 may be replaced with clamps, such as when the line 27 is a wire rope 27 or cable 27 of metal. Wire rope may be stronger and stiffer, certainly for comparatively equal sizes, and thus may often require less diameter and space. However, it tends to be less flexible and less elastically extensible.

Extensibility is problematic in that a length of rope tends to have an elastomeric response intended to gradually take up the momentum and energy of a falling body. Thus, as a swing 20, it may not be preferred. Rather, the line 27 may be formed of a rescue grade rope, which has comparatively negligible extension, or a wire rope that has even less (more negligible) extension under weight. The line 27 may be wire rope everywhere, or may connect to conventional climbing rope 27 nearer the rider 60 or climber 60 in the harness 28.

The ball nut 134 may proceed along a dedicated track, such as a track 112 or rail 112 of the system of FIG. 24A-24C. The rail 112 may provide the mechanical support and movement for the clevis 142 operating as a hanger 116 to support a pulley 146 on an axle 144.

Knots 148 or their equivalent for wire rope, clamps, tend to reduce the working strength of an individual line 27. Accordingly, the line 27 may be wrapped multiple times around a pulley 146 and anchored to the ball nut 134, or the clevis 142 rather than to itself. In this way, a certain amount of the stress otherwise experienced due to the bending and compressing of the line 27 against itself in knots 148 or clamps 148, or the like may be reduced if not eliminated.

Referring to FIG. 25C, multiple pulleys 146 may be spaced apart by widening the nut 134 will additional structure. Two pulleys 146 may operate as pivots 146, either with fixed lines 27 or moving lines 27 (as discussed at length hereinabove) passing around them. This configuration tends to keep any swinging motion within a single plane equidistant from the two points of suspension (centers 100 of pivoting) of the pulleys 146.

A swivel may operate essentially like a swivel of fish tackle permitting the harness 28 of a rider 60 and climber 60 to pivot with respect to the two lines 27 of FIG. 25C or any single line 27 as discussed herein. This permits an extra degree of freedom of motion during climbing, but especially during the swinging portion of this climbing and swinging event. With a single line, the swiveling motion may be less important, and provide a less pronounced difference from suspension by a single line 27.

For example, some wire rope 27 will tolerate or cause substantial twist (unwinding motion) when placed in tension. With the double lines of FIG. 25C, the swivel 216 may prove more important or desirable, since the double lines 27 will otherwise restrain rotation.

Figure 26A:
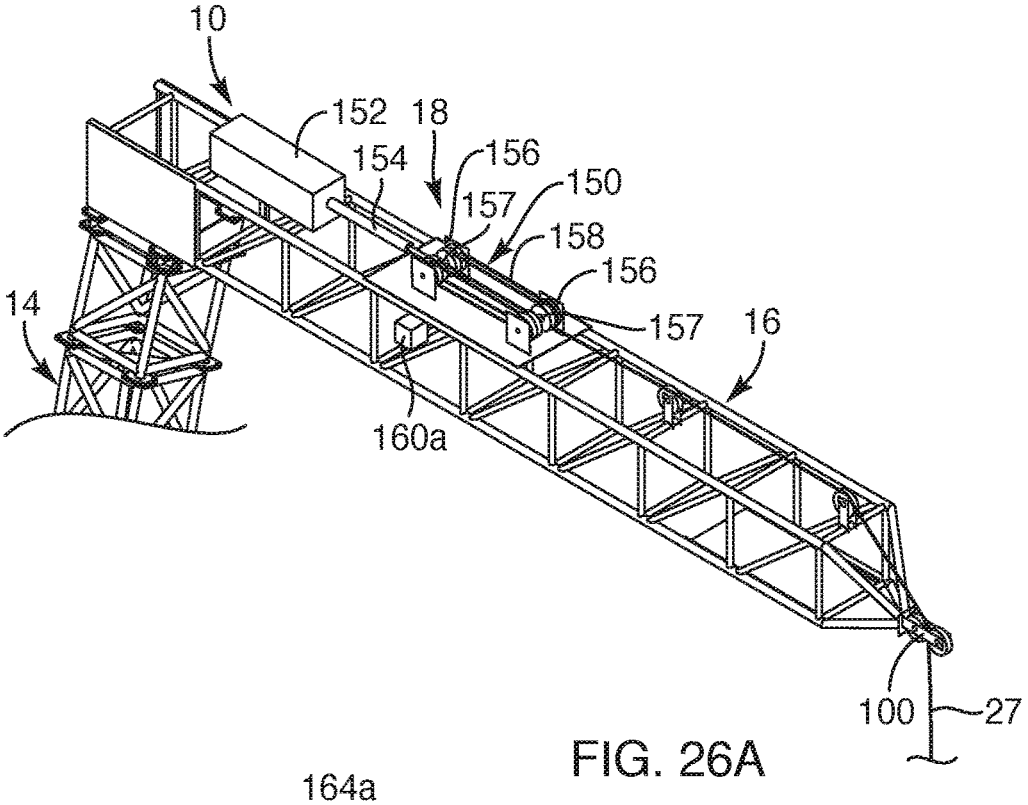
FIG. 26A is a perspective view of an alternative embodiment of a take-up (retractor) system for changing the radius by changing the length of line extended by a hydraulically actuated block and tackle, rather than altering the center of pivot, for a line that operates initially as a belay, and then as a swing for a climber on a wall in accordance with the invention.
Figure 26B:
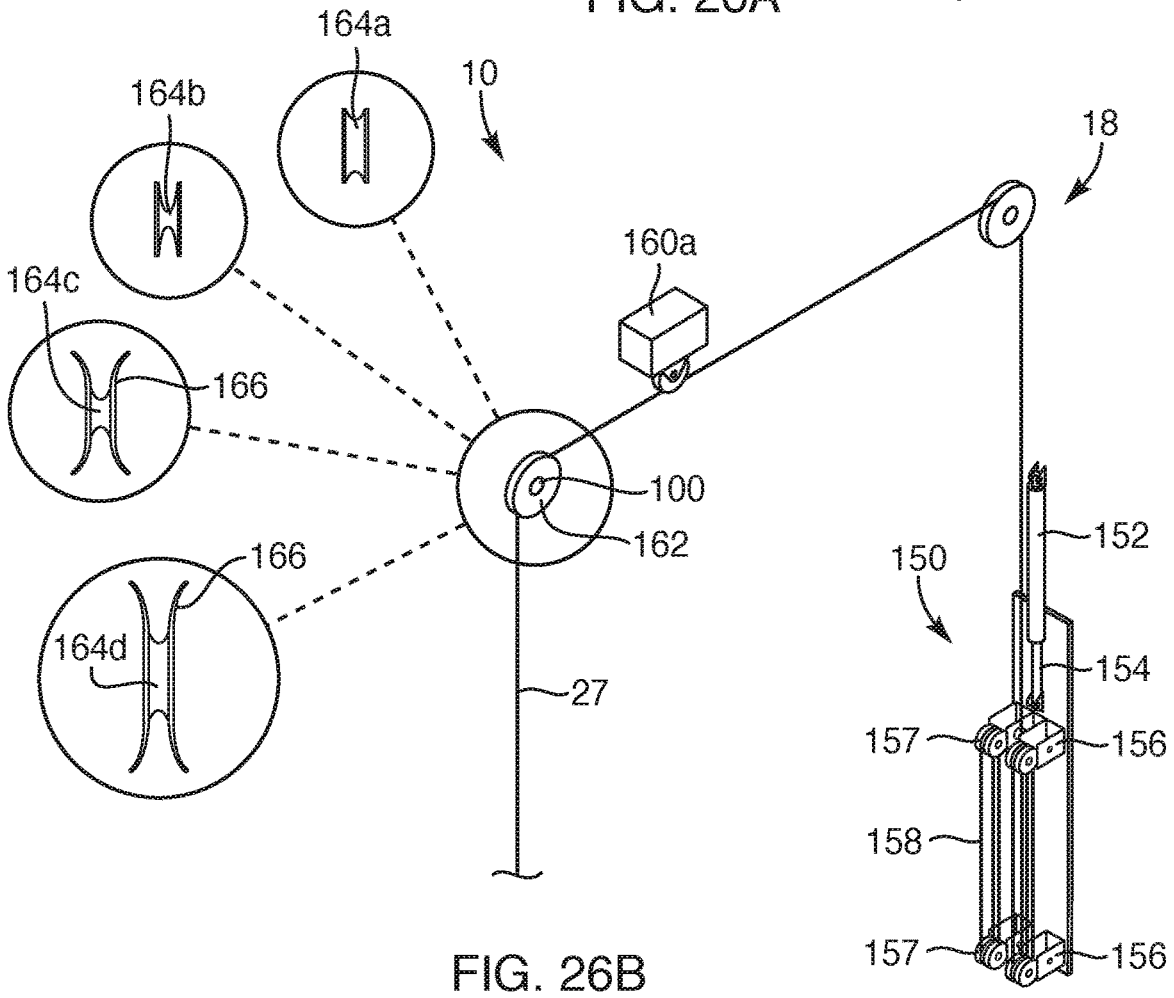
FIG. 26B is a perspective view of a vertically installed hydraulically driven block and tackle, illustrating a line tension sensor and various alternative pulleys and guides for keeping a line on the pulley providing the center of pivot.

Referring to FIGS. 26A and 26B, while continuing to refer generally to FIGS. 1 through 57, one alternative embodiment of a positioner 18 may simply be a take-up system 18 that relies on a hoist 150 operating as a block and tackle 150. In such a device, a hydraulic cylinder 152 may have a ram 154 extending therefrom under hydraulic pressure between blocks 156 on each. That is, the hydraulic cylinder 152 has a block 156 attached to it or near it as it anchors to a physical structure such as a beam 16.

This is basically a block and tackle operated in reverse (multiplying distance instead of multiplying force), driven by a hydraulic ram 154 extending from a hydraulic cylinder 152. The ram 154 may have another block 156 of pulleys 157 connected to it. Typically, a single axle effectively combines all pulleys 157 in a block 156. Upon retraction of a ram 154, the two blocks 156 separate from each other. Upon extension of the ram 154, the blocks 156 may move closer together. Other arrangements may also work equally well. Regardless, one block 156 is typically fixed with respect to the cylinder 152, and one is typically fixed with respect to the end of the ram 154, regardless of the overall connection scheme.

Meanwhile, the line 27 is wrapped around adjacent pulleys 157, first around a pulley of one end (block 156), and then around a pulley 157 at the opposite end (block 156). In this way, as a block and tackle 150 would work, the hoist 150 provides many times the take-up length of a line 27 to be taken up between the blocks 156, for a given extension or contraction of the ram 154 with respect to the cylinder 152.

Meanwhile, one end, the fixed end, of the line 27 is fixed with respect to the hydraulic cylinder 152 and the beam 16. The other end, the free end, of the line 27 is the hoist line 158 in between the blocks 156, or between the pulleys 157 of the blocks 156. Ultimately, the line 27 may be the exact same line as the line 27, 158. In other embodiments, the line 27 that actually connects to a user 60 may be linked in some other fashion to the line 158 operating on the blocks 156.

In the illustrated embodiment, various sensors 160 may be used. For example, a position sensor 160*a* may be used to detect a position of one of the blocks 156, the ram 154, or the like. The point of such a position sensor 160*a* is to detect exactly how much distance to the line 27 has extended or retracted with respect with a radius 102 of the line 27 with respect to the center 100 of pivoting.

Ultimately, the line 158, or the line 27, or both, if a single line 27 operates, such as a wire rope 27 (a climbing rope 27 not being well adapted to operating on automatic hydraulic equipment), may be run over a pulley 162 establishing the center 100 of pivoting. An additional sensor, or another sensor instead of the sensor 160*a* may be a load sensor 160*b*.

The load sensor 160*b* may be set at any point along the line 158, or the line 27 in order to detect how much force is in the line 27. The point of this tension or loading is a vector determination of the condition of the line 27 with respect to a climber 60.

It may be suitable to maintain a certain amount of tension in the line 27, typically less than about five pounds, urging a taking up of any slack in the line 27 between the point 100 or center 100 of pivoting, and the harness 28 of a user 60. Sensing greater tension in the line 27, may indicate that a user 60 is tugging against the line 27, and the hydraulic cylinder 152 should not move the ram 154, and release more line. Thus, a combination of knowing the position detected by the position sensor 160*a*, and the tension in the line 27 detected by a load sensor 160*b* may be used in combination to assess the condition of the line 27 and the user 60 on the wall 12.

For example, in one embodiment, distance may be the only parameter that matters. Timing may be used to control distance. On the other hand, in an embodiment such as the elliptical frame 14 of FIG. 23, both position and tension may be important parameters to detect in order to control when, with what force, and how far, the line 27 is retracted by the hydraulic ram 154 operating the blocks 156.

Referring to FIG. 26B, a vertical arrangement of the hydraulic cylinder 152 may be positioned away from the beam 16, with only the line 27 passing therealong. Also, guiding the line 27 may be done by one of various concepts for shields 166 and pulleys 164*a*, 164*b*, 164*c*, 164*d*. The pulley 164*a* may be quite conventional. Such may be entirely adequate. If a clevis 142 contains a pulley 146, 162, or axle 144, then escape of a line 27 from the pulley 164*a* is unlikely. However, with the lateral 11*c* motion imparted by a rider 60 swinging from a wall 12 toward the center 100 of pivoting, a lateral 11*c* component of motion may effectively swing a rider 60 sideways 11*c* and toward obstructions. In order to enforce a back-and-forth (transverse 11*b*) motion in a transverse direction 11*b*, between the wall 12 and the pivot center 100, a deeper, grooved pulley 164*b* or a guide 166 may be used.

For example, since the loading and material may be distinct, the pulleys 164*c* and 164*d* may alter both the diameter of the interior pulley 164*c*, 164*d*, as well as adding a guide 166 made of a different material. Typically, a metal pulley 164*c*, 164*d* will be stronger than a plastic one. However, polymeric shields 166 may be added beside the pulleys 164*c*, 164*d* to provide both increased effective diameter of the pulleys 164*d*, reduced friction on the line 27, as well as extending their flanges by adding shields 166. The shields 166 also assure that the lines are always well captured on the pulleys 164*c*, 164*d*. The shields 166 may or may not rotate with the pulley 164*c*, 164*d*. In some embodiments, the shields 166 may extend in a fixed relationship with respect to an axle 144, the beam 16, the positioner 18, a rail 112, or the like.

Figure 27:
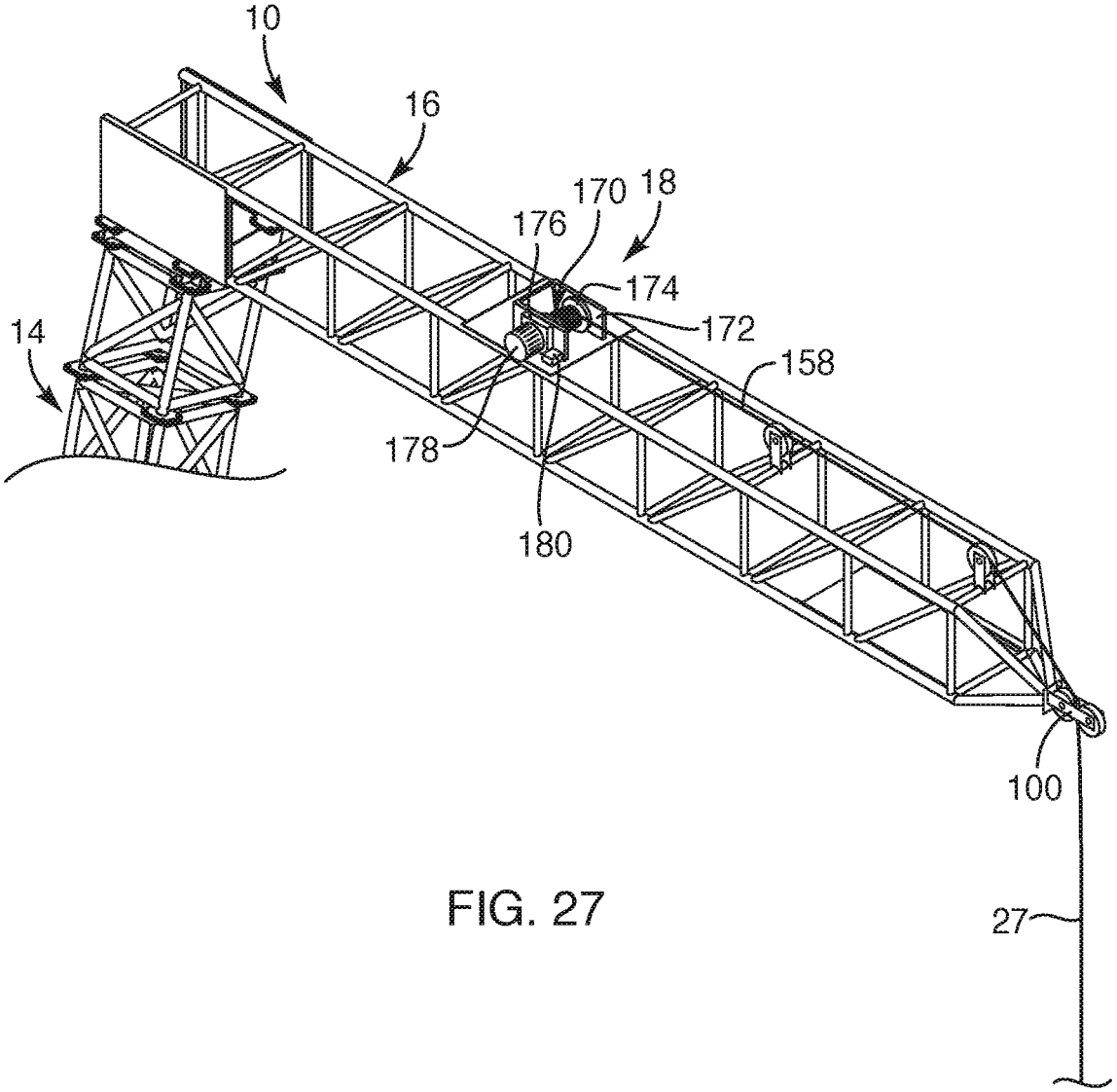
FIG. 27 is a perspective view of the take-up or retractor system of FIG. 26A, relying on a winch directly rather than the block and tackle, this retractor operating more directly on a line to support a climber during belaying and adjusting line length during climbing and consequent swinging operations.

Referring to FIG. 27, a basic winch 170 may be used as a positioner 18. In the illustrated embodiment, a winch 170 may be mounted with a frame 172 securing a reel 174. The reel will rotate in response to power through a transmission 176 moderating the speed and torque provided by a motor 178 as a motive means 178. The motor 178 may be controlled by a controller 180 responsive to switches, programs, and the like input by an operator of the system 10. Winches 170 tend to operate more slowly than a hoist 150. Thus, some combination of power, speed, overall distance, and the like may recommend or inform a decision as to what type of a positioner 18 will be used.

The positioner 18 may move the pivot center 100 or center 100 of suspension supporting a line 27. By the same token, a different effect may be obtained by moving the axle 144 on which any pulley 146, 162 may operate.

Figure 28:
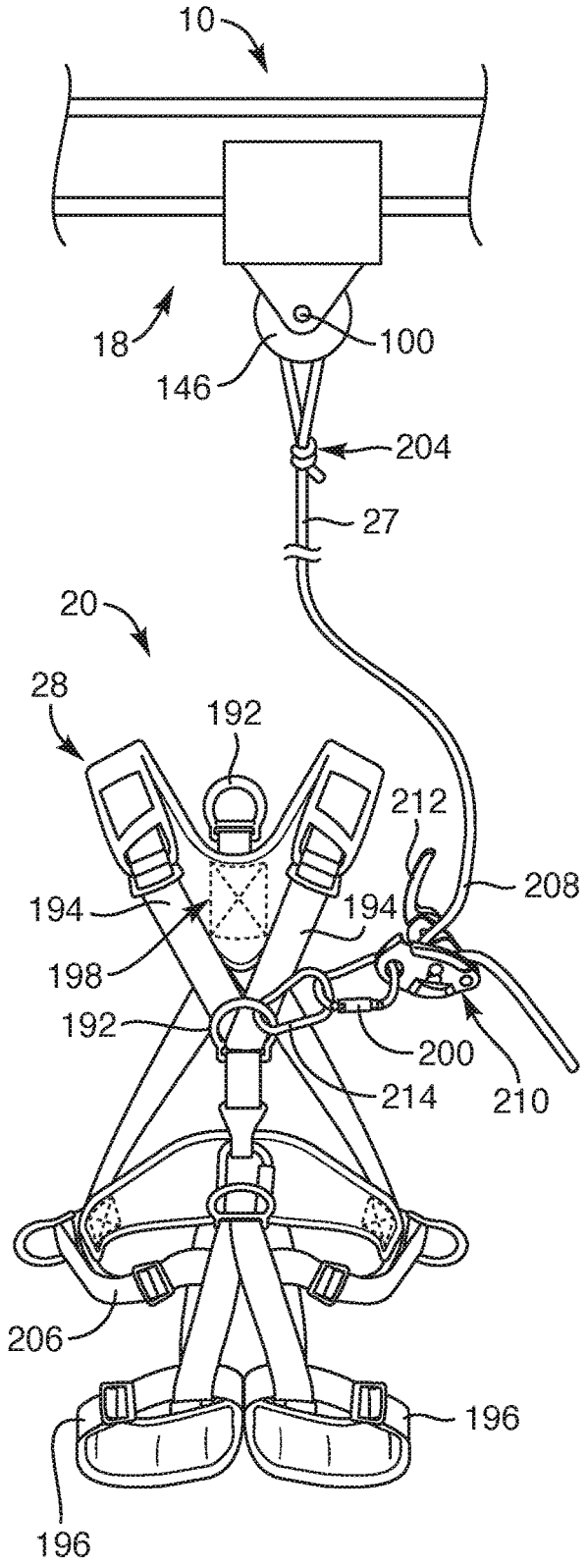
FIG. 28 is a perspective view of one embodiment of a swing mechanism including a top pulley providing a center of pivot about its axis of rotation and having a line descending therefrom connecting to a harness of a climber who will swing away from the wall after climbing it, on the same line that operated as a belay, also wherein a take-up is operable by a rider operator who takes up slack in the supporting line before a climbing event.
Figure 29:
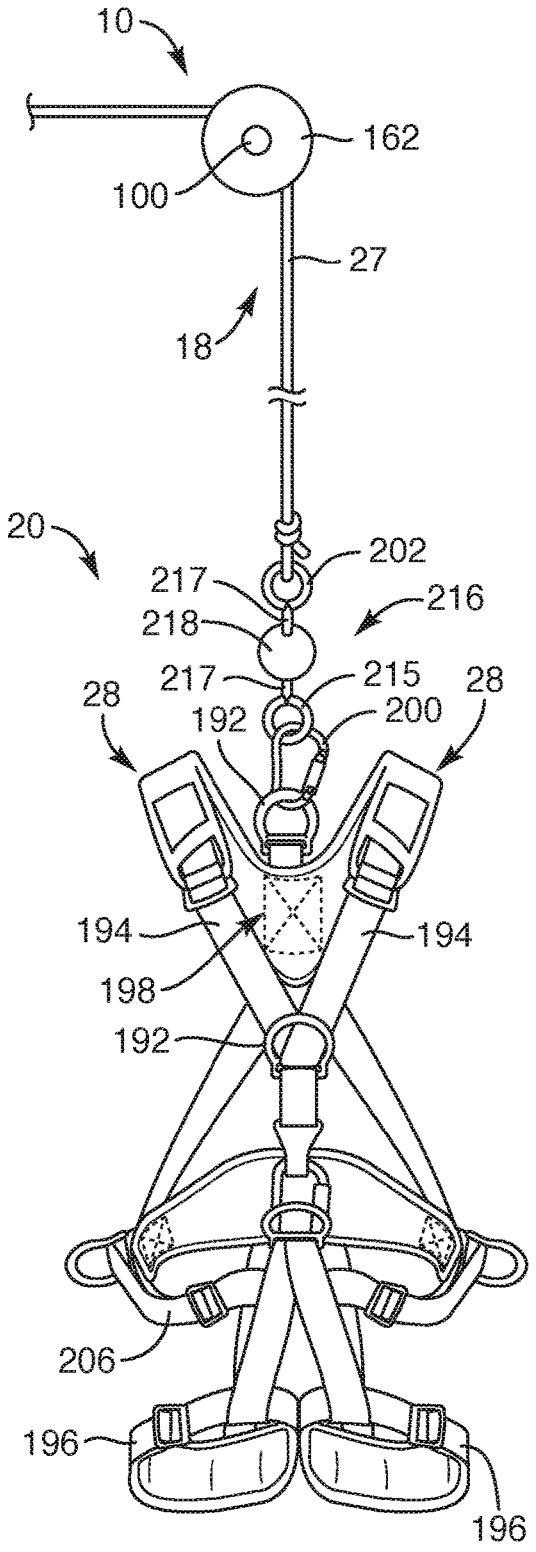
FIG. 29 is an alternative embodiment of a take-up and retractor apparatus to take up slack in a line operating as a belay, adjusting as needed throughout a climb and a consequent swing for a climber of a wall in accordance with the invention, also showing a swivel between the line and the harness of a user, which swivel may be applied to any or all embodiments of connections between the line and a harness.

Referring to FIGS. 28 and 29, while continuing to refer generally to FIGS. 1 through 57, a pulley 162 may be thought of as a top pulley 162, operating on an axle 144 defining the center 100 of pivot supporting a line 27. Ultimately, the line 27 may secure by a suitable means, such as a knot 204, or the like securing the line 27 to a ring 202 or a link 202.

The point here is to secure to a harness 28, which may include a connecting loop 192 for securing to the line 27. Typically, the loop 192 will be near a crossing point of shoulder straps 194 on the body harness 28. Such a harness 28 will have leg loops 196 and shoulder straps 194. The shoulder straps 194 typically connect to one another and to a belt 206 by reinforced connections 198, a patch 198 sewn together to the crossed shoulder straps 194.

Ultimately, a link 200 may link the harness loop 192 to a permanent link 202 secured to the line 27. A conventional climbing harness will typically connect a belt 206 or a loop formed by the leg straps 196 (leg loops 196) and the belt. That is, leg loops 196 are often straps that include buckles for adjustment. They may terminate in ends that are connected completely together, and pass by the belt 206, in an upward and downward fashion to create a remaining connection loop for a carabiner to secure the harness 28 to a line 27.

A difficulty with connecting to such a seat-type harness 28 is that the user 60 is suspended by a waist belt 206 and leg loops 196 in a pendulum fall in a system 10 in accordance with the invention. Usually, in climbing, a climber 60 takes a straight fall from a quasi-upright, or even standing, position. The fall may be easily handled by an extensible (lead climbing) rope 27 operating on a waist belt 206, or some attachment thereto through to the leg loops 196.

A pendulum fall is very different, and may be dangerous with such an attachment or harness to the center of mass of the body. A user 60 may be better suspended from higher (front or back of the chest) by a harness loop 192 where the shoulder straps 194 cross each other, in a reinforced connection 198. Thus, the user 60 will maintain orientation with respect to the line 27, as soon as a user 60 falls from the wall 12.

Referring to FIG. 28 specifically, one alternative embodiment of a connection to a line 27 may be an auto lock 210 or an automatic takeup 210, such as a Grigri™, other ascender, or similar locking device 210. A line 27, 208 may link to such at an auto lock 210 in which the line 27 passes through the auto lock 210, terminating in an outbound line 208. By tugging on the outbound line 208, an operator may take up all the slack in the incoming line 27 through the auto lock 210. Thus, the auto lock 210 operates to lock the loop 192 by the link 214 and link 200 to the line 27. This captures the harness loop 192, removing all slack between the harness loop 192 (and therefore the harness) and the line 27.

Upon completion of the climb and swing, a user 60 may be released by an operator who simply operates a handle 212 to slowly release under friction the outbound line 208, back out the way it came in as an incoming line 27. Various types of auto locks 210, ascenders, and the like are available in the art. For example, the references cited above as incorporated herein by reference contain details of structure and operation of various embodiments of lock off devices, ascenders, self-belay devices, and the like.

Referring to FIG. 29, specifically, the swivel 216 illustrated may be used in any attachment configuration to provide relative rotation between a user 60 in harness 28 and the connecting line 27. Swivels are common in fishing tackle to prevent spinning tackle from twisting fishing line. They are less common in industrial applications. Ball joints are used in various equipment applications, including hitches, tie rods, and so forth.

In the illustrated embodiment, a swivel 216 includes an upper ring 202 on a shaft 217 captured by a head (hidden, not shown) inside a center knuckle 218 (keeper 218) or connector 218 (keeper 218). Likewise, a lower loop 215 connects by a lower shaft 217 similarly captured by a head inside the knuckle 218 (keeper). Each loop 202, 215 may actually be integral with its respective shaft 217. Thus each loop 202, 215 and its respective shaft 217 is free to rotate completely, either clockwise or counterclockwise, with respect to the knuckle 218 (keeper 218). This reduces constraints on a climber 60, and may contribute to a more exciting swinging experience by adding a spinning degree of freedom in the motion of a user 60 swinging on the line 27 or multiple lines 27.

Figure 30:
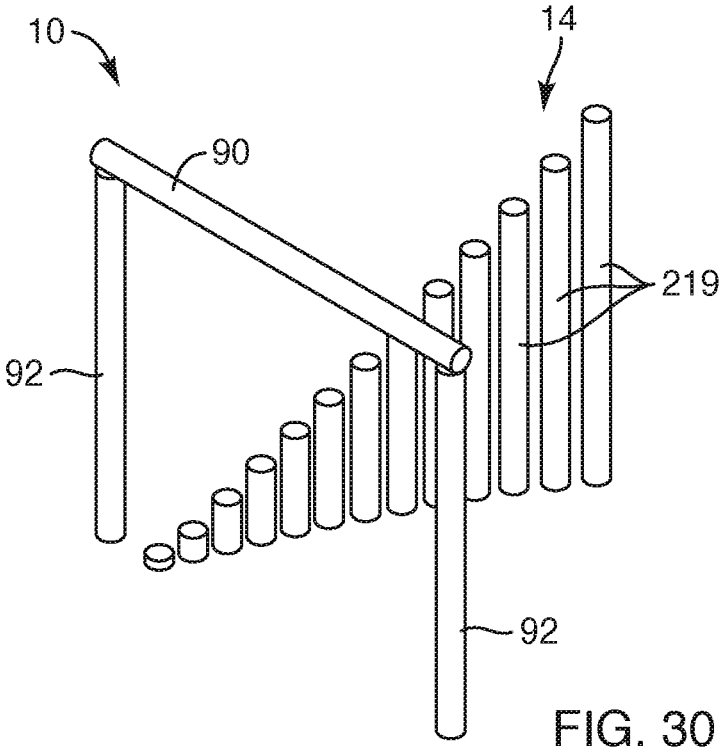
FIG. 30 is a perspective view of an alternative framing system for a climbing wall in accordance with the invention.
Figure 31:
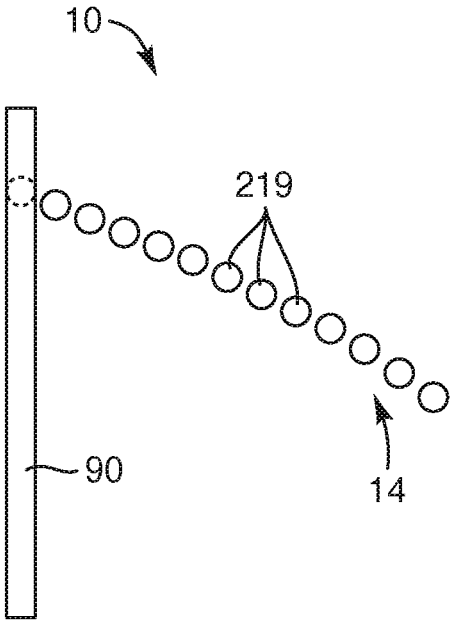
FIG. 31 is a top plan view thereof.
Figure 32:
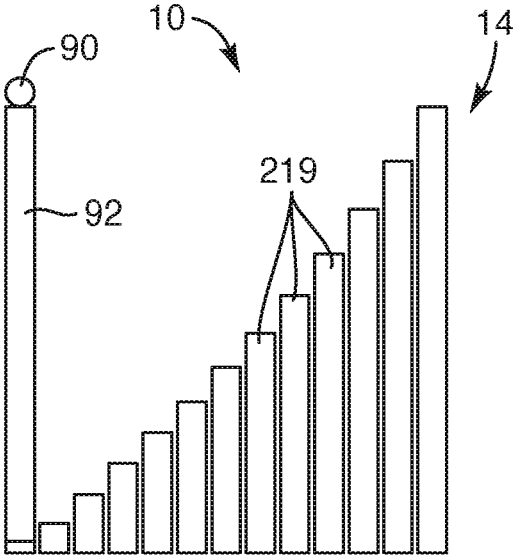
FIG. 32 is a right side elevation view thereof.

Referring to FIGS. 30, 31, and 32 an alternative to the frame 14 may be constructed using poles or posts 219 protruding from the ground. By changing the lengths (FIG. 30 perspective view and FIG. 32 side elevation view), a rise in altitude 11*a* and curvature with transverse direction 11*b* is provided. By arranging posts 219 along an arcuate path (FIG. 31) the progression in a lateral 11*c* direction is provided. Thus, a wall 12 may be secured to such a frame 14.

The cross beam 90 from a pole or tree as a source is quite straightforward, while pillars 92 are anchored similarly to the posts 219. Stability in all dimensions results from suitable ground penetration by all posts 219 and pillars. No overhead beam 16 is needed. Connection of the line 27 or a locator 18 and line 27 depends only on the cross beam 92, or the pillars 92 and crossbeam 20.

Figure 33:
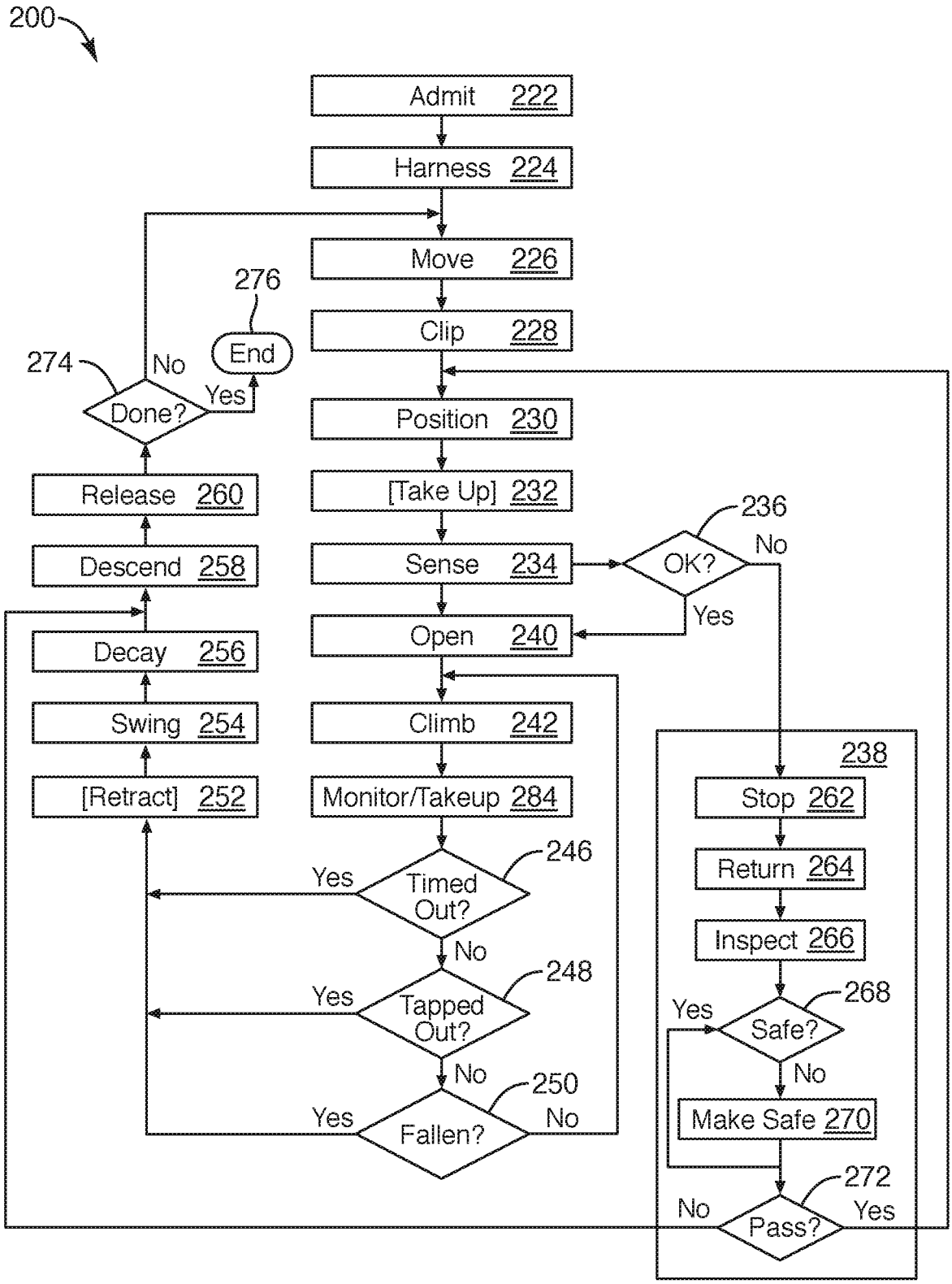
FIG. 33 is a schematic block diagram of a process for operating a system in accordance with the invention.

Referring to FIG. 33, a process 220 for operating a system 10 in accordance with the invention may begin with admitting 222 a climber 60 or user 60 within a fenced, enclosed, or otherwise restricted area considered an outer zone with respect to a safe zone. In this safe zone, a climber 60 has been admitted 222, but is only able to access the preparation area 22 or preparation station 22, and not the actual launch deck 24 or active area 24. In this safe area, harnessing 224 the climber 60 does not require any connection to the overhead line 27. Rather, a user 60 or several may dress in a harness 28 suitable for connecting to the line 27.

At the point of a preparation area 22, an attendant is best off by dealing with a single climber 60. The attendant will typically check carefully to be sure that the climber 60 is wearing a harness 28 appropriately, that all straps, links, connectors, and the like are in a condition suitable for protecting the user 60.

The process 220 may next involve moving 226 the climber 60 to an active launch zone 24 or an active zone 24. This region 24 may also be referred to as a launch deck 24. It is an area 22 unsafe for anyone to be in during an actual climb by a user 60. This is an area 22 that a user 60 relies on to clip in 228 the harness 28 to the line 27. Later on, this is an area that may be swept by a swinging climber 60 following completion of a climb or a failure of a climb up the wall 12 (e.g., fall, stall, pull-off).

In the illustrated embodiment, the positioning 230 of a positioner 18 may require retracting 230 a trolley 110 as a positioner 18. In fact, a positioner 18 may be thought of as a retractor 18 responsible to move a center of pivot 100 or center 100 of suspension. One function of positioning 18 the positioner 18 is to locate the positioner 230 in a proper relationship with respect to the climber 60 or user 60 in order to be able to secure the line 27 to the harness 28, and take up 232 any slack in the line 27 after clipping in 228.

As a practical matter, positioning 230 the positioner 18 may be also, or instead, the taking up 232 of slack in the line 27. However, in certain embodiments, as discussed hereinabove, the last measure of slack may actually be taken up 232 by an attendant drawing on a free end of a line 27 passing through a system at the positioner 18 or a take-up device 210 on a climber's 60 harness 28, which may also be thought of as an auto lock mechanism 210.

Sensing 234 may involve one or several sensors. One function of sensing 234 is to determine by suitable means, with a manual, electrical, mechanical, or computer controlled mechanism the proper positioning, loading, or the like of components in the system 10. For example, tension in the line 27 may be maintained above a nominally small or zero value. As a matter of safety, tension may be sensed 234 (typically by vector resolution) in the line 27. It may be maintained by the positioner 18 or other mechanism at some non-zero value. Such an increased value of tension may be five or ten pounds, and possibly more. This is significant force in the line 27, drawing a user 60 away from a wall 12, and requiring personal effort to overcome that force. Thus a load of 3 to 5 pounds is usually sufficient.

However, the presence of tension in the line 27 may also operate to rapidly control, additional retracting 230 or positioning 230 of the positioner 18 in order to take up 232 additional slack upon falling or the like. In fact, during climbing, it may be necessary to program a controller to take up slack, or possibly even let out a certain amount of slack, depending upon the sensors 160 in response to shape, length, clearance, other size or space factors, and the like corresponding to the wall 12.

Other sensing 234 may be sensing of position of the positioner 230, the user 60, the line 27, protective gates in the fence 80, or the like. Upon sensing 234, the process next tests 236 whether all sensors are reflecting a proper condition of the system 10 for operation with a new climber 60. If not, then an emergency check 238 is in order. If not, an emergency check 238 intervenes.

Meanwhile, if the test 236 determines that yes, the system 10 is in condition for regular operation. An interlock may be opened 240 in order to maintain proper length or take up of the line 27, tension in the line 27, or any other sensible measurement that may be sensed 234 by suitable sensors 160 and communication. Once all interlocks are open 240, the customer or climber 60 is free to climb 242 the wall 12, belayed by the line 27 connected to the harness 28. As described hereinabove, it is contemplated that a full body harness 28 is preferable in order to control orientation of the climber 60 with respect to the line 27, when the line 27 is loaded with the weight of the falling climber 60 in the harness 28.

Monitoring 244 by sensors 160 will occur on various sensors 160 (where a sensor 160 represents any one of specific sensors 160*a*, 160*b*, or the like) in the system 10. Distances, forces, tension, stress, positions, or other measureable parameters may be sensed 234 and monitored 244. Eventually, the system 10 may test for a certain condition based on the monitoring 244.

For example, one test 246 may test for a predetermined time allocated for a user 60 to climb the wall 12. A clock may determine whether a climber 60 has stalled out, failing to advance or retreat, but has not fallen. Based on the test 246 of timing out, the positioner 18 or retractor 18 may activate. However, so long as the test 246 results in detecting that the predetermined time has not yet occurred, a test 248 may determine whether the user 60 has topped out. If the user 60 has achieved the maximum distance possible to climb on the wall 12, a buzzer, bell, button, or the like may be available for touching by the user 60. Touching an indicator or sensor 234 indicates that the climber 60 has topped out.

This signal may result in converting to the process of swinging the user 60 on the line 27 away from the wall 12. However, if the test 248 determines that a user 60 has not topped out, then a test 250 may determine whether the user 60 has fallen. If a user 60 has not fallen, then the monitoring 244 continues with the tests 246, 248, 250, or others that may be determined useful.

If any of the tests 246, 248, 250 results in a positive output, a climber 60 has timed out, topped out, or fallen. The positioner 18 or other retractor 18 will typically retract 252, at a suitable speed, based on the monitoring 244, and the test 246, 248, 250 that indicates the user's 60 status. Retracting 252 assures that the user 60 and harness 28 will be pulled away from the wall 12, a suitable distance to prevent impact of the user 60 or any appendage of the user 60.

Given the fact that extremities may extend some number of feet away from the center of mass of a body, a distance of three to four feet may be a suitable distance for retracting 252 the positioner 18. Retracting 252 may involve moving the positioner 18, or may involve reeling in a length of the line 27. Either will take up or shorten a radius 102 of the line 27 extending from the center 100 of suspension to the harness 28.

Following a retraction 252 to shorten 252 the radius 102, a user 60 will swing 254 downward away from the wall 12, into space. In the various embodiments, the user 60 may automatically swing away from the wall 12, in a vertical direction 11*a*, a transverse direction 11*b*, and possibly a lateral direction 11*c*, due to the relative position of the center 100 of suspension and the shape of the wall 12. Eventually, the swinging activity will decay 256, and may decay 256 in response to damping.

Eventually, the positioner 18 will be activated to cause the harness 28 and line 27 to descend 258 to a position locating a user 60 on the launch deck 24, or in an area within the immediately available space therearound. A user 60 may then be released 260, typically by releasing 260 the harness 28 from the line 27. This may involve unclipping the harness 28 from the line 27, exiting by the user 60 from the launch area 24, and unharnessing in the preparation space 22, or outside the preparation space 22.

A test 262 may then determine whether the processes are done, and if so, may end 264 operation of the system 10. However, if operation 220 of the system 10 is not finished, the process 220 returns to moving 226 the next climber 60 to the active target zone or the active zone 24 for operating as a launch deck 24. At that point, again, the line 27 will be connected to the active climber's 60 harness 28, and so forth.

The emergency check 238 may involve a stop 264. This may occur by warning lights flashing, by the positioner 18 taking up line 27 or moving its position in order to lift a user 60 away from the wall 12, or otherwise immobilizing a user 60 from beginning to climb 242. A return 266 to the active zone 24 may follow the stop 264, and may involve returning a user 60 bodily at the end of the line 27.

Alternatively, an attendant or operator of the system 10 may return a user 60 to the launch deck 24 or active zone 24. Inspecting 266 may involve checking for any sensors 160 that may have triggered the stop 264. Inspecting 266 the harness 28 and the line 27, as well as any connectors 200, 202 or similar links 200, 202 may then be appropriate. A test 268 determines whether a climber 60 is now safe, and if not then makes safe 270 that user 60. Eventually, if the test 272 determines that the user 60 is safe, then the emergency check 238 returns back to the process 220 at the positioning 230.

On the other hand, if the test 272 results in no pass, then the emergency check 232 may be repeated. It will typically fail, resulting in return of the process 200 to the release 260 of the passenger for further remediation of the failed condition. The condition may be in the user 60, the harness 28, the line 27, or any other component of the system 10.

Referring to FIGS. 34 through 38, which omit many details for clarity, several alternative mechanisms and systems 10 for implementing a swing 20 are illustrated. In the illustrated embodiment, the frames 14 supporting each of the climbing walls 12 in various, possible, alternative configurations are arranged to support a swing 20 on a horizontal beam 16. Each of the beams 16 may extend effectively parallel to a wall 12 corresponding thereto. Accordingly, when a line 27 is secured to the overhead beam 16, a climber 60, upon falling from a respective wall 12 will swing in a plane perpendicular to the longitudinal orientation of the corresponding beam 16.

Figure 34:
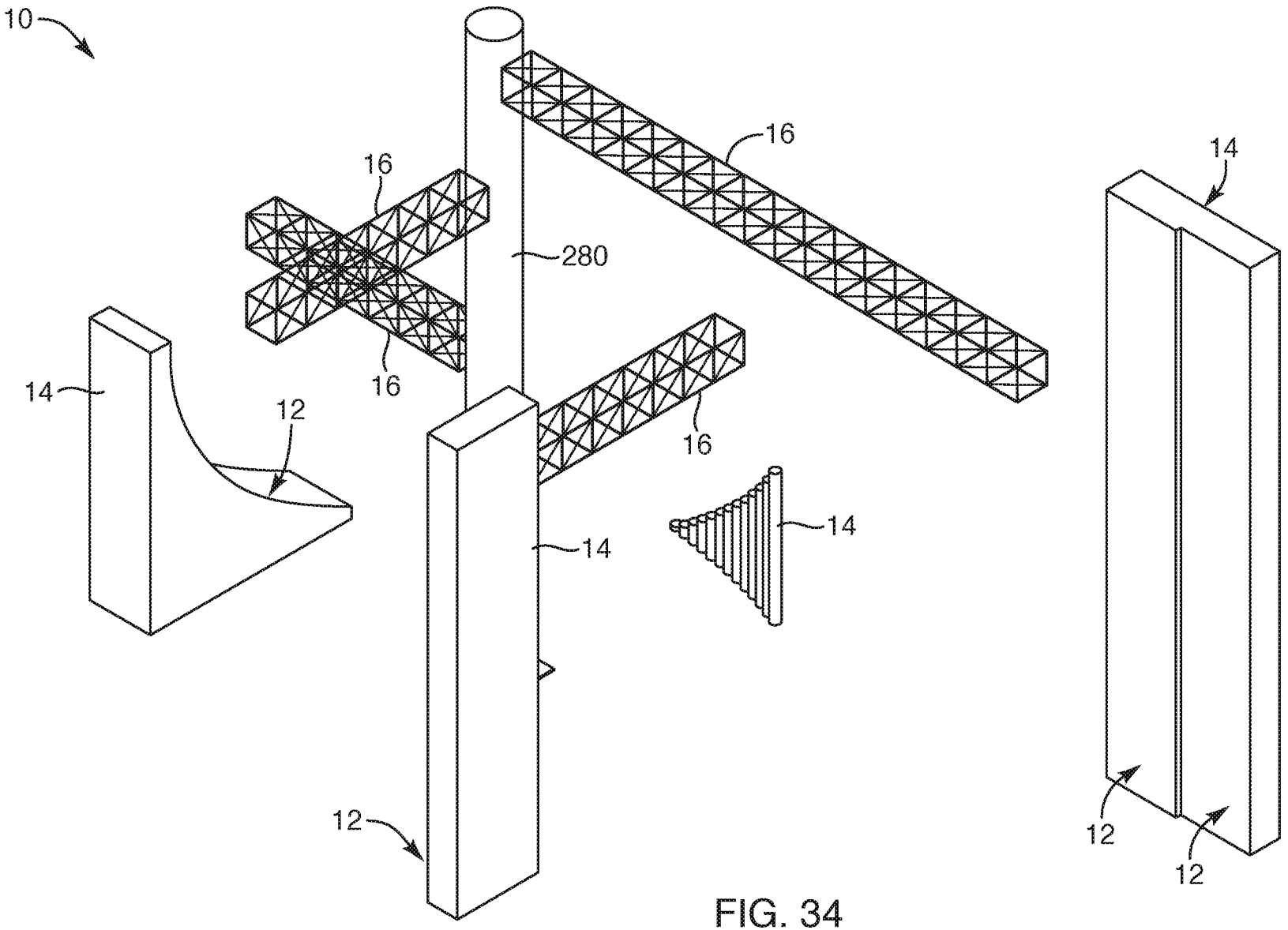
FIG. 34 is a perspective view of a cross-swing alternative embodiment of a system in accordance with the invention.

In the illustrated embodiments of FIG. 34, a central tower 280 supports at least one end of each of the beams 16. Accordingly, a climber 60 may climb either a curved wall supported by a curving frame 14, a pole array forming a frame 14, or a curved wall secured to or supported by a pole frame 14 as described hereinabove. Similarly, a more conventional framing 14 may support a more conventional vertical wall 12.

Figure 35:
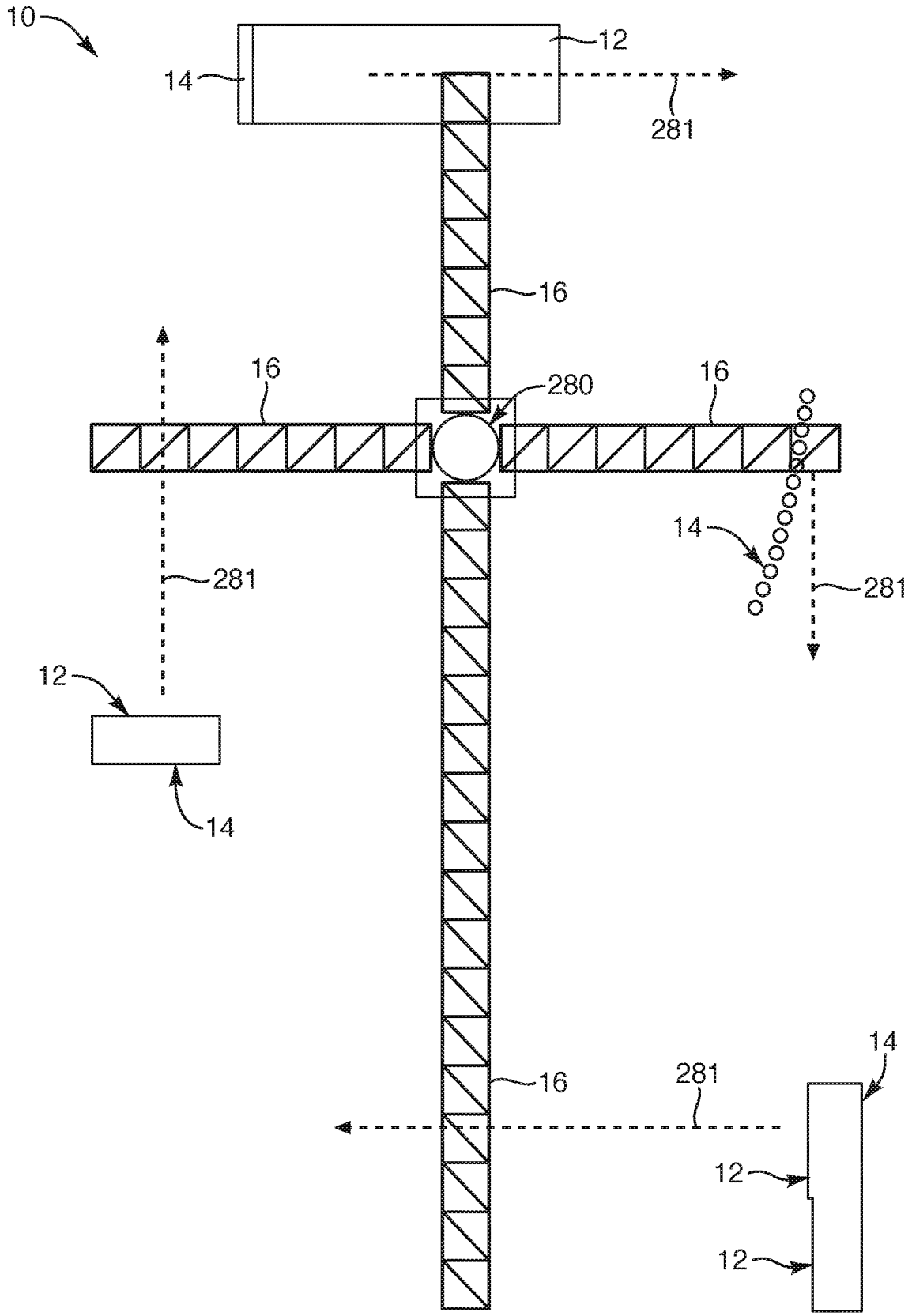
FIG. 35 is a top plan view thereof.

In the embodiment of FIGS. 34 and 35, the swing path lies in a plane perpendicular to the longitudinal orientation of the corresponding overhead beam 16 that will support the belaying line 27 extending down to a climber 60. Upon releasing one's grip on a wall 12 or otherwise falling voluntarily or involuntarily from a wall 12, a user 60 will thus swing away from the corresponding wall 12, and in an arc perpendicular to the supporting overhead beam 16. Any of the system components described hereinabove may be mounted to that beam 16 as appropriate.

Figure 36:
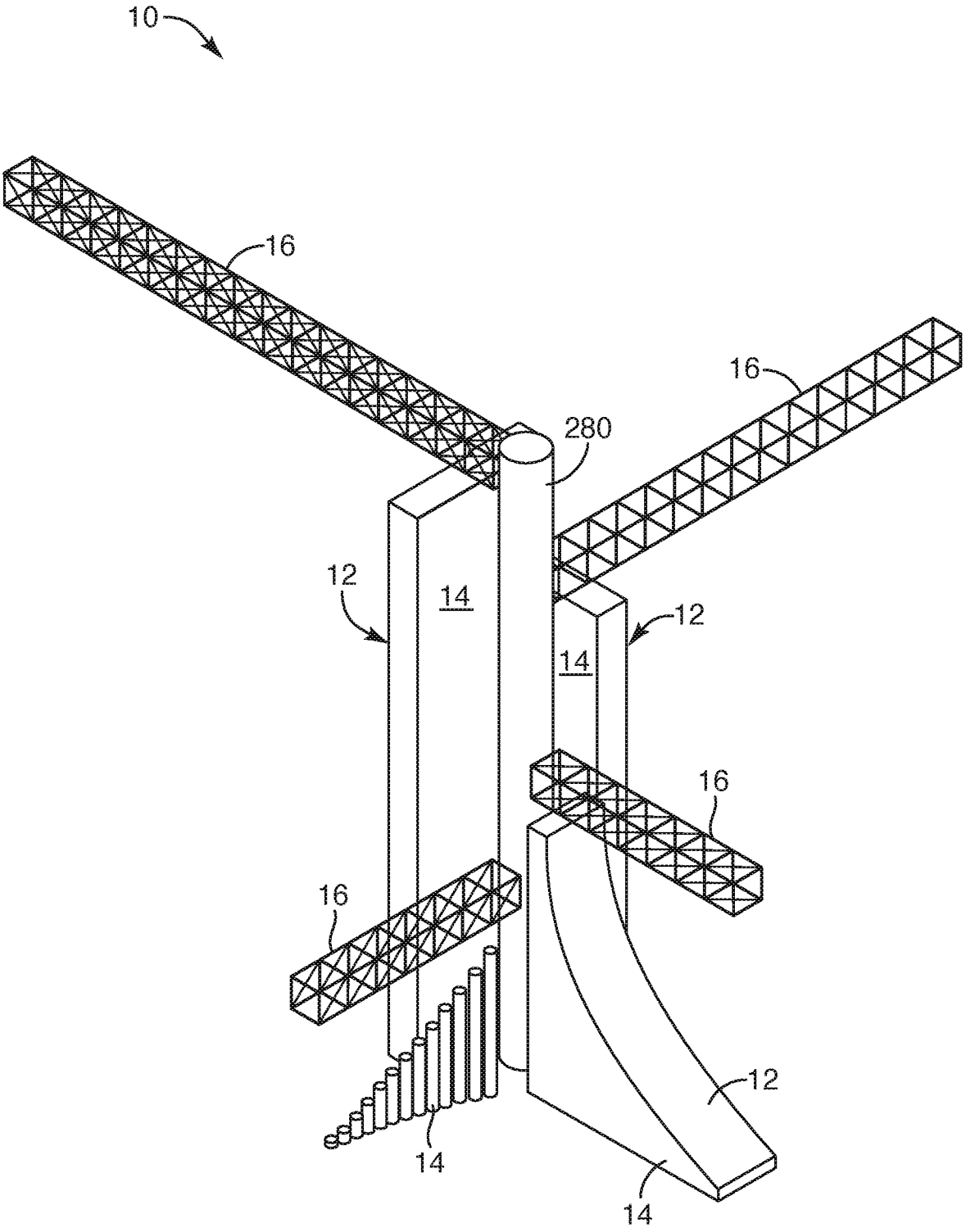
FIG. 36 is a frontal perspective view of a parallel-swing alternative embodiment.
Figure 37:
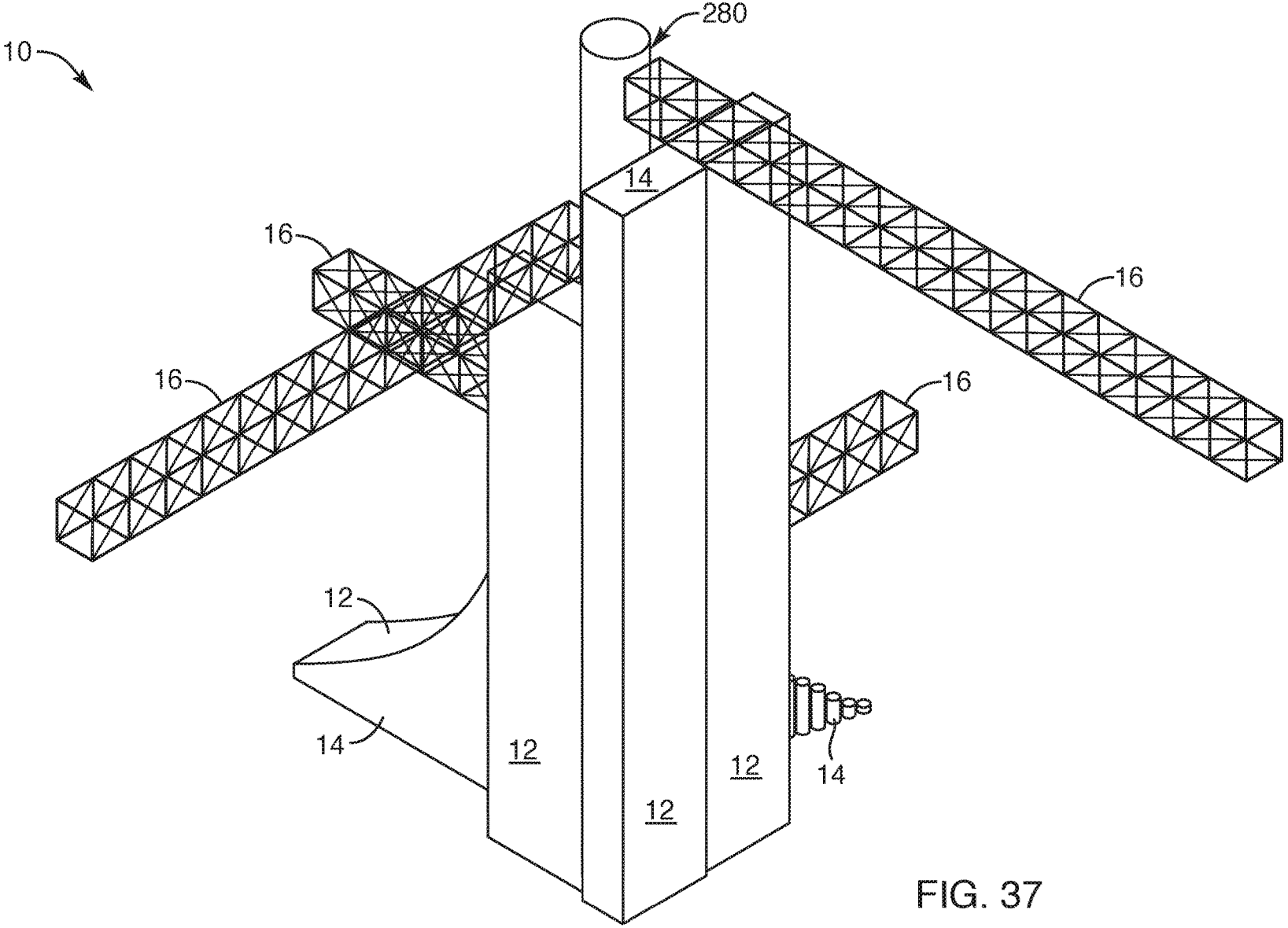
FIG. 37 is a rear perspective view thereof.
Figure 38:
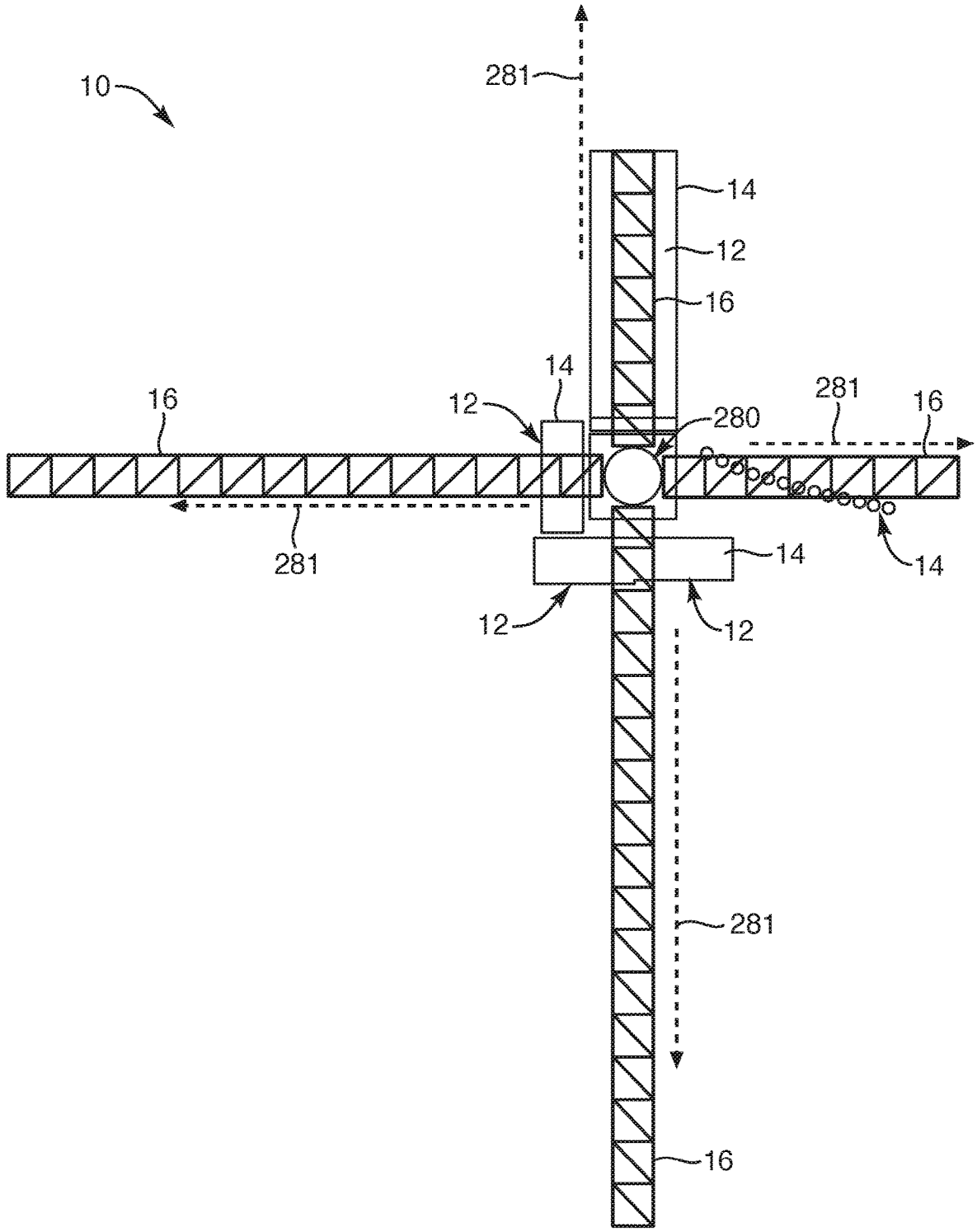
FIG. 38 is a top plan view thereof.

Referring to FIGS. 36 through 38, an alternative embodiment of a central tower 280, supporting various horizontal overhead beams 16 extending away therefrom places all of the walls 12 and their respective frames 14 (some walls 12 removed for clarity of the frames 14) in close proximity about the central support tower 280. In such an embodiment, each respective overhead beam 16 may be set at its own altitude along the height of the tower 280 or vertical extent of the tower 280. Thus, a smaller or shorter climbing route may correspond to a shorter line 27 and correspondingly lower overhead beam 16.

Again, a climbing route may be established on a more conventional wall 12, supported by its own frame 14. Likewise, a climbing route may be on a wall supported on a set of poles anchored in the ground, or may be just the poles themselves. A wall that is simply supported by a pole type of frame is discussed hereinabove.

Similarly, another frame 14 such as a system of trusses, lattices or the like may also support a wall having an incline, a circular arc, an elliptical arc, or some other arcuate shape rising from a base surface to a height near that of a corresponding beam. Such a wall or other climbing structure may be served by an overhead beam to swing a user 60 in an arc in a plane (path 291) parallel or perpendicular to a corresponding overhead beam 16.

One will note that in each of the embodiment of FIGS. 36 through 38, the central tower 280 benefits, or may be connected in order to stiffen and support the various frames 14 around the tower 280. This may also assist in improving the cantilever support for each of the overhead beams 16. In contrast, the embodiments of FIGS. 34-35 rely on frames 14 and walls 12 remote and independent from the tower 280 are also possible.

One will also note that the swing direction 281 of each climber 60 upon release from a corresponding climbing wall 12 in FIGS. 36-38 will be in a plane effectively parallel to the supporting overhead beam 16 from which the climber 60 is suspended. In FIGS. 34-35 the plane of such arc is perpendicular to the beam 16 from which it descends.

Referring to FIGS. 34 through 38, one will note that beams 16 extend in multiple directions, either orthogonal or parallel to one another, and all orthogonal to the vertical, longitudinal direction of the tower 280. One may extend a beam 16 from any suitably secure and supporting location on a tower 280. The frames 14 of FIGS. 34-35, are spaced farther from the tower 280. They may accommodate a greater number of overhead beams 16 having less than ninety degrees of angle therebetween. However, interference between swing paths 281 may militate for larger separation distances.

In contrast, the embodiment of FIGS. 36 through 38 maintains all climbing frames 14 and their corresponding walls 12 in close proximity to the tower 280. This provides additional stiffening and strengthening of the tower 280 and may provide additional support for the overhead beams 16. However, it may necessarily limit the horizontal width of, or the number, of walls that can be positioned around the circumference of the tower 280. Meanwhile, no swing path 281 (*arc*) inherently presents any interference with another.

On the other hand, if strictly vertical walls 12 were used, then a hexagonal central shape, octagonal central shape, or the like might present multiple facets or faces or surfaces as climbing walls 12. Just as the separate frames 14 of vertical walls 12 in FIGS. 36 through 38 are positioned at right angles to one another, greater than ninety degrees may exist between the walls. This is speaking of their back sides. The angle is less than two hundred seventy degrees from the perspective of their front faces. Thus, a quadrilateral, a pentagon, hexagonal, septagonal, octagonal, or other polygonal orientation of multiple walls 12 beside one another may be implemented.

A tower 280 may support an octagonal arrangement of various walls in which a, climber 60 may swing parallel to a wall in the central area, or a wall positioned at an outer extremity of one of the beams 16. As discussed hereinabove, a wall 12 may be positioned near a central tower 280, thereby swinging a fallen climber 60 out away from the tower 280 or in a swing direction 281 away from the tower 280. Alternatively, for example in a building, each of the overhead beams 16 may extend out to a climbing wall 12 at or near its outer most extremity, or near its outermost extremity, thereby swinging a climber 60 parallel to that beam, and toward the tower 280 upon falling.

Such a system 10 may benefit from an auto takeup system, or auto-belay system. As a practical matter, an auto-belay would best serve only if modified to prevent immediate descent. That is, conventional auto-belay systems begin immediately descending a climber 60 upon loading the line 27 with the full weight of the climber 60. Auto belay systems rely on a slight take up force sufficient to draw in the line 27, but insufficient to support the weight of a climber 60. Safe swinging away from the wall 12 on a line 27 supported by an overhead beam 16 would usually militate toward maintaining the length of a line 27 at the length it has upon falling, or shorter, in order to provide safety, especially with respect to striking a ground surface, supporting surface, floor, or the like.

Figure 39:
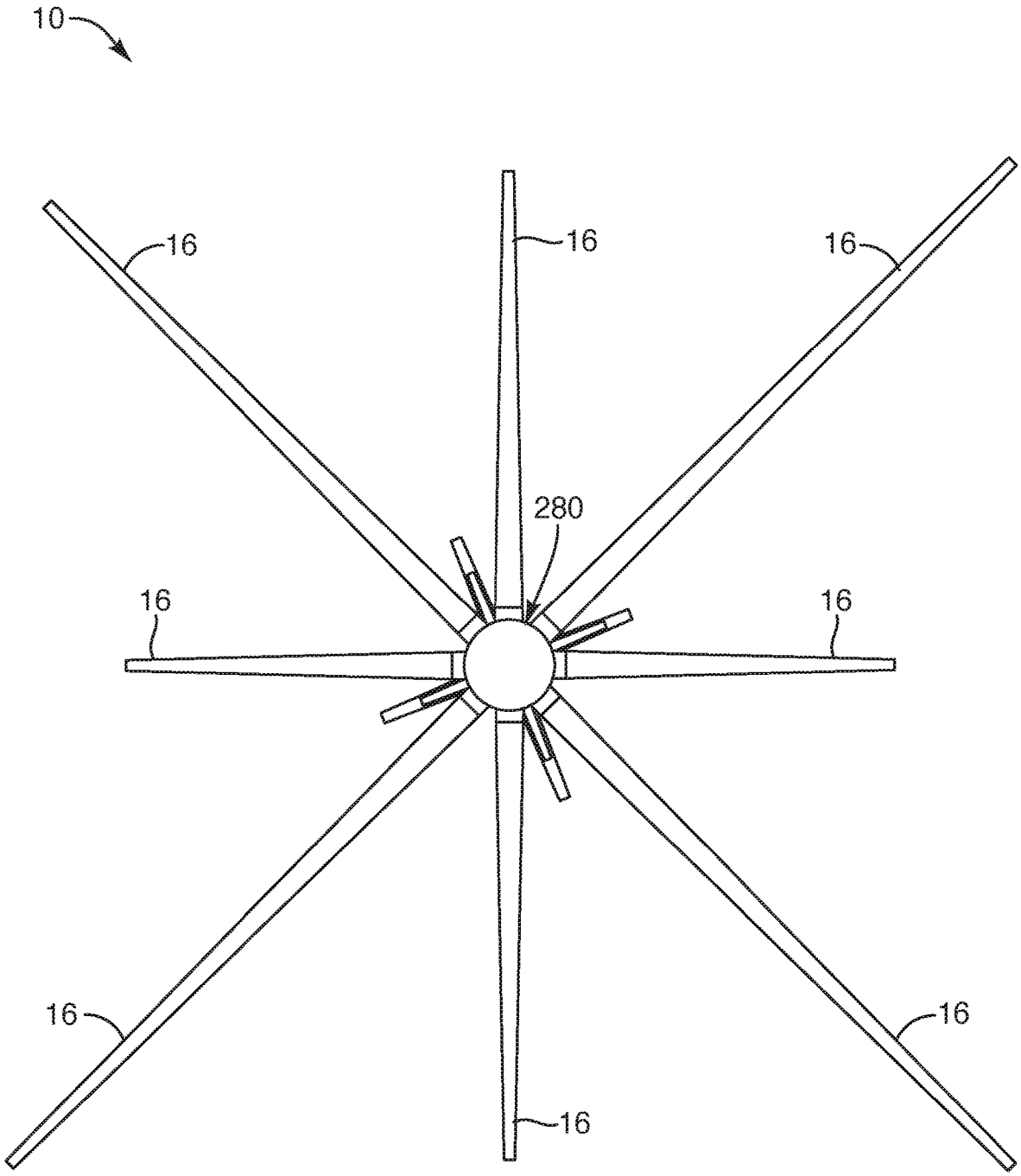
FIG. 39 is a top plan view of another alternative embodiment in a star configuration of upper beams.

One benefit of an embodiment in accordance with FIG. 39 is that the overhead beams 16 may be trussed together across the top of the tower 280 such that the full span from one beam 16 across the tower 280 to an exactly parallel and collinear opposite beam 16 could be supported by the overhead truss thus balancing across the tower 280. In this way, the cantilevers that become or support the overhead beams 16 may be substantially deeper, stiffer, stronger, more stable, and less flexible if desired.

Figure 40:
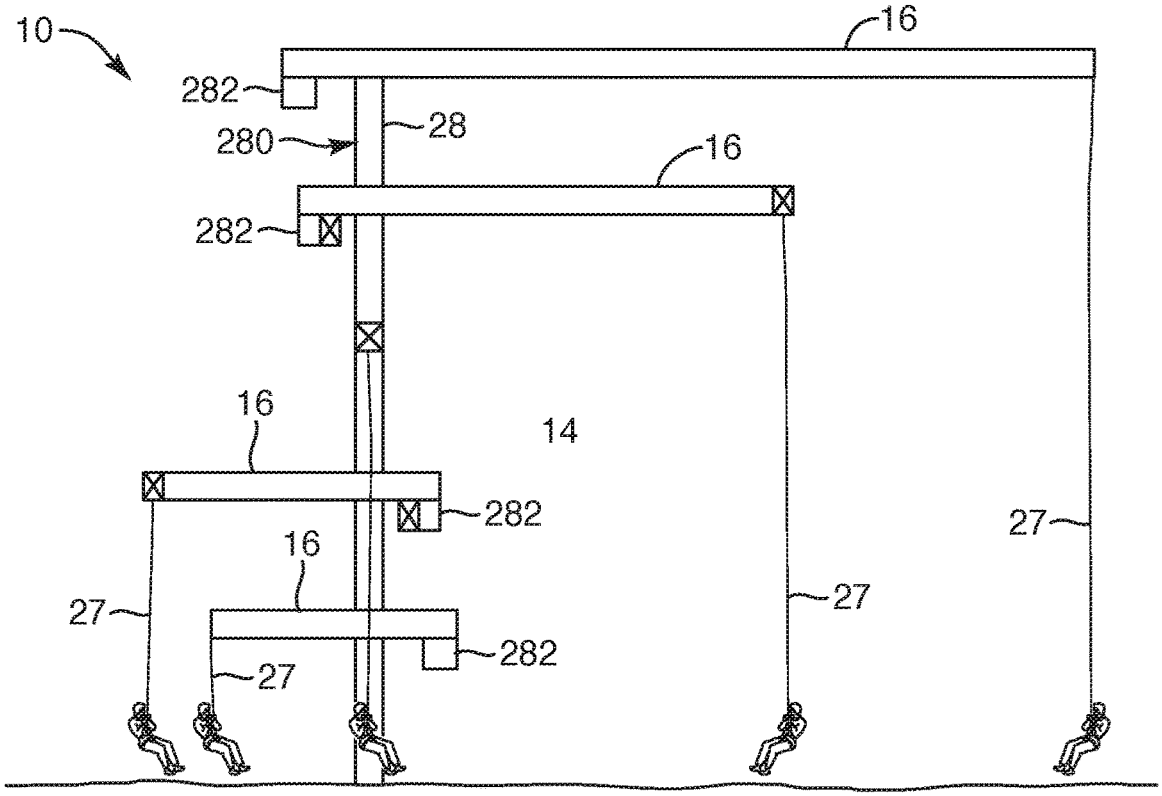
FIG. 40 is a side elevation view of an alternative crane-like embodiment of multiple swing systems about a central tower for purposes of supporting a climbing wall near that center tower.
Figure 41:
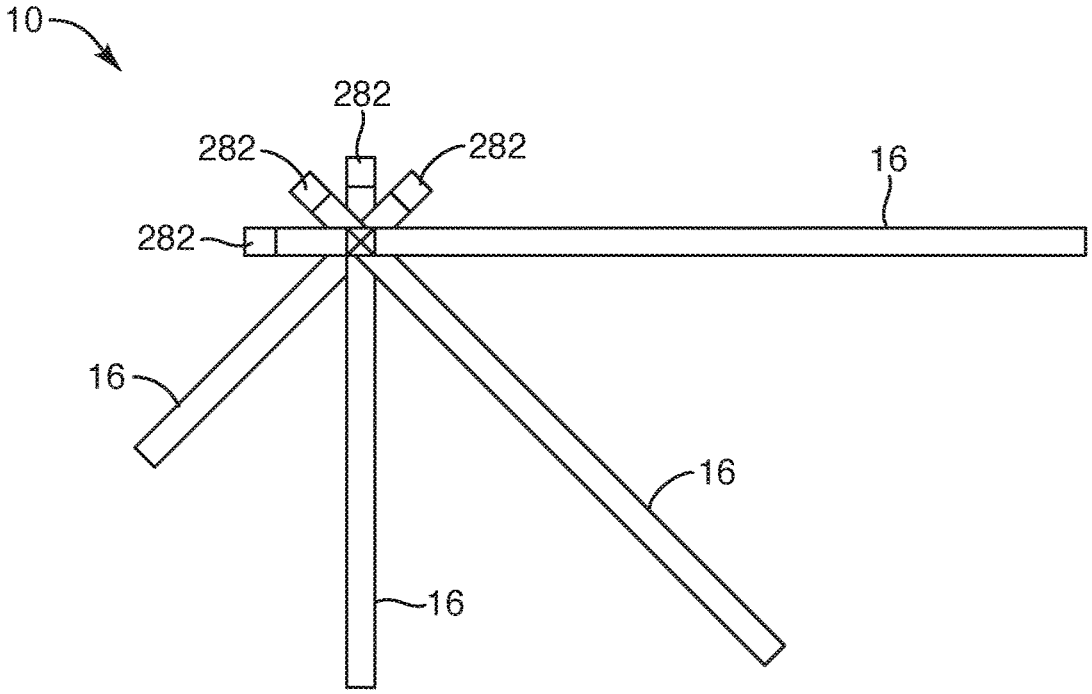
FIG. 41 is a top plan view thereof.

Referring to FIGS. 40 and 41, another alternative embodiment of a system 10 in accordance with the invention relies on a central tower 280 that supports crane-like, overhead beams 16 positioned at various locations that circumferentially distributed about the central tower 280. In this embodiment, the cantilevered beams 16 may be provided with counter weights 282 in order to stabilize them about the tower 280 and eliminate part of the torque or the "couple" (a structural term of art meaning a rotating force that might otherwise exist at the connection location of each beam 16 and the tower 280).

In this embodiment, again, the height and length of each overhead beam 16 may be selected according to the height of a particular wall corresponding thereto. The length maintained in each line 27 is thus unique to its overhead beam 16, the length of that beam 16, the height of that beam 16, and the height of the corresponding wall.

Figure 42:
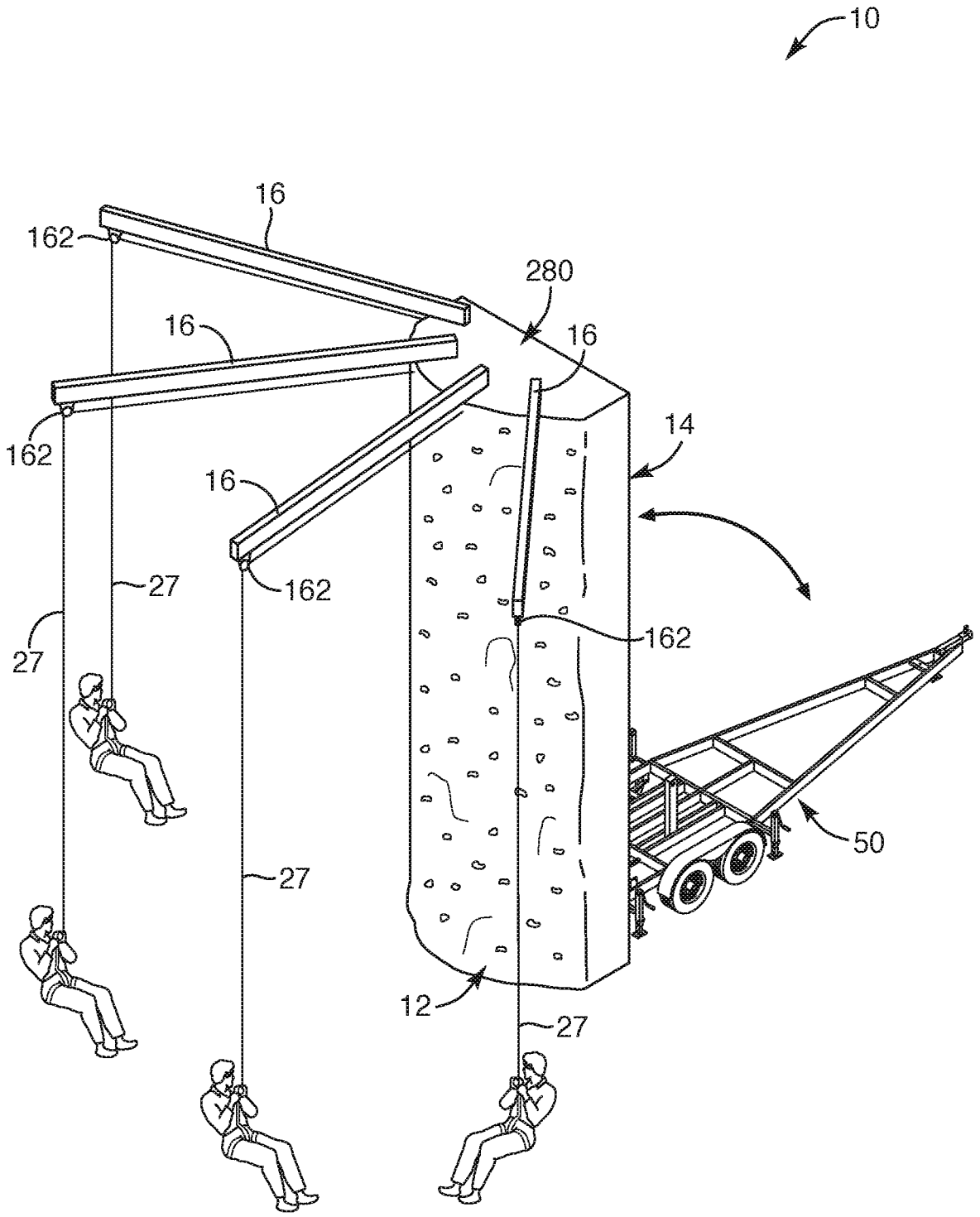
FIG. 42 is an alternative embodiment of a multiple swing climbing tower mounted on a trailer frame to be mobile.

Referring to FIG. 42, in one alternative embodiment of a system 10 in accordance with the invention, a tower 280 may effectively serve as the frame 14 for a climbing wall 12 having various routes, or even various faces, but are serviced by multiple overhead beams 16. In such an embodiment an auto belay, or an auto take up 286 may mount within the frame 14 or behind it in order to provide automatic take up on each of the lines 27 supporting a climber 60. In the illustrated embodiment, the tower 280 is mounted to pivot upward from a trailer 50 as a carrier 50 or supporting vehicle 50. Thus, the tower 280 may be pivoted down onto the trailer 50 in a stowed position and may be pivoted upward into a vertical, deployed position.

In the illustrated embodiment, multiple overhead beams 16 extend away from the frame 14, supported thereby. From each of the overhead beams 16, a line 27 extends, typically across a pulley 162 near the end of each beam 16 farthest away from the tower 280 and frame 14. In this manner, a climber 60 may climb on a vertical wall 12 and upon releasing hold upon the wall, or otherwise falling, may swing away from the wall 12, on the line 27 about the pulley 162. Meanwhile, an automatic take up operating much like an auto belay, but not immediately descending the climber 60, may accommodate the reduced distance from the pulley 162 to the climber 60 as the climber 60 ascends the wall 12.

For example, one may think of an overhead beam 16 and a wall 12 as forming two legs of a triangle. The hypotenuse of that triangle is represented by the line 27 extending from a pulley 162 at a distal end of the overhead beam 16. The climber 60 on the wall 12 is attached to the other end of that line 27 to form and define a hypotenuse. The hypotenuse, and the vertical leg of the triangle both reduce as the climber 60 ascends. In fact, the length of the line 27 extended from the pulley to the wall 12 may eventually approximate the length of distance of the pulley 162 from the wall 12 directly horizontally.

Upon falling or jumping from the wall 12 the climber 60 will thus be swinging on the shortest length of line 27 ever remaining on the climb. Thus, there exists little or no chance of striking the supporting surface or the ground therebelow.

Initially, it is possible that a climber 60 stumbling and falling right at the ground level near the wall 12 would have more line 27 extended than the vertical distance from a climber 60 directly underneath the pulley 162. Thus, a climber 60 stumbling on a first step or hold might conceivably have a standing fall to the ground. However, even that should be ameliorated by the climbing harness 28 anchored at a waist location or chest location to the line 27.

Figure 43:
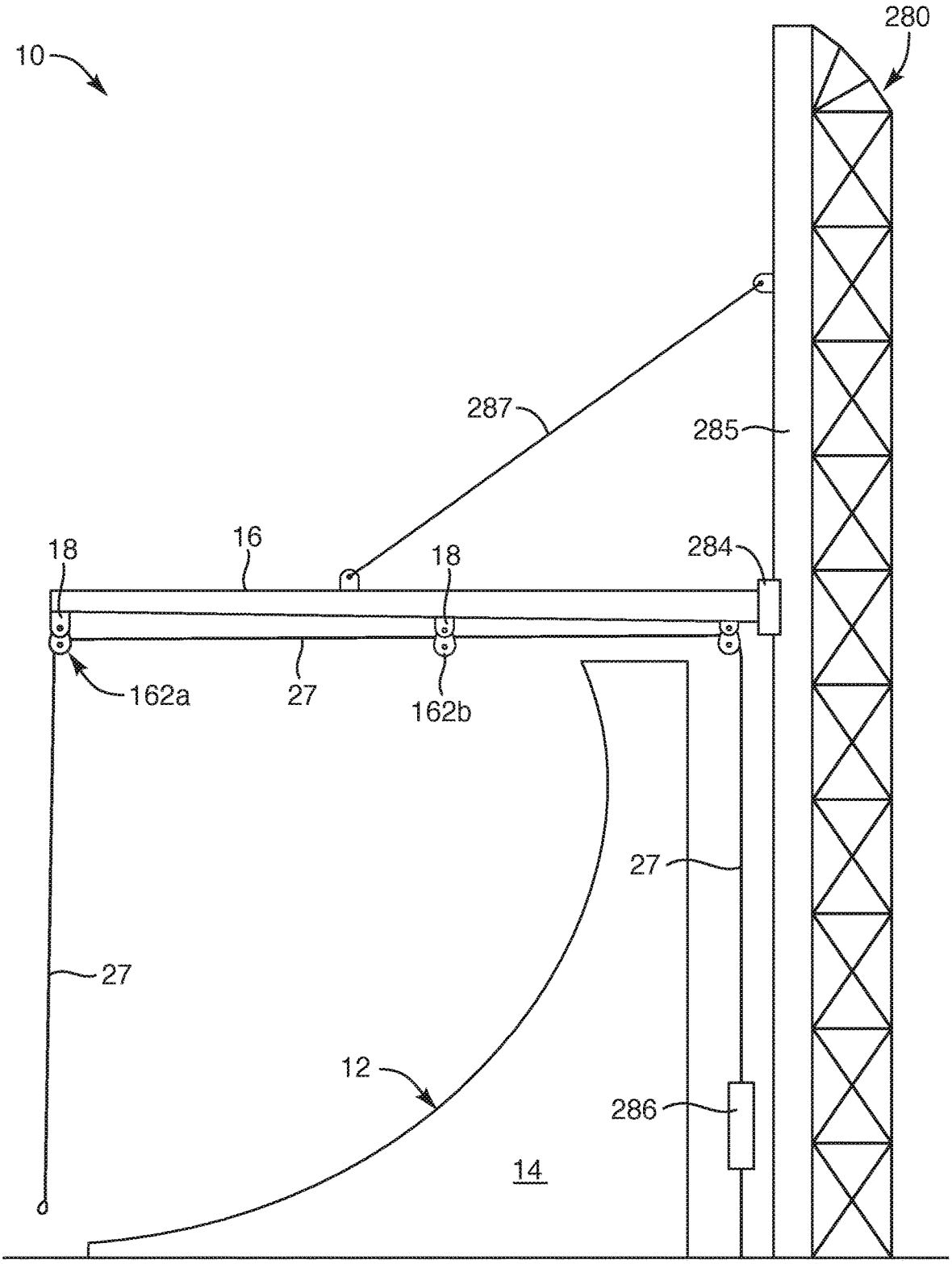
FIG. 43 is a side elevation view of a system in accordance with the invention having a curved wall below an upper beam, in which the safety line or cable to a climber is automatically retracted or retrieved by an auto take system, and a tower provides vertical support for the upper beam.
Figure 44:
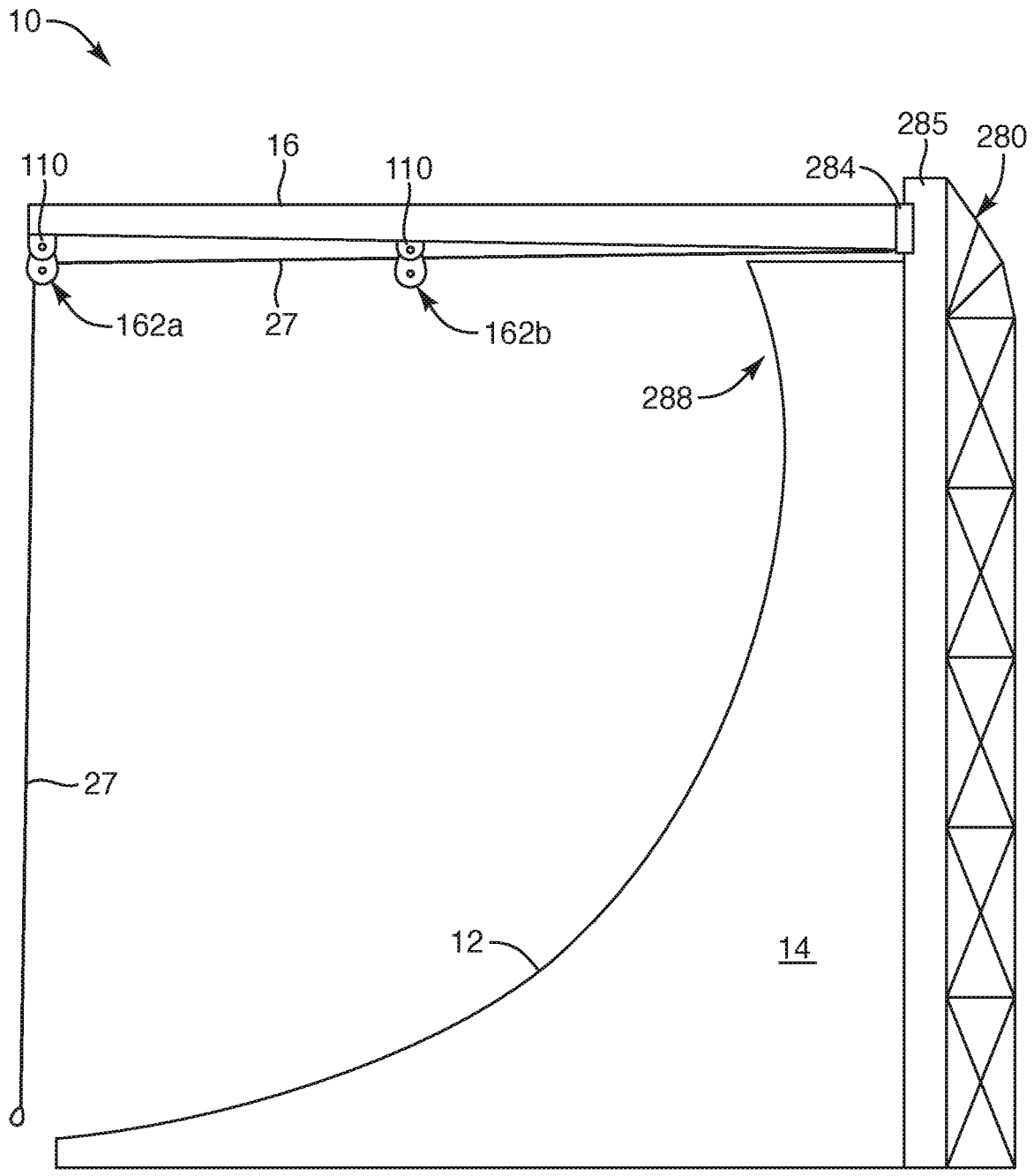
FIG. 44 is a side elevation view of a system in accordance with the invention relying on an automatic take up and having an overhang or inverted region near the top of the climbing wall.

Referring to FIGS. 43 and 44, in certain embodiments, a tower 280 may extend above a horizontal, overhead beam 16 to render the beams 16 adjustable in height. This central tower 280 may support and transfer between each of the horizontal beams 16 a certain portion of the lateral load. For example, if another beam 16 were attached to the tower 280 and extending opposite the illustrated beam 16, then the guy line 287 extending from the tower 280 to the beam 16 supports both vertical load and lateral load.

Accordingly, if an identical beam 16 were to extend away from the tower 280 in direction collinear or parallel with that of the beam 16, then another guy line 287 to such a beam 16 would still add vertical load to the tower 280 but would neutralize, by vector analysis, the horizontal loads between the two beams 16.

In certain embodiments, by proper mechanization of the structural supports for the beam 16 and guy line 287 along the tower 280, the beam 16 may be shifted in altitude along the height of the tower 280, to any altitude desired. Thus, as illustrated, the pulley 162 may be shifted to match the length of line 27 descending to the height of the wall 12 and position of that pulley 162 as described hereinabove.

In the illustrate embodiment, an auto takeup system 286 may provide for automatic adjustment of the height of the line 27 or the harness 28 of a climber 60 by taking up length of the line 27 as the climber 60 ascends the wall 12.

Referring to FIG. 44, a wall 12 along a frame 14 may be cantilevered from a tower 280. Nevertheless, in the presence of the framing 14 for supporting a wall 12, additional support may be provided for the horizontal beam 16. Meanwhile, the line 27 may extend out over pulleys 162 supported by a trolley 110, which may actually move along the upper beam 110 either to adjust to the advance of a climber 60 along the wall 12, or to shorten the swing that may result at the end of a climb. As discussed herein above, the concept of a pulley 162 may be used as a convenience and a frictional amelioration for the moving line 27.

In this embodiment, the central tower 280 may again accommodate multiple walls 12 with their respective frames 14. Likewise, the tower 280 may serve to stabilize various different types of walls 12 and different types of frames 14 as discussed hereinabove with respect to FIGS. 34 through 38.

Figure 45:
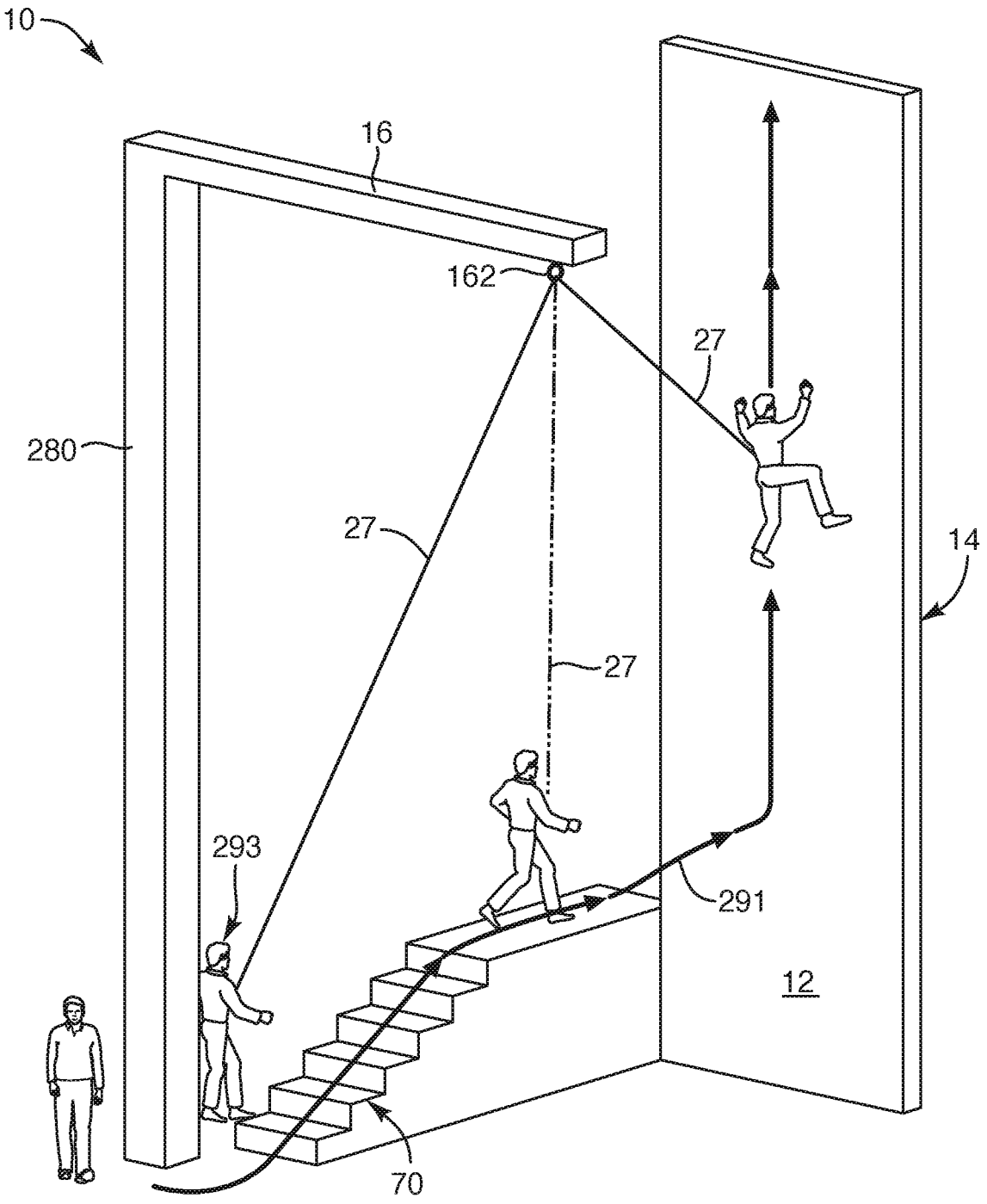
FIG. 45 is a perspective view of a simplified embodiment in which a swing tower is installed near a more conventional vertical climbing wall, using a stair or other riser to assure that a climber can never swing sufficiently close to the ground to strike it, and the take up is not automatic, but is provided by a belayer.

Referring to FIG. 45 a tower 280 and overhead beam 16 may be adapted for any climbing structure. Classical climbing structures include climbing walls 12 supported by frames 14, as illustrated. Meanwhile, the path 291 of a climber 60 may be from ground, up a series of steps 70 or some other incline 70 or riser 70, in order to initiate a climb on a wall 12. Any type of structure that is capable of being climbed may be used.

One caveat, however, may be that the climbing structures 12, 14 should not be capable of interfering with the swing away from the climbing structures 12, 14 occasioned by a fall. Moreover, in the illustrated embodiment, a belayer 293, a second person, may actually secure the line 27. Typically, belay devices exist, they bear names such as a GRIGRI™, an ATC™ (air traffic controller), a GRILLON™, an SIR™ or the like. In fact, a setup relying strictly on carabiners is also possible. The point is that a frictional control device may be worn on the harness of a belayer 293 who then takes personal responsibility for maintaining a slight tension, simply enough for take up, on the line 27 as a climber 60 ascends the wall 12. Upon falling, the climber 60 is supported by the line 27 and the belayer 293 as in a conventional pendulum fall.

In certain embodiments, the cantilever configuration of an overhead beam 16 may provide a certain resilience and spring by deflecting slightly. This deflection tends to relieve any jolt or jarring force from a fall. As a practical matter, by maintaining a line 27 with substantially no slack in it, most falls will immediately tension the line 27. This will swing a climber 60 in a graceful arc with no substantial impact loading by the line 27 on the climber 60 through the climber's 60 harness.

Referring to FIGS. 46 through 50, while continuing to refer generally to FIGS. 1 through 57, a system 10 may be configured in certain embodiments to operate with a harness 28 in which a user 60 connects directly to a pair of belay lines 304 secured to a takeup system 290. In the illustrated embodiment, a takeup system 290 provides control of the length or extension of belay lines 304 that will secure to a chest ring 12 on a harness (body harness 28) on a user 60. In the illustrated embodiments, the belay lines 304 may eventually be connected together to become a single belay line 294, selectively paying out and taken up by the belay takeup 290.

The takeup system 292 operates to position the trolley 110 along the rail 112 supported under the overhead lateral beam 16. Meanwhile, a line 296 or takeup line 296 connects to the trolley 110, thus drawing the trolley 110 along the rail 112 under the beam 16. One will note that a system of pulleys 298*a*, 298*b*, 298*c* permits the takeup systems 290, 292 to be hidden out of the way on an opposite side of the frame 14 from all the activities by a user 60.

Figure 46:
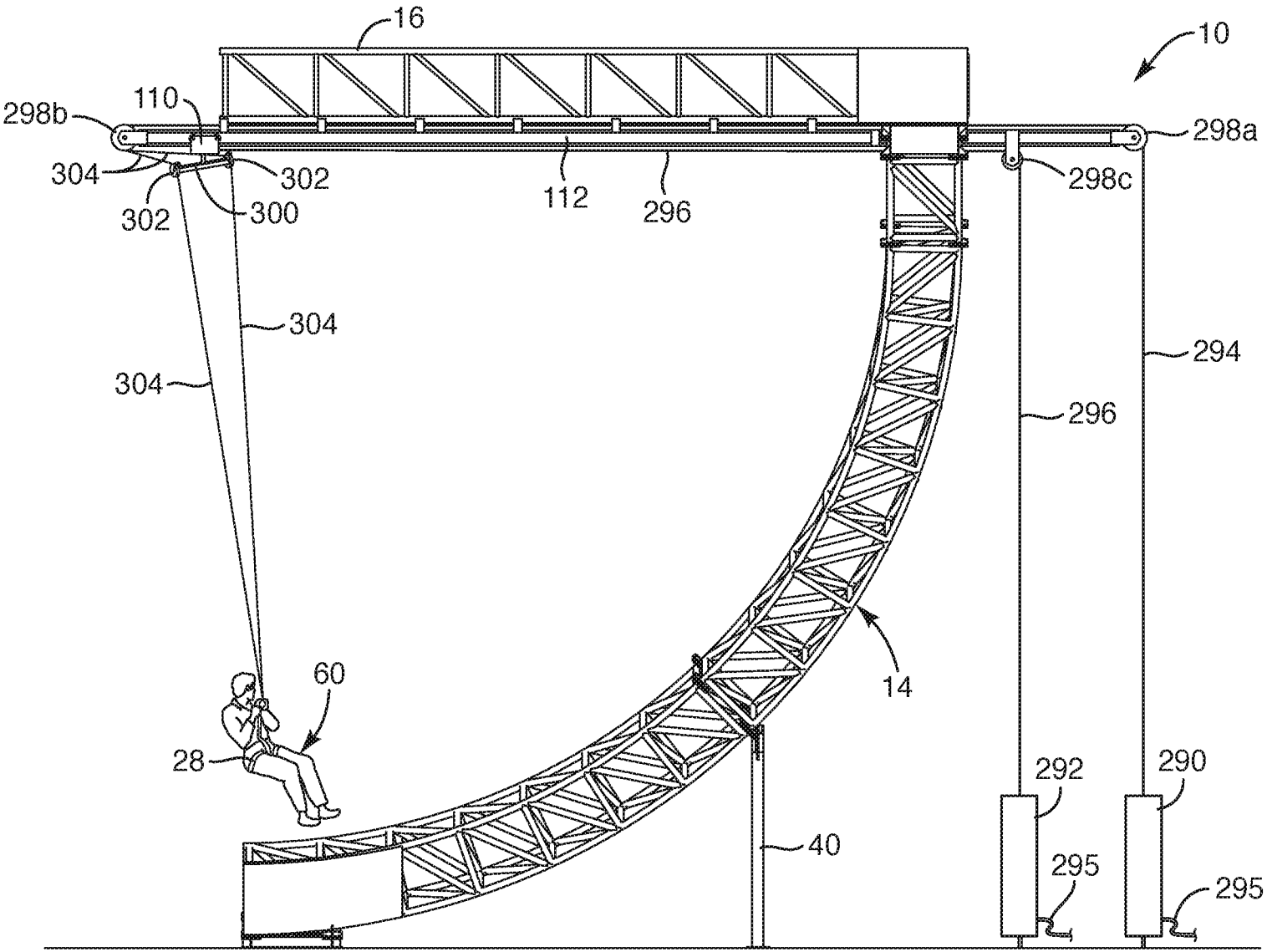
FIG. 46 is a side elevation view of an alternative embodiment of a frame, overhead beam, and multiple takeup systems for taking up both the belay lines on a climber and moving a spreader bar along the overhead beam in a front-anchored, full body harness.
Figure 47:
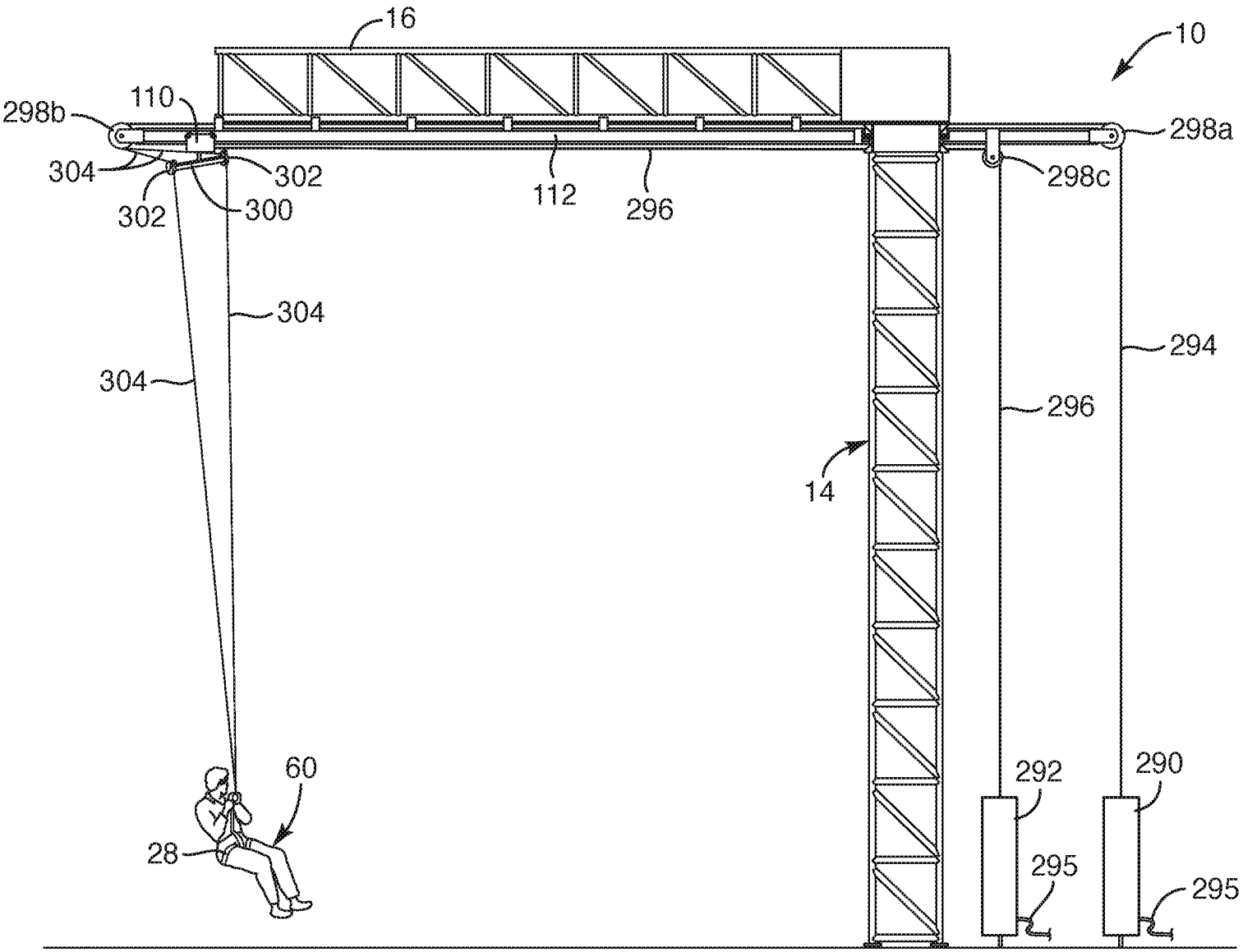
FIG. 47 is a side elevation view thereof suitable to retro fit onto any conventional, vertical climbing wall.

Referring to FIG. 46, one embodiment of a system 10 in accordance with the invention may include a frame 14 to support a wall 12 (removed here for clarity) on which a user 60 may climb and from which that user 60 may swing.

In general, a user 60 climbs the wall 12 by virtue of texture, holds 30, or other features on the wall 12 allowing the user 60 to maintain a grip by hand, foot, and usually both. In this embodiment, the trolley 110 travels along the rail 112 drawn toward the wall 12 by the trolley takeup 292 and urged away therefrom by weight of a user 60 on belay line 304.

Under the trolley 110, belay lines 304 may be a single line 294. For stability of path, the belay line 294 is best configured to split into dual belay lines 304. The path for the takeup lines 294, 304, 296 is over a series of pulleys 298 (e.g., 298*a*, 298*b*, 298*c*). In the illustrated embodiment, the belay line 294 moves from a takeup device 290, controlled by a controller 140*a* (FIG. 17) accessed by the wires 295, through a spreader 300*b* to take up slack in the lines 294, 304, and over pulleys 298*a* to run out parallel to the beam 16, and over twin pulleys 298*b*.

The double belay lines 304, a spreader bar 300 (yoke 300) maintain orientation of the user 60 rather than permitting a "precess" motion nor swinging side-to-side. The harness 28 is urged to swing perpendicular to a plane of the spreader bar 300. Pulleys 298*m* on each end of the trolley 110 accommodate each of the belay lines 304 individually.

The trolley takeup line 296 is taken up by a trolley takeup system 292, which may be programmatically controlled by a remote controller through connecting wires 295, thereby operating a motor, hydraulic pump, pistons, pulley blocks and the like as necessary in the takeup system 292. In general, the takeup devices 290, 292 may be "block-and-tackle" types of mechanisms with multiple pulleys and multiple reevings of the respective lines 294, 296 around individual pulleys 298 assembled as blocks 306 of pulleys 298 separated by a hydraulic ram to provide multiple lengths 306 of line 294, 296 taken up for length or distance of extension of the hydraulic ram.

Although the trolley 110 may be driven away from the frame 14 along the rail 112 toward the belay pulleys 298*b*, the weight of a user 60 suspended by the belay lines 304 passing over the end pulleys 298*m* will urge the trolley 110 away from the wall 12 as the climber 60 falls.

Figure 48:
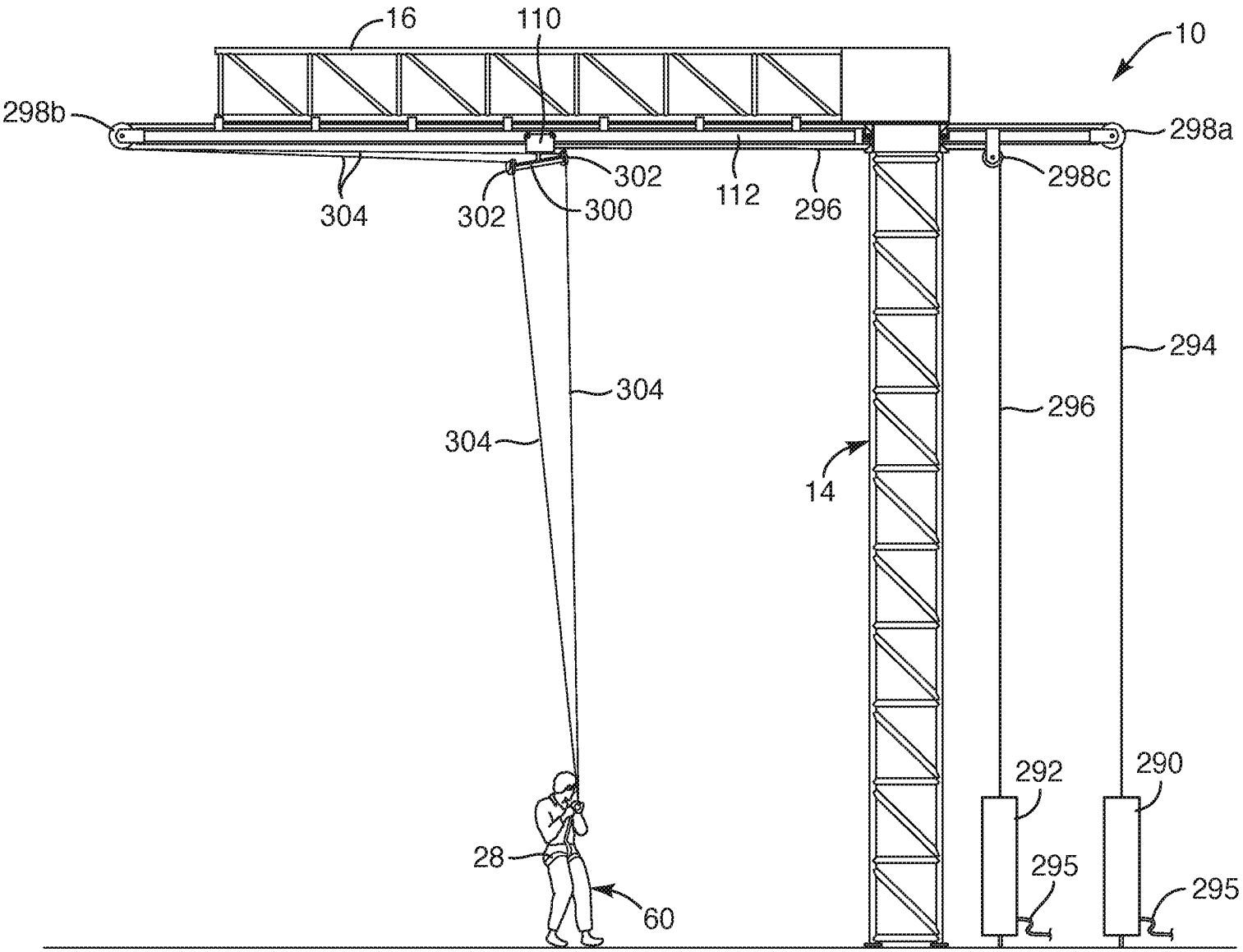
FIG. 48 is a side elevation view thereof with a user (climber) approaching the frame supporting the wall with an overhead trolley adjusting belay lines and a suspension point thereof at each end of a spreader bar suspended from the trolley.
Figure 49:
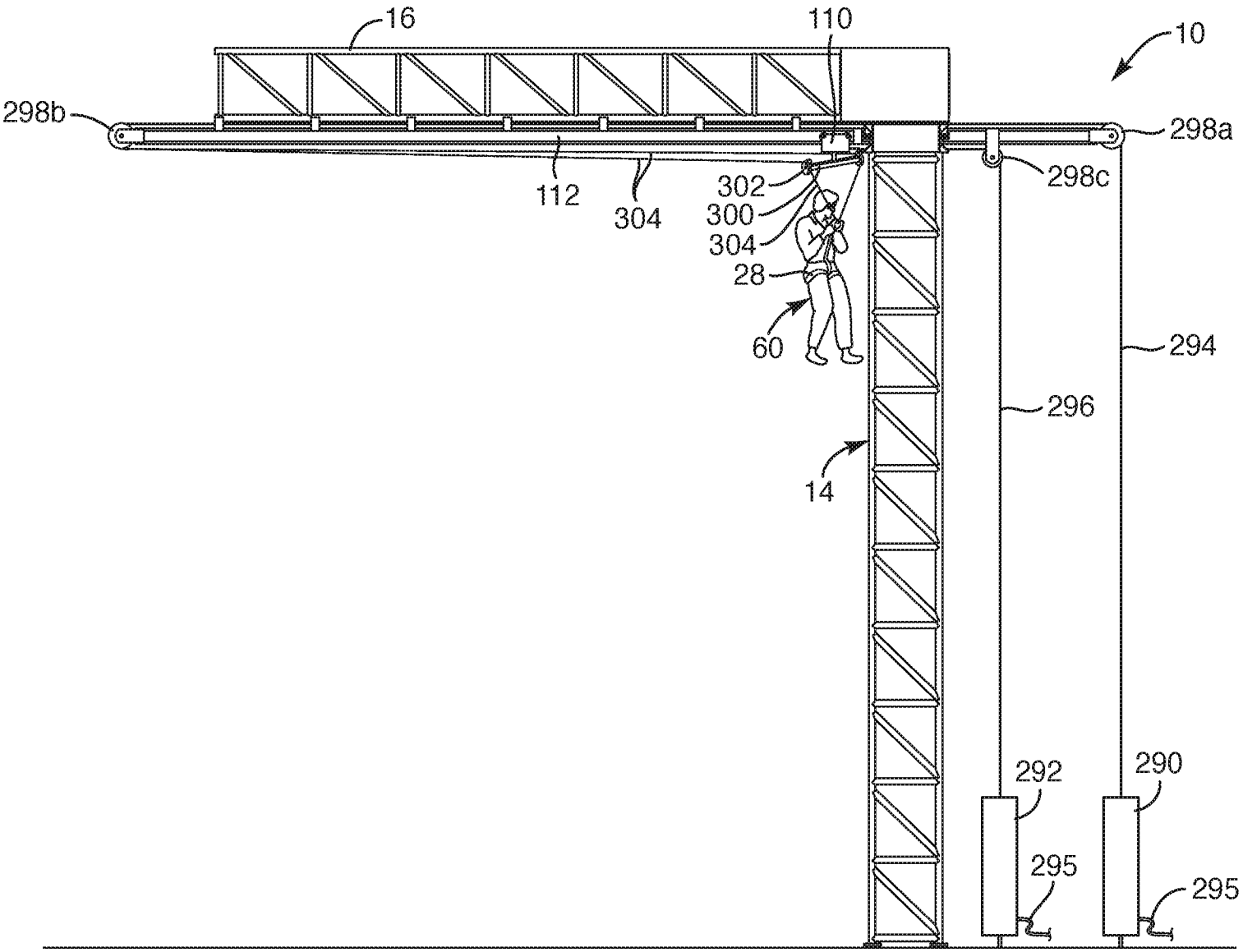
FIG. 49 is a side elevation view thereof illustrating a climber having ascended the wall supported by the tower, in a position to drop, release, fall or otherwise leave the wall and tower to swing away therefrom on the belay lines.
Figure 50:
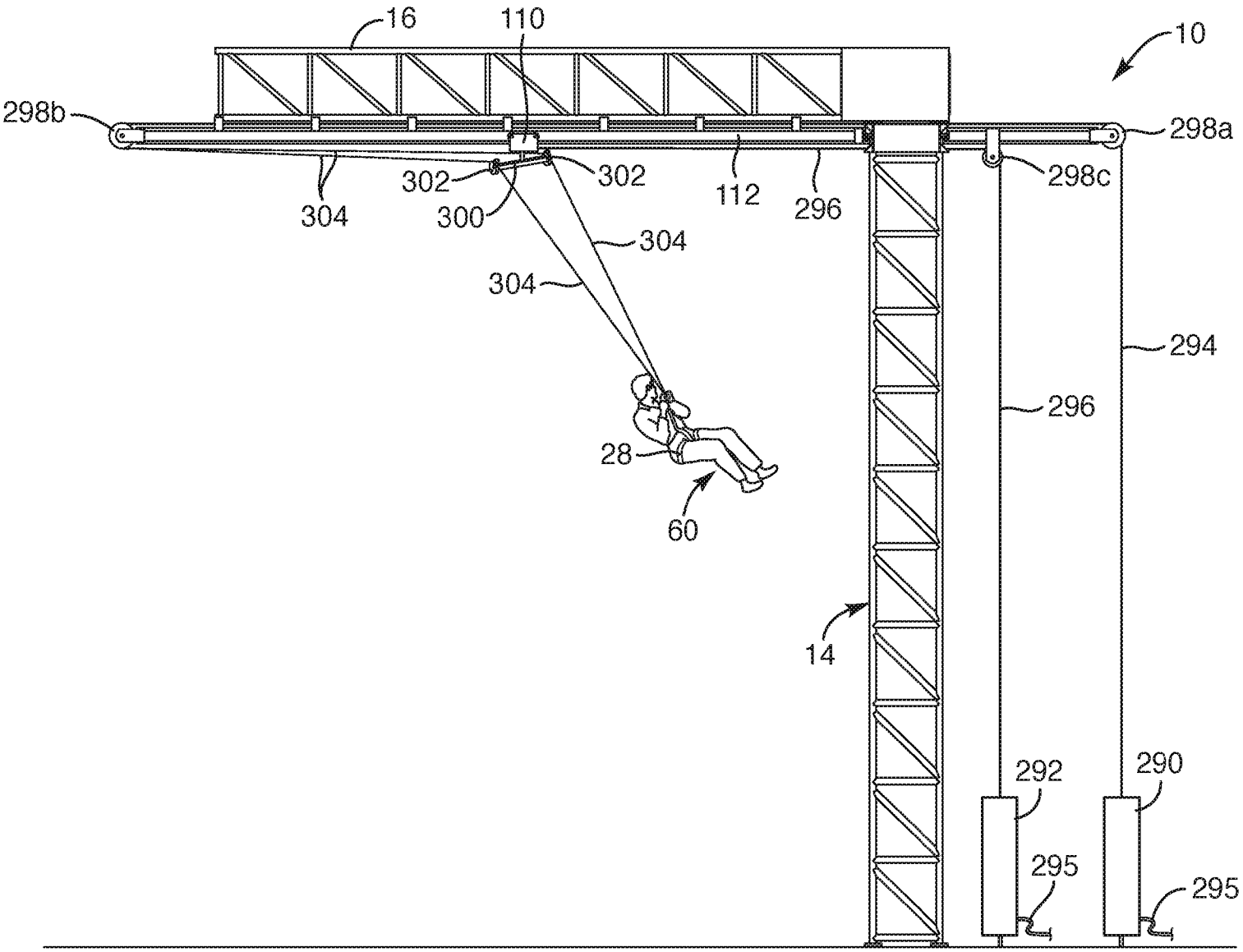
FIG. 50 is a side elevation view thereof with a climber having left the wall, swinging away therefrom, on the belay lines suspended from the spreader bar under the trolley, as the trolley moves away from the wall and its supporting tower or frame and toward the far or distal end of the overhead, lateral beam.
Figure 51:
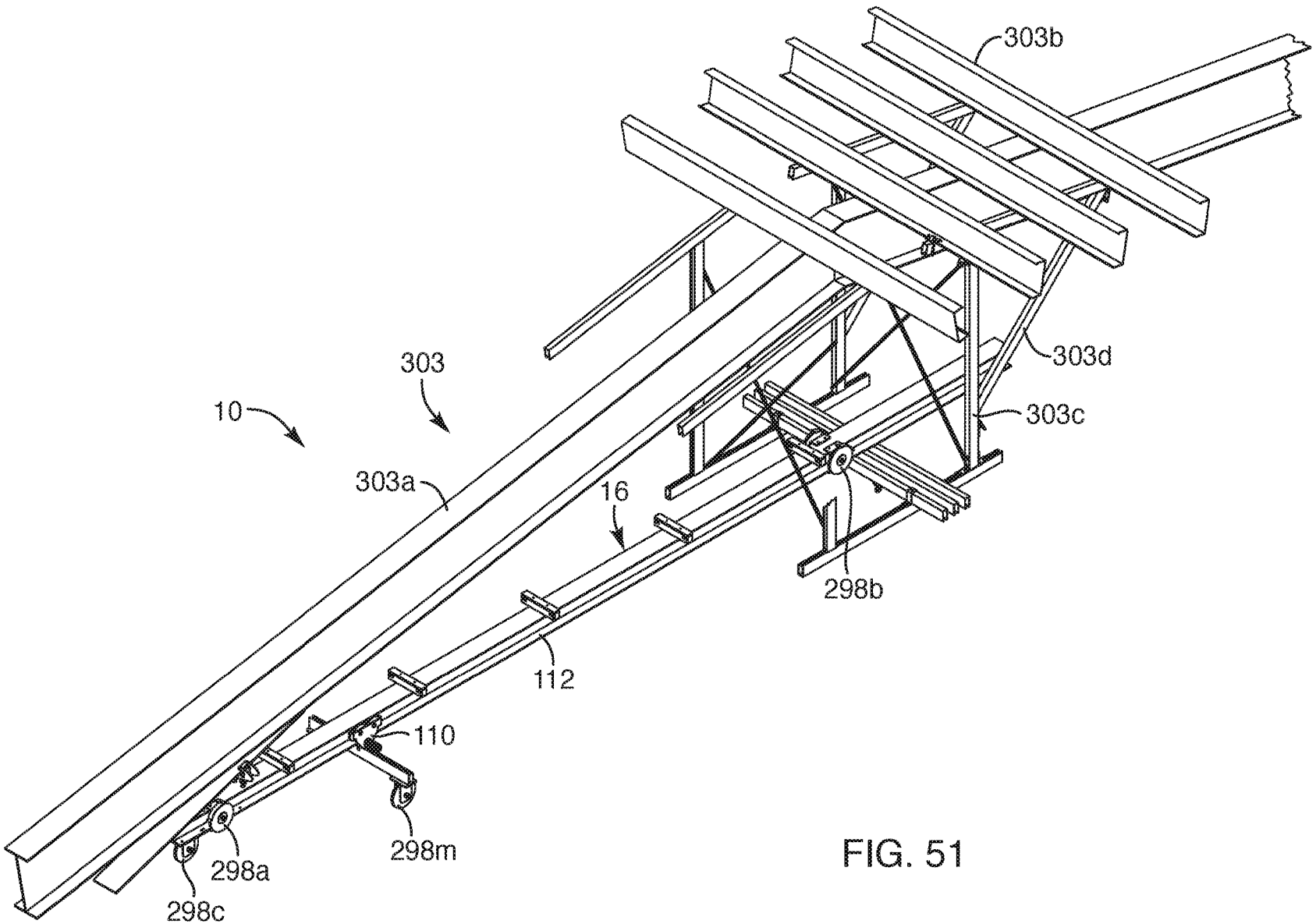
FIG. 51 is a perspective view of one embodiment of a track and trolley for a system in accordance with the invention.
Figure 52:
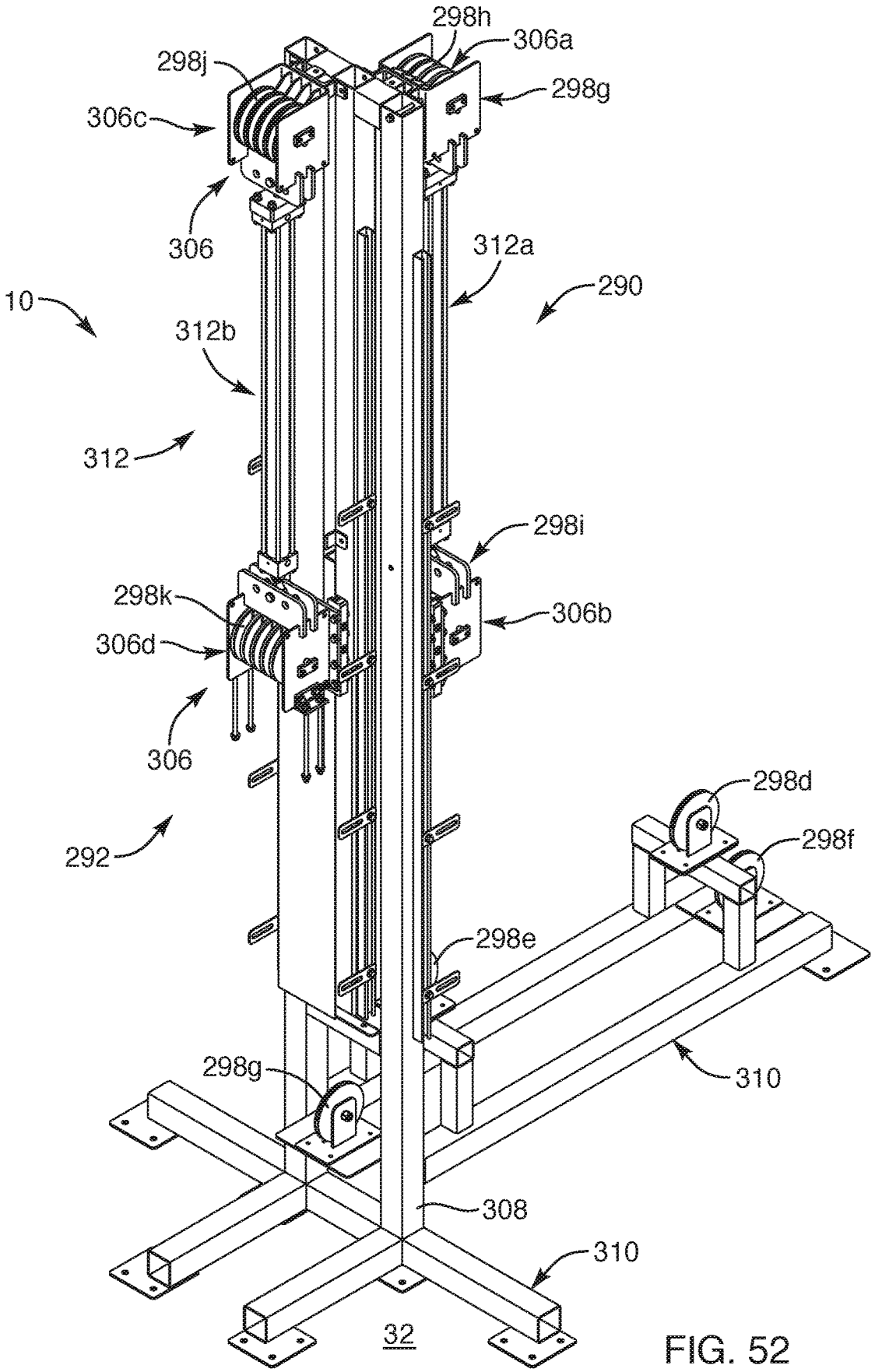
FIG. 52 is a perspective view of one embodiment of a cable hoist system for take up devices for a trolley and a belay line to a climber in accordance with the invention.

In operation, the systems of FIGS. 48 through 50 operate similarly. In general, a user 60 progresses along a wall 12 that may itself progress forward and upward along the shape of the frame 14. The trolley 110 may move forward, drawn by the trolley takeup system 292 and line 296 toward the intersection of the frame 14 and the rail 112, under its supporting beam 16. The belay lines 304 extend virtually vertically from the trolley 110 locked there or nearby until a fall is permitted. The belay takeup 290 is controlled to draw the line 294, and belay lines 304, taking in or letting out slack as needed as the climber 60 advances upward. If the wall 12 and frame 14 are vertical, the trolley 110 is locked "at" or near the frame 14-to-beam 16 junction during the entire climb.

When the climber 60 falls, leaps, or otherwise releases his or her grip on the wall 12 at the top, the trolley 110 may carry pulleys 298*m* slightly farther from the wall 12 and lock. Release of the trolley 110 to move freely away (left, in illustration) from the wall 12 and frame 14 may be manual or automatic, triggered by the climber 60, an operator, a timer, a limit switch, or other programmed controller. Once free to roll the trolley 110 responds to the force vector outward away from the frame 14 and along the rail 112.

The fall of the user 60 is not straight down, nor is it a pure swing. It is a swinging motion about a moving center of suspension 100 of the pulleys 298*m*, moving (left) with the trolley 110.

Referring to FIGS. 47 through 50, a system 10 may operate with a vertical wall 12 supported by a vertical frame 14, or retrofitted onto any wall 12.

A fall prior to completing the climb may result in a sensor 160 detecting the fall and the takeup system 290 lifting the user 60 to the top of the "route" (wall 12). This motion assures that the release of the trolley 110 and consequent swinging fall will always initiate in the same place. A non-climber may even be so lifted from a floor 44 or ground to swing this way.

The system 10 illustrated typically operates by a user 60 in a harness 28 connecting to the belay line 304 by the chest ring 192 through the linkages (e.g., 200, 210, 216, etc.) and components discussed in detail hereinabove.

The user 60 may or may not need to advance toward the wall 12 and frame 14. If so, the trolley 110 responds by the takeup 292 drawing the line 296 across the pulley 298*c* and the trolley 110 toward the frame 14. The belay takeup 290 may monitor and take up the belay lines 294, 304, but the takeups 290, 292 need not ever move simultaneously. The user 60 may be free to walk along the supporting surface toward the frame 14 and wall 12. Eventually, the trolley 110 arrives at the wall 12 at a close but suitably safe distance.

At this point, the trolley takeup 292 may be locked off or stopped because the trolley 110 will stay at that location as the climber 60 ascends, belayed by the takeup 290 taking up slack in the lines 294, 304.

At the top of a climb, the trolley 110 is fixed, and the belay lines 304 have been continually taken up. In this position, the climber 60 is safe, and cannot fall. The user 60 may thus approach the top of the climb, fall with the trolley 110 retreating, and move in the arc at the bottom dead center of the swinging motion. The user 60 is now accommodated in motion by control of the trolley 110 alone, moving outward from the wall along the rail 112. This lets out the belay lines 304, which are only later taken up as necessary.

Even if a climber 60 does fall, having not fully ascended, the system 290 may immediately draw the climber 60 upward at a modest (safe, comfortable) speed.

Upon triggering by a timer, user weight, fall detection, operator control, programmed computer control, or the like, the trolley 110 is released from its position close to the frame 14 with belay lines 304 stopped by the takeup 290. The trolley takeup 292 releases freely the line 296, thereby permitting the trolley 110 to move to the left. The speed of that movement may be controlled or left to be determined by momentum and energy transfer of the fall.

Consequently, as the user 60 falls, the belay takeup 290 holds fixed the lines 294, 304. The center of suspension 100 (the pulleys 298*m*) move left as the climber 60 falls downward and leftward toward and past the trolley 110 stopped at its extreme position, to swing tangent to, then into, a circular arc whose radius is the lines 304.

A person incapable, unwilling, or unable to climb may harness up and elevate by the lines 304 from the takeup 290 toward a trolley 110 stopped on the rail 112.

After elevating the user 60, the belay lines 294, 304 may halt, locked by the takeup 290. Upon release of the trolley 110, it retreats, the lines 304 pass over it supporting the fall, yielding a thrill ride with no climbing required.

Figure 53:
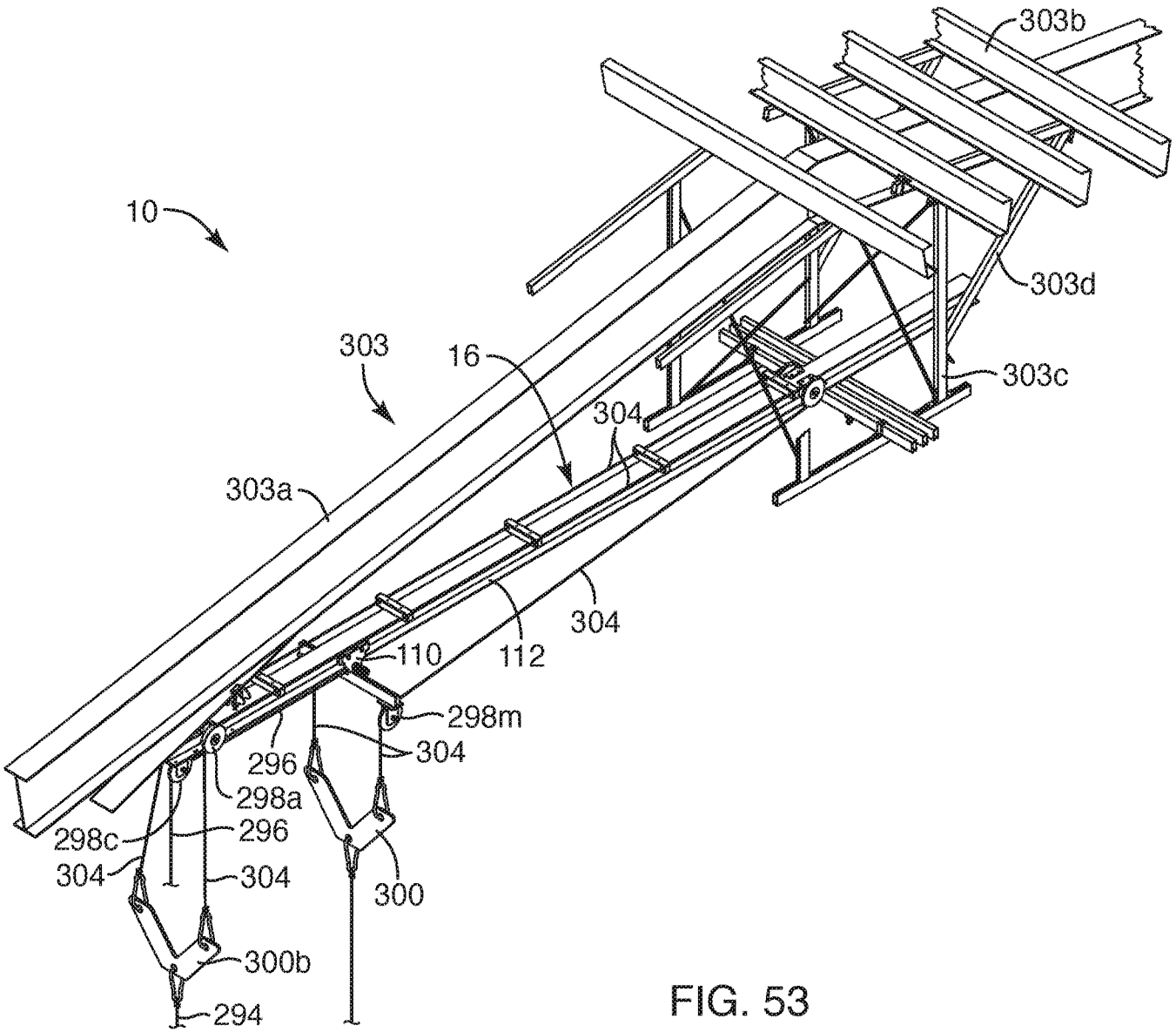
FIG. 53 is a perspective view of the track and trolley system of FIG. 51 threaded with the lines for trolley movement and belay.
Figure 54:
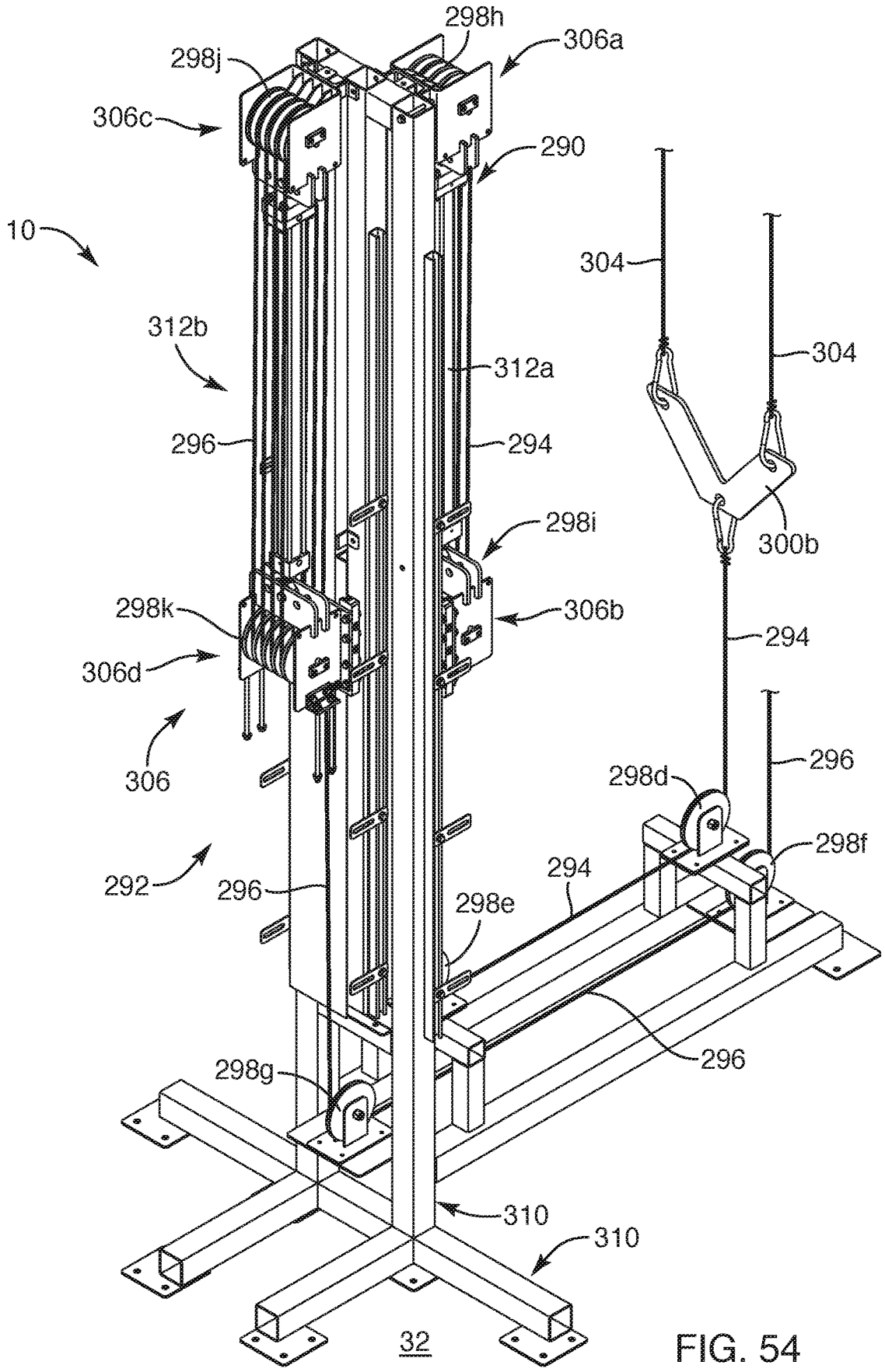
FIG. 54 is a perspective view of the takeup systems of FIG. 52 threaded with the takeup lines for belay and trolley movement.

Referring to FIGS. 53 through 54, a building 303 or other structure 303 may support a system 10. For example, a rail 16 may support or even be integrated with a track 112 secured to a super structure 303 with rafters 303*a*, purlins 303*b*, various supports 303*c*, and reinforcing struts 303*d*. The trolley 110 carrying sheaves 298*m* rolls along the track 112 drawn by the line 296 and urged away from the wall 12 by the weight of a user 60 suspended therefrom. The pulleys 298*a*, 298*m* guide the lines 304 from the spreader 300*b*, along the rail 112, back to the trolley 110, and down over the trolley 110, respectively.

The trolley 110 will respond to the force vector of the lines 304 passing over the pulleys 298*m* to urge the trolley 110 toward the pulleys 298*b*. On the other hand, the trolley 110 is restrained by the line 296 from the trolley takeup system 292, over the trolley control pulley 298*c*. The rate of travel of the trolley may be programmatically controlled or determined by acceleration of the trolley 110 and line 294 in response to the momentum of the climber 60.

Following each of the takeup lines 294, 296, 304 from their origins, structures are threaded with the lines 294, 296, and 304 drawn by of a takeup system 290, 292 may be implemented in a either reels, capstans, telescoping hydraulics, block and tackle, a combination or the like. In this particular illustrated embodiment, the takeup systems 290, 292 are a block-and-tackle type. For example, a block 306*a* or 306*c* (specific instance of any block 306) is fixed to a pillar 308 rising from an operating surface 32 supporting a base 310 providing mechanical stability and support. The fixed blocks 306*a*, 306*c* are fixed to the pillars 308.

The movable blocks 306*b*, 306*d* are movable vertically by hydraulics 312 to extend and retract the lines 294, 296, respectively. When the lines 294, 296 are threaded around the sets of pulleys 298*h*, 298*i*, 298*j*, and 298*k*, through the blocks 306*a*, 306*b* and 306*c*, 306*d*, respectively, a "leverage and distance multiplier" equal to the number of pulleys in each matched pair of blocks 306 results in the lines 294, 296.

Accounting for all of the pulleys 298, one will see that the pulley 298*a* is responsible to support a change in direction of the line 294 between the takeup system 290 of the belay and the pulley 298*b* at the end of the overhead beam 16 and rail 112 or track 112. Similarly, the top pulley 298*c* above the trolley takeup system 292 makes a turn in the line 296 to change from a vertical movement to a horizontal movement necessary to draw the trolley 100 across or along the track 112.

The beam 16 is illustrated as level. In some embodiments, it may be tilted slightly to favor movement "downhill" away from the wall 12. Thus, for example, a user 60 may climb the wall 12, belayed by the line 304 to the trolley 110 until some event ends the climb. At that point, the trolley 110 may release and travel away from the wall 12 sending the climber into a pendulum fall. Control of the speed of the trolley may be by a linear eddy current brake. Likewise, payout of the line 304 may be controlled by an eddy current brake on a reel on the trolley 110 or as a part of a takeup system 290, either of such being biased to wind the line 304 in and eddy-current-braked to pay the line 304 out.

In order to support those motions, a system of pulleys 298 includes a pulley 298*d* carrying the line 294 from the belay takeup system 290 through the pulleys 298*e* to eventually draw through the spreader 300*b* on the double lines 304. To arrive there, the line 294 must also pass through the pulley 298*e* which operates as a sheave 298*e* diverting the line 294 from a vertical direction to a horizontal direction, in order to pass under to the pulley 298*d*. The line 294 connects to the spreader bar 300*b*. The lines 304 connect to opposing ends of the spreader bar 300*b* connecting the double belay lines 304 to the takeup line 294.

By the same token, the pulleys (sheaves) 298*f* and 298*g* direct the trolley takeup line 296 from its original vertical displacement direction, from the sheaves 298*j*, to move horizontally out to, and under, the pulley 298*f*. Therefrom, it passes upward to the pulley 298*c* that will direct the line 296 to fix to the trolley 110 suspended under the track 112.

Backing up farther along the path of the belay takeup line 294 and the trolley takeup line 296, one will immediately note that each of these lines 292, 294 is threaded around its pulleys 298*h*, 298*i* and pulleys 298*j*, 298*k* in respective blocks 306*a*, 306*b*, 306*c*, and blocks 306*d*, respectively. Each block 306 holds multiple sheaves 298 or pulleys 298. For example, the upper block 306*a* of the belay takeup 290 includes multiple sheaves 298*h*. The line 294 or takeup line 294 is threaded around each of those upper sheaves 298*h* or pulleys 298*h* and the corresponding lower pulley 298*i*.

At the end or terminus of the line 294, the line 294 will be anchored to a fixed point. Thus, from a fixed point, the line 294 fastened thereat will pass down and up multiple times around corresponding pairs of pulleys 298*h*, 298*i*. Ultimately, on the last pass over an upper pulley 298*h* the line 294 will then pass down around the lower belay guide pulley 298*e*, and be redirected out to and below the guide pulley 298*e*, 298*g*.

Displacement of the lower block 306*b* away from the upper block 306*a*, takes up line 294. In either direction relative movement between the blocks 306*a*, 306*b*, and will greatly multiply displacement of the line 294 proceeding therefrom. For example, if the block 306*a* and the block 306*b* each carry five sheaves 298*h*, 298*i*, respectively, then a multiplier of ten times the relative displacement between the blocks 306*a*, 306*b* will result in the line 294.

In the same manner, the trolley take up 292 may also be provided with an upper block 306*c*, lower block 306*d*, carrying sheaves 298*j* or pulleys 298*j*, and 298*k*. The relative leverage or increase in relative motion between blocks 306*a*, 306*b*, 306*c*, and 306*d* may be designed according to the preferred ability to adjust that distance and the multiplication factor desired for operating the lines 294, 296.

The number of sheaves 298 between the blocks 306*a*, 306*b* need not be the same as that number for the blocks 306*c*, 306*d*. In the illustrated embodiment, those numbers are the same.

Similarly, it is preferable that the pulleys 298*e* be directly fed the line 294 directly from whichever of the sheaves 298*h* feeds lies most directly above it. Likewise, the sheave 298*g* is best positioned directly below the sheave 298*j* from which the line 294 is fed to that sheave 298*g*.

Thus, movement of a lower block 306*b*, 306*d* toward or away from its corresponding upper block 306*a*, 306*c* will result in a deployment (payout) or retrieval, respectively, of the corresponding line 294, 296. A suitable hydraulic system 312 may be secured to drive that relative motion.

In general, a block-and-tackle system relies on multiple pulleys 298, a line 294, 296, the line 294, 296 being fixed to a single immovable position at one end. The opposite end of that line 294, 296 extends to a free end responsible for some purpose.

For example, in a conventional block and tackle, operated by hand, a user draws on the free end of a line 294, 296, in order to obtain a leverage advantage in which proportionally more line must be taken up, in order to lift a load supported by the moving block 306*b*, 306*d*. That is, for example, in the illustrated configuration, the tremendous force available by hydraulic drives 312*a*, 312*b* applies force applied to the lower blocks 306*b*, 306*d*.

Thus, contrary to traditional block-and-tackle use, force applied between the blocks 306*a*, 306*b* and 306*c*, 306*d* in the take up is applied to the opposite end of the corresponding line 294, 296.

Alternative embodiments for the takeup systems 290, 292 need not be the same as each other. For example, a capstan may be driven by a motor or a motor on a transmission. Likewise, the takeup systems 290, 292 may each be operated as totally integrated takeup system. A motor may rewind a line 294, 296 onto a reel or capstan. An eddy current brake may resist during release of the collected line 294, 296 therein. In the illustrated embodiment, however, it has been found effective to use hydraulic systems 312*a*, 312*b* for compact powerful drives capable of releasing and retrieving the lines 294, 296 rapidly, in fact, as fast as a user 60 can transfer momentum enough to fall.

Figure 55:
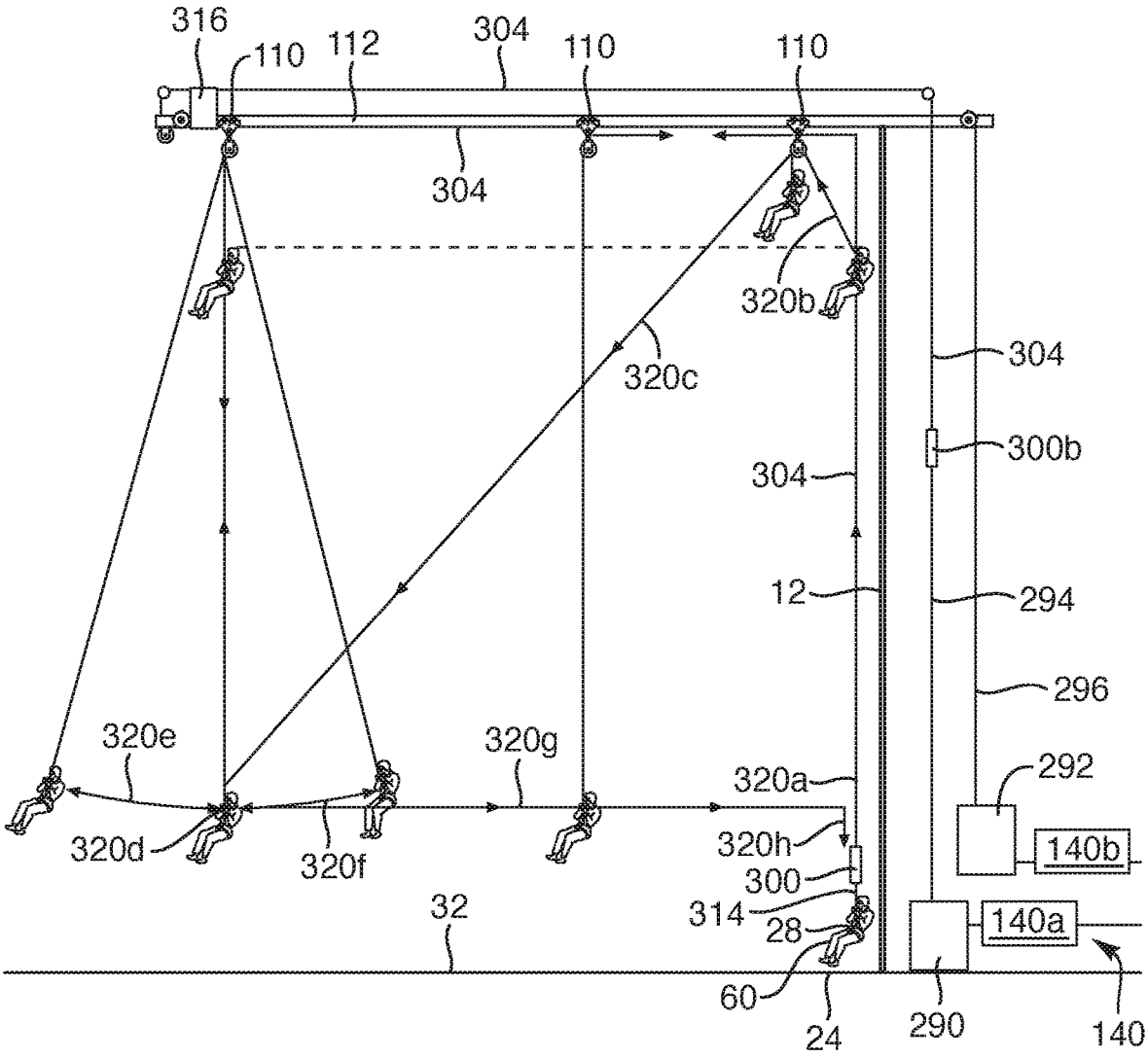
FIG. 55 is a schematic diagram of the user path in a system in accordance with the invention including a climb, a fall trajectory, swinging, and returning to the launch location.

Referring to FIG. 55, operation of a system 10 in accordance with the invention may rely on a climber 60 approaching a climbing wall 12 into a launch area 24. The climber 60 has previously donned a harness 28. That harness 28 is then clipped to a sling 314 interposed between the harness 28 of the climber 60 and the spreader 300 connected to the double lines 304.

A harnessed climber 60 or rider 60 may follow a path 320 in parts. The controller 140*a* for the belay takeup 290, and a controller 140*b* for the trolley takeup 292 may be programmed to provide multiple modes of operation. For example, during climbing, a climber 60 is belayed on the sling 314 under the spreader 300 connected to the lines 304 being taken up by the belay takeup system 290. Typically, programming the controller 140*a* will provide a slight tension (force of a few pounds or kilograms) in the lines 304. The force may be sensed by a typical sensor 160*a*, 160*b* against a line 294, 296, 304. Position may be sensed at a block 306*b*, 306*d*.

As the climber 60 scales the wall 12 along a path segment 320*a*, the lines 304 are taken up and maintained in a slight tension (sufficiently small to not cause discomfort or instability for a climber 60) by the belay takeup system 290. If, at any point, the climber 60 falls from the wall 12, the belay lines 304 have already been taken up slack. They will simply maintain their position by control exerted by the controller 140*a* controlling the belay takeup 290.

Meanwhile, if the climber 60 does not fall, then the climber 60 may continue to ascend the wall 12 to eventually approach the trolley 110 overhead above the climber 60. A climber 60 will ultimately execute one of several actions. First, the climber 60 may reach the top end of a wall 12, in close proximity to the trolley 110.

A second possible consequence is that the climber 60 may ascend to the top of the wall 12 and strike a button or other sensor that tells the controllers 140*a*, 140*b* that the climber 60 has completed the climb. A third possibility is that the climber 60 may stall. A climber 60 may become tired. One 60 may reach an altitude at which certain of the climbing holds 30 on the wall 12 are no longer accessible or navigable for the skill level of that climber 60. By whatever cause, the climber 60 effectively stalls out short of achieving a target location near the top of the wall 12.

As mentioned hereinabove, the climber 60 may slip and fall from the wall 12. Even if a climber 60 is making steady progress or unsteady progress upward along the wall 12, a predetermined time limit may be required to be met. Thus, a system 10 may simply time out. The controller system 140, meaning either or both of the controllers 140*a*, 140*b*, may be informed of that fact by sensors 160, including clocks 160, thus proceeding independently from others' intentions.

By any of the foregoing termination modes, a climber 60 may be drawn along a path 320*b* by operation of the belay takeup 290 retrieving in the lines 294, 304, the trolley 110 retreating slightly, or both, to some predetermined distance or position. At this point, the belay lines 294, 304 will remain fixed at their lengths, while the controller 140*b* of the trolley takeup system 292 will release the line 296 at a predetermined rate as determined suitable, as will be discussed hereinbelow.

Accordingly, the trolley 110 is effectively free to traverse along the track 112 away from the wall 12. The trolley 100 may even effectively free wheel at whatever speed the weight of the climber 60 may dictate. In certain embodiments, the controller 140*b* may programmatically limit the speed at which the trolley 110 retreats away from the wall 12. A technical analysis may determine an appropriate limit to the speed of the fall of the climber 60 along the path 320*c*. The fall path 320*c* may thus be carefully controlled, programmatically controlled along a certain trajectory, or may simply be dictated by free fall of the climber 60 at whatever speed the lines 304 may pass over the trolley 110 or its pulleys 302 as the climber 60 falls.

A tangent point 320*d* is a point 320*d* at which the trajectory 320*c* of a climber's fall intersects with a tangent of a path 320*e* of swing 320*e*. For example, in certain previously discussed embodiments, the entire path 320*c* may be a swinging pendulum fall 320*c*. In this embodiment, it is not.

One will note that the tangent point 320*d* may represent a comparatively abrupt change in direction. Swinging along the forward path 320*e* or the backward path 320*f* with respect to the trolley 110 directly thereabove is driven by the fall of the climber 60 and the release of the trolley 110 by the trolley takeup system 292. That path pair 320*e*, 320*f* forms a simple arc at a radius determined by the lines 304.

In the illustrated embodiment, the fall path 320*c* is neither directly vertical nor completely semicircular. Rather, the path 320*c* is something in between. Accordingly, a change in direction must occur as the fall path 320*c* intersects the swing path 320*e* at a tangent point 320*d*. The tangent point 320*d* is a point 320*d* at which a tangent from the arc 320*e* will intersect the fall path 320*c*.

Thus, the belay takeup system 290 and its controller 140*a* may be programmed to assure programmatically that a climber 60 swinging along the paths 320*e*, 320*f* will not strike the wall 12, an obstruction, or the underlying surface 32. This will typically be a direct result of the distance that the trolley 110 moves from its position closest to the wall 12 and its position farthest therefrom.

Back to the issue of the change in direction, the abruptness may be solved or remediated programmatically by control of the trolley 110 through the trolley takeup system 292. Alternatively, or in addition, programmatic controls may release or pay out the line 294 by the belay takeup system 290. Other absorption mechanisms may include, for example, a spring mechanism 316 or attenuator 316 of another type.

The trolley 110 may abut or impact directly against an attenuator 316 positioned at its end-of-stroke position. An attenuator 316 may be one of several varieties. For example, a hydraulic damper, a spring, a complex system of springs of engineered stiffness may be installed. Such may ensure that the trolley 110 is free to move horizontally against a spring 316 resistance, thereby releasing a certain additional length of the belay lines 304. This results in a vertical spring effect on the climber 60.

In some embodiments, the harness 28 or sling 314 may produce certain spring effects. An elasticity of "dynamic line" or the like may permit a reduction of shock by extending the time during which forces are remediated on the climber 60. Typically, discomfort results if more than three "g's" of acceleration (deceleration) occur (3×gravitational acceleration).

Thus, the speed of the trolley 110 may be moderated by the trolley takeup 292. Payout of the belay lines 304 may be moderated by the belay takeup system 290 may occur instead or in addition. Alternatively or in addition, some type of an attenuator 316 may simply take up the load elastically, with or without some amount of damping. Something as simple as a spring 316, against which the trolley 110 may strike and bounce, may provide sufficient remediation of the impact forces caused by the change of direction between the fall path 320*c* and the swing path 320*e*.

Again, multiple attenuators 316 or springs 316 may actually be applied. These may include on or within the sling 314, in the harness 28, in one or more of the yokes 300, 300*b*, in the trolley 110, at a distal end (away from the wall, proximal) of the track 112 carrying the trolley 110 (carrier 110), in the lines 304, or a takeup 290, 292, or elsewhere. Elastic extension under load as a relief may be placed in the actual path (e.g., load path) from the climber to the takeup 290, 292, or may be in some pulley 298, its mount, or the like along that path.

Swinging along the paths 320*e* forward and 320*f* backward may be permitted for some predetermined period of time. Thereafter, the trolley 110 may be moved toward the wall 12 and the initial launch deck 24 or launch location 24 near the wall 12. However, how to attenuate this swing, and particularly the back swing 320*f*, so as not to permit the climber 60 to strike the wall 12 upon approach, deserves some attention. One way to quickly dampen any swinging motion by the climber 60 from the trolley 110 is to move the trolley 110 toward the wall 12 during the back swing path 320*f*.

For example, the trolley 110 may remain fixed for some number of oscillations of the climber 60 along the paths 320*e*, 320*f*. After a predetermined time, the trolley 110 may move toward the wall 12 in coordination with travel along the path 320*f* in a few (2-5) such strokes.

Accordingly, the climber 60 will rise, not remain at the same minimum height as during the remainder of the swing. The trolley 110 moving toward the wall 12 may be compensated by adding additional line 304 or length of the lines 304 in order to maintain the climber 60 at the same elevation relative to the surface 32. Thus, force or momentum necessary for oscillation is not reintroduced to the climber 60 (e.g., not recovered from the potential energy of altitude) as a result of the angle made by the lines 304 with respect to the rail 112.

The trolley 110 moving toward the wall 12 while additional line 304 is fed out, at the proper time and position will basically remove the force that would impart momentum. This leaves a climber 60 without the momentum or force that would otherwise move the climber 60 toward the path 320*e*.

Ultimately, the trolley 110 will typically move along the path 320*g*, carrying the rider 60 parallel to the surface 32 and toward the original launch position 24. Upon arrival close to the wall 12, the belay controller 140*a* may programmatically pay out the line 294 and lines 304 in order to lower the climber 60 to the surface 32 along the path 320*h*.

Upon stably standing upon the surface 32, the climber 60 or an attendant may secure the sling 314 to a ground tether. Then one may unclip or be unclipped from the sling 314 below the spreader 300. The climber 60 may then move to an area where the harness 28 may be removed. Accordingly, when safe to do so, another climber 60 may approach the wall 12, retrieve the sling 314, and clip in below the spreader 300 under the double lines 304.

The climber 60 or an operating attendant may clip the sling 314 to a ground anchor, a loop on the wall 12 or an eye bolt secured in the surface 32, or the like. Alternatively, the belay takeup system 290 may be programmed to pause awaiting an instruction. Such may be done through activation by a button that a climber 60 or attendant strikes when properly harnessed 28 and connected to the sling 314. At that point the climber 60 is safe to be belayed with the modest but undirected take up force required for such a belay.

Figure 56:
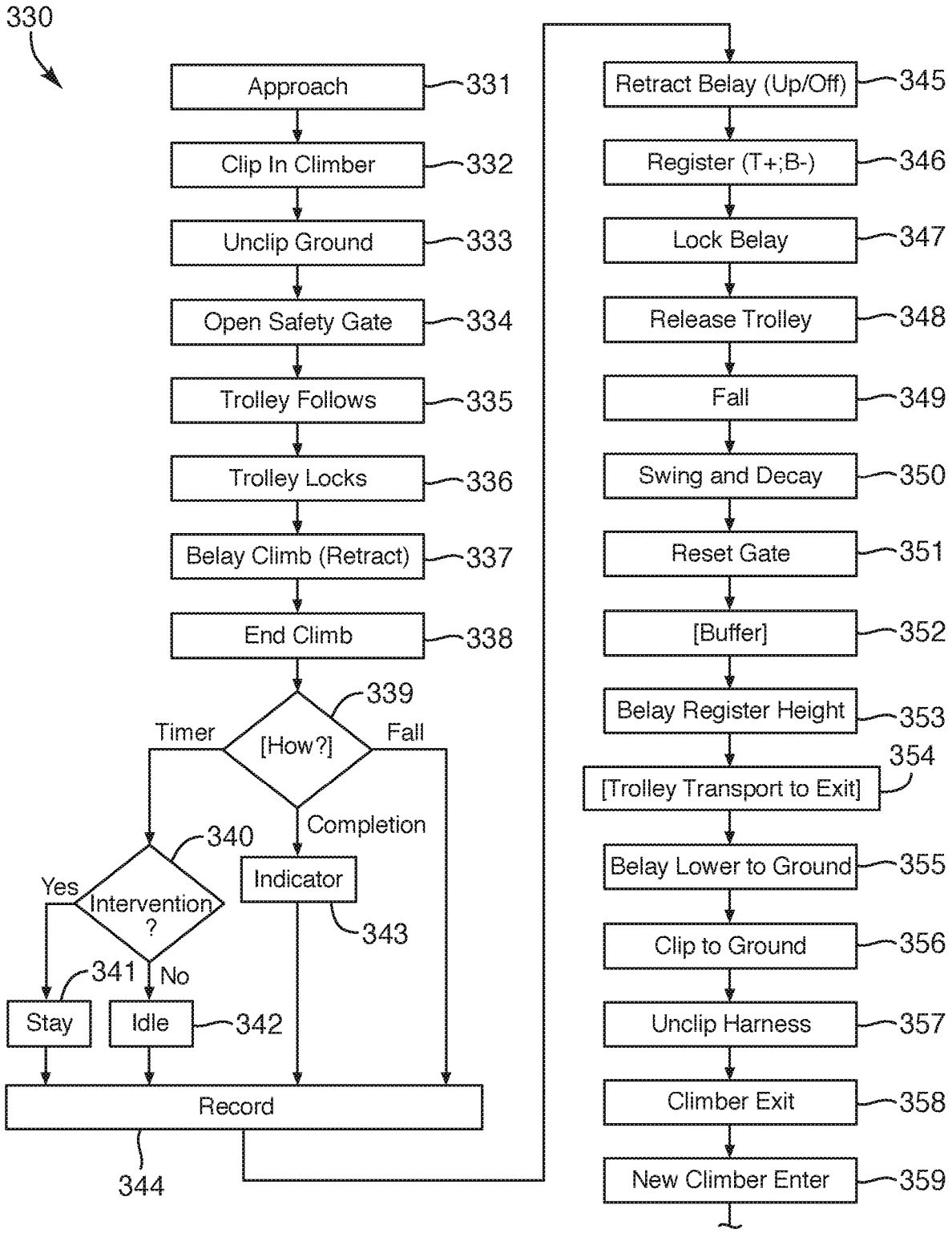
FIG. 56 is a schematic block diagram of one embodiment of a process for operating a system in accordance with the invention.

Referring to FIG. 56, while continuing to refer generally to FIGS. 1 through 57, a process 330 in accordance with the invention may begin with an approach 331 by a first climber 60 walking to a starting position 24 such as the launch deck 24. A user 60 may clip in 332 or an attending assistant may clip in 332 a climber 60 wearing a harness 28.

Typically, a sling 314 configured to clip in by a carabiner, for example, to a harness 28 of a climber 60 may be secured to a ground or a ground tether. A ground tether assures that the sling 314 not rise freely due to the upward bias maintained by the belay retrieval system 290. It is a good practice to clip in 332 a climber 60, or more properly to clip 332 the harness 28 of a climber 60 to the sling 314 before unclipping 333 from the ground tether. Then, one may unclip 333 the ground tether from the sling 314. In this way, a mishandling of the sling 314 with its carabiner or other connection mechanism will not result in the lines 304 and the sling 314 rising out of reach to a level difficult to retrieve.

A safety gate 73 may require opening 334 to actually approach 331, and the trolley 110 may follow 335 or be fixed there. For example, in one embodiment, the trolley 110 may be provided with a sensor 160 that detects force applied by a user 60 on the lines 304, thereby engaging the trolley controller 140*b* to move the trolley 110 toward the wall 12, while also enabling or controlling the belay controller 140*a* to let out more of the lines 294, 304 in order to accommodate the horizontal distance that the trolley 110 must move. That is, as a trolley 110 moves toward the wall 12, it will necessarily require an additional payout of the lines 304 in order to maintain the vertical position of a climber 60.

When a climber 60 is ready to climb, either by manual indication of an attendant pushing a button or simply by detection of sensors 160 in the system. Sensors 160 may respond to loading or relaxing load on the sling 314 (and necessarily the lines 304 and the line 294). Before the climber 60 is climbing, and the trolley 110 needs to be locked 336 in place. In this way, the belay takeup system 290 acts truly for belay, retracting 337 with a slight bias force, selected for comfort and safety, always applied to the lines 294, 304, 314 during a climb.

Ultimately, the climb will end 338. Ending 338 may occur by any of several mechanisms discussed hereinabove. Meanwhile, a test 339 may determine exactly how a climb is ended 338. For example, if a climber 60 falls, then the belay takeup system 290 simply ceases movement and the climber 60 is suspended by the lines 304 secured to the sling 314. At that point, the climb is over and the climber 60 is suspended by the belay lines 304. If on the other hand, a climber 60 reached the maximum permitted height near the top end of the wall 12, then the climber 60 may touch a bar, button, panel, or other actuator that will indicate 343 that the climber 60 has finished, timed out, or detected the force of a fall.

A timer may detect that a climber's time allocated for the climb has expired. In this case, a test 340 for intervention may be manual or automatic. Typically, if an attendant sees that a climber 60 has stalled 341, then intervention will be appropriate. On the other hand, if a climber 60 has reached the top of the wall 12 and has not indicated 343 completion by touching an actuator exactly what the condition of the climber 60 is, then an idle 342 or idling condition 342 may exist.

A stall 341 may be a result of a climber 60 becoming too tired. Also, the climbing holds 30 may become too far apart, too small, or otherwise inaccessible or unusable by the climber 60. Recording 344 the reason for the end 338 may be a principal reason or the only reason for distinguishing how the climb ended 338.

One reason for this is that of a process 330 in accordance with the invention may retract 345 the belay lines 304 regardless of the how 339 or test 339 for the end 338 of the climb. In other words, it may be of only temporary interest to an operator to know exactly why a climb has ended 338.

Ultimately, regardless of how 339 a climb ended 338, the belay lines 304 will typically be retracted 345 by the belay takeup system 290. The sling 314 and the spreader 300, as well as the harness 28 of a climber 60 will have a basically fixed spatial relationship with one another. Accordingly, they may all be registered by the retraction 345 of the lines 304 by the takeup system 290.

For example, typically, the trolley 110 will be moved away from the wall 12, thus adding to displacement of the trolley line 296. That line 296 will typically be extended while the belay lines 304 will correspondingly be retracted over the trolley, requiring movement of the takeup system 290 to take up the lines 304 passing over and down below the trolley 110 in response to its movement. This will register 346 (position at a known location) the user 60, harness 28, sling 314, and spreader 300 away from the wall 12 and usually above the termination of the climb.

The belay takeup 290 is locked 347, the path 320*b* having been completed. Now, the climber 60 may fall 349 safely (no risk of contact with the wall 12 or holds 30) upon release 348 of the trolley 110 (line 296) to move along the track 112 away from the wall 12. The overshoot 350 or swinging 350 of the climber 60 at the end of a locked 347 belay line 304 will convert the path 320*c* into the arc 320*e* and back 320*f*. The swinging 350 may be ended if a few (2-5) pulses of retracting 337 the trolley takeup line 296 during path 320*f*.

Opening 334 the safety gate 73 may reset 351 the gate.

Buffering 352 may reduce pendulum swinging of the paths 320*e*, 320*f*. Comparatively long or short times are considered in terms of throughput cycles of thrill rides rather than arbitrarily in the "eye of the beholder." Short may be anything less than 20 seconds (e.g., 5, 10, 15) and long may be over that, to half a minute or even a minute.

The swinging 350 may actually be affirmatively dampened 352 or buffered 352 by moving the trolley 110 toward the wall 12 during the path 320*f*, moving the pivot point 100 and return force needed to transfer momentum to the climber 60 swinging along the path 320*f*. This also takes up the belay lines 304. Thus, a controller 140, such as either one or both of the controllers 140*a*, 140*b* may operate to control the trolley 110 to move in an opposite direction from the harness 28 containing a climber 60.

This has the effect of robbing the potential energy needed for momentum to reciprocate its direction. That is, if a pivot point 100 created or defined by the trolley 110 is moved, then potential energy may be reduced. Typically, this will be done by moving the trolley 110 toward the wall 12, while advancing or paying out the lines 304 to keep a climber 60 at the same or a lower altitude then otherwise reached by swinging 350.

Eventually, even when the swinging 350 has diminished or decayed sufficiently without intervention, the belay takeup 290 may be controlled by the controller 140*a* to register 353 the user 60 at a preselected height. The trolley 110 may separately or simultaneously move toward the wall 12. Eventually a user 60 is transported 354 back to a position 24 close to the wall 12, to be lowered 355 to the ground to properly ground tie or clip 356 to the ground tether.

The transport step 354 should occur at a level to assure that a climber 60 will clear any persons or other obstructions on the ground surface 32. Thus, the accidental presence of people in dangerous locations may be reduced to a non-issue. Accordingly, transport 354 will typically involve carrying a climber 60 along the path 320*g* toward the wall 12. Maintaining a level height is not required, as it will necessitate retraction of the trolley 110 retrieval line 296, with simultaneous payout of the belay lines 294, 304.

Once the trolley 110 comes to a stop near the wall 12 at the launch deck 24, the belay takeup 290 may pay out the belay line 294 to lower 355 the climber 60 to the surface 32 where the ground tie may be clipped 356 to the sling 314 and any connectors (carabiners) thereon, before the harness 28 is unclipped 357 from that sling 314.

The climber 60 will typically exit 358 the area 24 and remove the harness 28 someplace remote. In this way, favoring better throughput, a second climber 60 may now enter 359 and approach 331 a launch deck 24, being fully harnessed previously, and clip in 332 to the sling 314 beginning the process 330 again.

Referring to FIG. 57, a system 10 in accordance with the invention may be illustrated in a schematic block diagram. For example, a climbing space 361 may be adjacent to and may overlap a swing space 362, above an approach space 360 over an underlying support 363. A preparation space 364 may be remote or part of the approach space 360 closer to the wall 12 and other climbing structures 365 such as a frame 14 of any variety supporting or supported by the overhead structure 366.

Installed inside a building or the like each may be supported by building structures 303 instead, supporting therebelow both a trolley support 367 (e.g., track 112) of some type, and various supports 368 for the belay system 290 and belay lines 304.

Typically, the belay supports 368 are operably connected to the belay drive 369 including the belay takeup system 290, any associated bracketing, pulleys, and the like. A controller 140 may control the belay drive 369 and the trolley drive 371, each drawing lines 294, 296, respectively, passing over belay supports 368 and the trolley supports 367.

One value of the diagram is to understand that each of the spaces 360, 361, 362, 364 may be engineered to accommodate the actual trajectory or path 320 of a climber 60 both while climbing and while swinging. Accordingly, the relative proportions and shapes of the spaces 360, 361, 362, 364 may be engineered to preclude interference between people accidentally in an approach space 360 during swinging 350 in the swing space 362.

The belay drive 290 and trolley drive 292, controlled by the controller 140, position the climber 60 at a specific position with only certain degrees of freedom of motion for the protection of the climbers 60. Accordingly, various braking systems may include friction, eddy current braking, spring systems, dampers, hydraulic dampers, pneumatic dampers, fluid drag, buffering and so forth. Similarly, the overhead structure 366 may be part of a building, freestanding, or supported by the climbing structure 365.

Control modes available may include computerized, programmatic control of appropriate components, such as the takeup systems 290, 292 controlling the belay lines 304 and the trolley 110 on its retrieval line 296. Position, speed in any direction, and acceleration at some rate toward some target speed may all be programmatically controlled to limit forces and accelerations to suitable levels.

Typically, a user 60 is comfortable at anything less than 2.5 g's (where g is the acceleration of gravity), and uncomfortable above 3.5 g's. Some thrill seekers tolerate more. Anecdotally, pilots in extreme circumstances have been documented to have endured, and their airplanes have survived, about 9 g's.

Thus, in a system in accordance with the invention, the controller 140, including one or more of the controllers 140*a*, 140*b* (or controllers 180, 370, 369, 371) may be processor controlled to maintain loads (forces) felt by a climber 60 within comfortable limits. This is probably most evident at the tangent point 320*d* discussed hereinabove.

Alternatively, the rate of release of the line 294 by the takeup system 290 may be manually or programmatically controlled to control the rate of travel by a user 60 during the fall path 320*c*. An operator can manually control or adjust a hydraulic valve to perform this control of the fall 349 of a user along the path 320*c*. Testing with dead weights may also aid manual adjustment of timing of movements of components such as the lines 294, 296 by the takeup systems 290, 292. This may be done by adjusting valves controlling movement (e.g., position, direction, speed, acceleration, etc.) of the hydraulic cylinders 312*a*, 312*b* in the hydraulic system 312, or whatever motive device is used to pay out and take up the lines 294, 296.

In that regard, development and testing of various embodiments of systems 10 indicate, if not militate, that the takeup devices 290, 292 be controlled, preferably in both directions. For example, if hydraulic cylinders 314*a*, 314*b* are used, pressure should be maintained on both sides of the double-acting pistons therein. Positions should be maintained by valves controlling input and exit of hydraulic fluid (typically oil).

Oil on both sides of the piston head should be under pressure sufficient to maintain a background pressure. Controls may then change relative pressures to move the pistons. This may be done by providing an accumulator tank (e.g. back-pressurizing tank or bladder tank) to provide an instant supply of pressurized hydraulic fluid. An accumulator with a valve to bleed off excess oil in it has been found effective.

For example, even supposed "incompressible liquids" like oil will compress somewhat, although much less than gases by orders of magnitude. Perhaps most significantly, "non-condensable gases" like air (nitrogen and oxygen) were found to condense or absorb comparatively slowly into hydraulic fluid over a period of hours or days. The result was gases boiling out of solution when pressure was relieved. Relieving pressure completely, or even significantly below operating pressures, resulted in gases coming out of solution in seconds or less, and not readily returning into solution. Volatile organic compounds from the oil may also evaporate comparatively quickly and condense more slowly. This effect by gases was found to cause the fluid against the hydraulic pistons in the rams 314*a*, 314*b* to be "spongey" or "springy" and making control difficult and sloppy (having poor tolerances for control). Thus pressures suitable to controlling precisely the movement of the pistons were maintained.

In certain embodiments, a system 10 in accordance with the invention may be controlled by stepping through the sequence of FIG. 56 in time. A set time for a climb may be input into a controller 140, 370. A start time and duration time may be input independently. Once triggered to start, the controller 140, 370 or the like may move through that sequence unattended. In some embodiments, an attendant may simply need to assure that harnesses 28 are properly worn, closed, and connected to the sling 314.

By sling 314 is meant any suitable and safe connection approved for connecting the harness 28 to the spreader 300. This is typically a webbing loop, known as a sling 314. Double lines 304 resist spinning by a climber 60 when swinging 350. The lines 304 will complicate connection if directly connected to a harness 28. Meanwhile forces are significant, requiring metal or stiff and strong composite materials for the spreader 300, 300*b*. If the spreader is steel or other hard material lacking padding, a sling 314 is effective to keep the spreader 314 away from a face or head of a climber.

This sling 314 may include a carabiner, typically a locking type, or more than one. It may include a loop of safety webbing (typically called a sling in climbing parlance between a pair of carabiners. It may be a "quick draw" (a pair of carabiners connected by a short, looped segment of webbing sewn together in the middle). Such would typically not have locking carabiners and would therefore not usually be used for a known falling situation that may change orientation of a climber 60 in any of six degrees of freedom (three in linear translation and three in rotation).

In some embodiments, a climber may be clipped in 332 at the back of a harness. However, such harnesses not consistent with Applicant's invention are typically used (including virtually all full-body harnesses 28 known to and researched by Applicant at present) only as life safety devices. As such, they are a one-use product. Any fall deploys destructible and replaceable elements that must then be replaced and the harness re-built before further use. Although "Aussie-style rappelling" relies on a climbing rope secured to the back of a waist belt, no falling is contemplated in such a "top-roped" scenario. Catching a falling climber 60 by the back of the waist belt of a seat-type harness is life-threateningly dangerous, and absolutely inappropriate.

As discussed hereinabove, even a person unable or unwilling to climb may be harnessed in, connected (clipped in 332) to the sling 314, and lifted along a modified path 320*b* to experience the fall 349 and swing 350. Of course, in certain embodiments of a wall 12, this may be awkward. However, if the swinging 350 actually starts at a location directly accessible to a sling 314 below a trolley 110, even a purely semicircular swing path 320*e*, 320*f* may begin with a lifting of a user 60 in a harness 28 or chair to a drop point. Tensioned lines 304 would need no additional movement of a center of pivot, as discussed with respect to various alternative embodiments discussed hereinabove.

In general, for most circumstances, however, the time allotted to a climb may be set, and a climber may begin climbing, belayed 337 from a pivot point 100 above. Upon successful and timely arrival at an actuator bar, button, ring, or the like at the top of the climbing route, the climber may strike the actuator and receive a light, buzzer, blinking display of time elapsed, or other celebratory feedback from the system 10. A climber may be timed out after the elapsed time set in advance. One may time out due to failure to strike the actuator for any reason. One may be unsuccessful due to dallying, too slow progress, inability to navigate holds 30, or the like. If timed out for any reason, the climber may be drawn from the wall by the lines connected to the harness. The fall may be delayed or immediate. It may be safest to draw the user 60 upward and away from the wall 12 to a predetermined "fall start point." This may preclude any striking or scuffing by the rider 60 or climber 60 against the wall 12 or holds fastened to it. The fall may then be very predictable, whether it be a true semicircular path or "pendulum fall" or a modified pendulum fall comprised of a fall below a moving trolley 110, eventually becoming a pendulum swing after the trolley 110 (positioner 18) comes to halt above.

In various embodiments a line 27 for belaying 337 and swinging 350 may be made up of various components, such as the lines 304, sling 314, spreader 300 and so forth. It may terminate at an anchor point for the block 306*b* or may be wrapped around a capstan as a takeup 290. In fact, a line may have two ends or be part of an "endless loop" with no ends, to be moved in a reciprocating fashion. Each type of takeup system 290 has it benefits, burdens, costs, and risks. Capstans must be fast and rely on friction to retract and pay out a line 27. Hydraulics are heavy, involve much framing support, as well as oil handling and pumping. However, they provide high ratios of line length to piston movement.

Winches or other reels are typically slower than either, and may require some opposing force to draw a line 27 out of the winch. In fact, most winches are ratcheted or worm driven.

Figure 58:
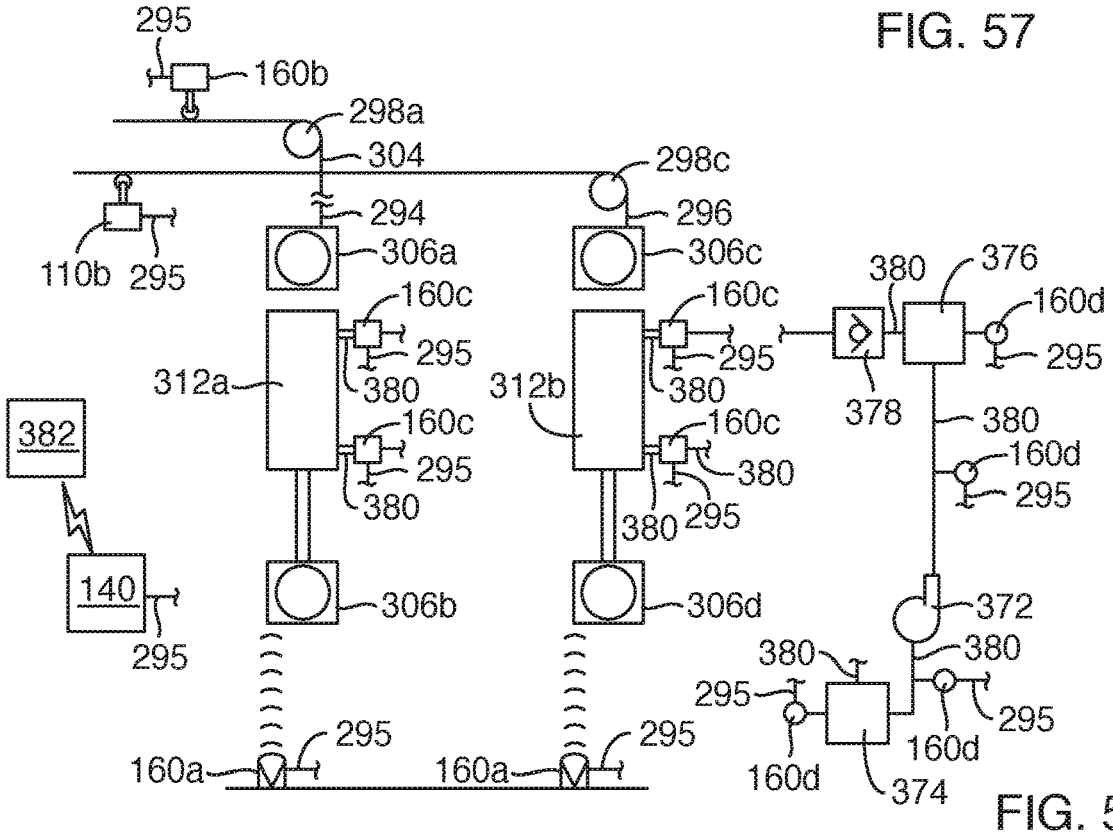
FIG. 58 is a schematic block diagram of hydraulic control and monitoring.

Referring to FIG. 58, each of the sensors 160*a* is a distance sensor 160*a* and a controller 160*a* responsible to verify the position of the moveable (lower) blocks 306*b*, 306*d*. Thus, if displacement of the block 306*b*, 306*d* is incorrect, inadequate, or the like, information from the distance sensors 160*a* will connect through a communication line 295 to the controller 140, which may ultimately report to a remote computer 382 over a connection, illustrated by the radio signal, such as the internet or another network.

The force sensors 160*b* operate on lines 294, 296 or may detect forces on the pulleys 298*a*, 298*c*. Thus, tension or slack may be detected and measured for feedback control of valves 160*c*, which are actually combined sensors 160*c* and flow control valves 160*c* or flow in and out of the hydraulic cylinders 312*a*, 312*b*. Thus, the controller 140 through communication lines 295 may receive inputs from and send signals to each of the sensors 160 (160*a*, 160*b*, 160*c*). All may be reported to or controlled by the controller 140 or through it by the remote computer 382.

The pump 372 provides pressurized oil into the lines 380 downstream, including to the pressure tank 376. The pressure tank 376 may provide a biased pressure to the belay cylinder 312*a*. Either cylinder 312*a*, 312*b* may be pressurized by the pump 372 directly through connecting lines 380 which also represent schematically return lines 380 into the sump 374 from which the pump 372 draws.

The pressure sensors 160*d* connected to the various hydraulic lines 380 feedback information to the controller 140 through lines 295 (data communication links 295) to assist in control of the pump 372, pressure tank 376, hydraulic cylinders 312*a*, 312*b*, and so forth by the controller 140.

Thus, all active elements and moving parts may be monitored by sensors 160, which may include controls, reporting back to the controller 140 and remote computer 382 at all times. Therefore, no active component can escape observation, control, and a halt command if operation is not within the predetermined value of its operational parameters (e.g., force, tension, pressure, displacement, position, speed, acceleration, and so forth). Thus, in general, the lines 295 represent a communication connection of wire or wireless type to and from the controller 140 recording all sensors 160. Likewise, each hydraulic cylinder 312*a*, 312*b*, can receive from the pump 372 pressurized oil and return released (unpressurized) oil through appropriate hydraulic lines 380 into the sump 374 as directed.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of thrill riding combining climbing and swinging, the method comprising:

providing a climbing structure extending upward from a surface, a pivot point moveable thereabove from a first position proximate the climbing structure to a second position spaced away therefrom, and a line extending from the pivot point and capable of connecting to a user harnessed and proximate the surface;

belaying the user by taking up the line during the user climbing up the climbing structure;

swinging the user by initiating falling of the user, supported by the line, away from the climbing structure; and precluding contact between the user and the climbing structure during the swinging by moving the pivot point from the first position to the second position during the falling.

2. For use in the method of claim 1:

a climbing wall as a portion of the climbing structure; and a belay takeup device operably connected to take up slack in the line.

3. For use in the method of claim 2:

a track;

a trolley as a carrier of the pivot point and capable of traveling along the track between the first position and second position; and a trolley takeup device capable of moving the trolley to the first position and releasing the trolley to travel to the second position in response to weight of the user.

4. The method of claim 1, comprising:

attenuating the swinging by drawing the trolley and pivot point toward the climbing structure during a portion of the swinging toward the climbing structure.

5. The method of claim 4, comprising:

controlling height of a user above the surface by moving the trolley with the line passing over a sheave, on the trolley, defining the pivot point as a center of rotation of the sheave.

6. An apparatus comprising:

a climbing structure;

a support system providing a center of pivot positioned above the climbing structure to support the center of pivot in a first position proximate the climbing structure and a second position spaced away from the climbing structure;

a line descending from the center of pivot and capable of connecting to and belaying a user ascending the climbing structure;

a belay takeup effective to tension, retrieve, and pay out the line, independently from movement of the pivot point;

a trolley providing support and movement of the pivot point in moving along a track; and a trolley takeup system capable of moving the trolley toward the climbing structure and away from the climbing structure, independently from operation of the belay takeup.

7. The apparatus of claim 6, wherein:

the track is secured to the support system and extending in a direction away from the climbing structure;

the center of pivot is secured to be selectively movable along the rail; and the line is reaved over sheaves on the support system and the center of pivot to descend to the user while ascending.

8. The apparatus of claim 6, comprising a wall as part of the climbing structure, provided with holds and texturing for engagement by the user in the ascending.

9. The apparatus of claim 6, comprising a controller capable of controlling the belay takeup and the trolley takeup system during the ascending and a pendulum fall subsequent to the ascending.

10. The apparatus of claim 9, comprising:

a harness capable of connecting the user to the line and supporting the user during the pendulum fall;

the controller programmed to belay the user by tensioning the line during the ascending and locking the line against paying out from the belay takeup consequent to a fall of the user from the climbing structure.

11. The apparatus of claim 10, wherein the controller is programmed to control the belay takeup paying out the line to lower the user to the surface by paying out the line over the center of pivot in a fixed position thereof.

12. The apparatus of claim 9, wherein the trolley is movable away from the climbing structure during the pendulum fall.

13. The apparatus of claim 12, wherein the line has an effective length between the user and the belay takeup, and the effective length is constant during the pendulum fall.

14. A method of amusement riding comprising:

providing a climbing structure extending upward away from a surface, a belay line capable of connecting to and belaying a user ascending the climbing structure, a support system oriented to swing the user on the belay line away from the climbing structure in response to a pendulum fall by the user, a center of pivot about which the belay line turns down to the user and which remains movable away from the climbing structure during the pendulum fall;

connecting to a proximate end of the belay line a harness secured about the user proximate the surface;

taking up slack in the belay line;

drawing the user toward a registration position proximate the climbing structure and the support system;

dropping the user in a pendulum fall by moving the pivot point away from the climbing structure;

swinging by the user away from and then back toward the climbing structure;

attenuating the swinging by moving the center of pivot toward the climbing structure during the swinging back toward the climbing structure; and descending the user to the surface by paying out the belay line with the pivot point remaining in a fixed location.

* * * * *